US007599647B2

(12) United States Patent
Takiguchi et al.

(10) Patent No.: US 7,599,647 B2
(45) Date of Patent: Oct. 6, 2009

(54) CHARGING DEVICE AND ELECTROPHOTOGRAPHIC APPARATUS INCLUDING THE SAME

(75) Inventors: Toshiki Takiguchi, Yamatokoriyama (JP); Tatsuya Inoue, Nara (JP); Hirokazu Yamauchi, Uji (JP); Kazuhiro Matsuyama, Ikoma (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 277 days.

(21) Appl. No.: 11/586,726

(22) Filed: Oct. 26, 2006

(65) Prior Publication Data

US 2007/0098445 A1 May 3, 2007

(30) Foreign Application Priority Data

Oct. 26, 2005 (JP) ..... 2005-311936
Oct. 26, 2005 (JP) ..... 2005-311937
Oct. 26, 2005 (JP) ..... 2005-311938
Oct. 26, 2005 (JP) ..... 2005-311939
Oct. 19, 2006 (JP) ..... 2006-285151

(51) Int. Cl.
*G03G 15/02* (2006.01)

(52) U.S. Cl. ..... 399/171; 399/170

(58) Field of Classification Search ..... 399/168, 399/170, 171, 172
See application file for complete search history.

(56) References Cited

U.S. PATENT DOCUMENTS 5,025,155 A 6/1991 Hattori
5,523,834 A * 6/1996 Ito ..... 399/315
5,970,287 A * 10/1999 Yamaguchi ..... 399/168
2002/0051920 A1 5/2002 Owaki et al.
2005/0053397 A1 3/2005 Sekovski et al.
2005/0074254 A1 * 4/2005 Maeda ..... 399/92

FOREIGN PATENT DOCUMENTS

JP 1-232369 A 9/1989
JP 2-55253 U 4/1990
JP 10-274873 A 10/1990
JP 5-181348 A 7/1993
JP 10-142904 A 5/1998
JP 11-352713 A 12/1999
JP 2000-137368 A 5/2000
JP 2000-206763 A 7/2000
JP 2002-108032 A 4/2002
JP 2003-91209 A 3/2003
JP 2005-84688 A 3/2005

* cited by examiner

*Primary Examiner*—Hoang Ngo
(74) *Attorney, Agent, or Firm*—Nixon & Vanderhye, P.C.

(57) ABSTRACT

In an image forming apparatus of the present invention, a scorotron charging device has a meshed grid electrode which is meshed more coarsely in a high-speed apparatus than a meshed grid electrode in a low-speed apparatus according to a circumferential velocity of a photoreceptor. With this arrangement, it is possible to charge the photoreceptor at a predetermined potential in the high-speed apparatus, without increase of the amount of ozone generation and upsizing of the image forming apparatus.

5 Claims, 44 Drawing Sheets

| CIRCUMFERENTIAL VELOCITY OF PHOTORECEPTOR (mm/sec) | SLIT WIDTH (mm) | RESULT |
|---|---|---|
| 350 | 1.0,1.2 | ○ |
| 350 | 1.4 | ○ |
| 350 | 1.6 | ○ |
| 350 | 1.8 | ○ |
| 350 | 2.0 | ○ |
| 350 | 2.2 | ×1 |
| 350 | 2.4 | ×2 |
| 350 | 2.6 | ×2 |
| 350 | 2.8 | ×2 |
| 400 | 1.0 | ×× |
| 400 | 1.2 | ×× |
| 400 | 1.4 | ○ |
| 400 | 1.6 | ○ |
| 400 | 1.8 | ○ |
| 400 | 2.0 | ○ |
| 400 | 2.2 | ×1 |
| 400 | 2.4 | ×1 |
| 400 | 2.6 | ×2 |
| 400 | 2.8 | ×2 |
| 450 | 1.0 | ×× |
| 450 | 1.2 | ×× |
| 450 | 1.4 | ×× |
| 450 | 1.6 | ○ |
| 450 | 1.8 | ○ |
| 450 | 2.0 | ○ |
| 450 | 2.2 | ○ |
| 450 | 2.4 | ×2 |
| 450 | 2.6 | ×2 |
| 450 | 2.8 | ×2 |

| CIRCUMFERENTIAL VELOCITY OF PHOTORECEPTOR (mm/sec) | SLIT WIDTH (mm) | RESULT |
|---|---|---|
| 500 | 1.4 | ×× |
| 500 | 1.6 | ×× |
| 500 | 1.8 | ○ |
| 500 | 2.0 | ○ |
| 500 | 2.2 | ○ |
| 500 | 2.4 | ○ |
| 500 | 2.6 | ×2 |
| 500 | 2.8 | ×2 |
| 600 | 1.4 | ×× |
| 600 | 1.6 | ×× |
| 600 | 1.8 | ○ |
| 600 | 2.0 | ○ |
| 600 | 2.2 | ○ |
| 600 | 2.4 | ○ |
| 600 | 2.6 | ○ |
| 600 | 2.8 | ×2 |

SECTION A-A

FIG. 8

| CIRCUMFERENTIAL VELOCITY OF PHOTORECEPTOR (mm/sec) | SLIT WIDTH (mm) | RESULT |
|---|---|---|
| 350 | 1.0,1.2 | ○ |
| 350 | 1.4 | ○ |
| 350 | 1.6 | ○ |
| 350 | 1.8 | ○ |
| 350 | 2.0 | ○ |
| 350 | 2.2 | ×1 |
| 350 | 2.4 | ×2 |
| 350 | 2.6 | ×2 |
| 350 | 2.8 | ×2 |
| 400 | 1.0 | ×× |
| 400 | 1.2 | ×× |
| 400 | 1.4 | ○ |
| 400 | 1.6 | ○ |
| 400 | 1.8 | ○ |
| 400 | 2.0 | ○ |
| 400 | 2.2 | ×1 |
| 400 | 2.4 | ×1 |
| 400 | 2.6 | ×2 |
| 400 | 2.8 | ×2 |
| 450 | 1.0 | ×× |
| 450 | 1.2 | ×× |
| 450 | 1.4 | ×× |
| 450 | 1.6 | ○ |
| 450 | 1.8 | ○ |
| 450 | 2.0 | ○ |
| 450 | 2.2 | ○ |
| 450 | 2.4 | ×2 |
| 450 | 2.6 | ×2 |
| 450 | 2.8 | ×2 |

| CIRCUMFERENTIAL VELOCITY OF PHOTORECEPTOR (mm/sec) | SLIT WIDTH (mm) | RESULT |
|---|---|---|
| 500 | 1.4 | ×× |
| 500 | 1.6 | ×× |
| 500 | 1.8 | ○ |
| 500 | 2.0 | ○ |
| 500 | 2.2 | ○ |
| 500 | 2.4 | ○ |
| 500 | 2.6 | ×2 |
| 500 | 2.8 | ×2 |
| 600 | 1.4 | ×× |
| 600 | 1.6 | ×× |
| 600 | 1.8 | ○ |
| 600 | 2.0 | ○ |
| 600 | 2.2 | ○ |
| 600 | 2.4 | ○ |
| 600 | 2.6 | ○ |
| 600 | 2.8 | ×2 |

SECTION A-A

SECTION A-A

SECTION A-A

| | CIRCUMFERENTIAL VELOCITY OF PHOTORECEPTOR (mm/sec) | | | |
|---|---|---|---|---|
| | 250 | 400 | 500 | 600 |
| ◇ | 600 | 580 | 570 | 560 |
| □ | 660 | 640 | 620 | 610 |
| △ | 700 | 685 | 660 | 640 |
| × | 650 | 645 | 640 | 630 |
| ✳ | 700 | 680 | 655 | 645 |
| ⊕ | 725 | 705 | 690 | 675 |
| + | 690 | 675 | 660 | 640 |
| ▬ | 755 | 730 | 705 | 685 |
| ○ | 765 | 740 | 715 | 695 |
| ◈ | 710 | 685 | 675 | 650 |
| ▣ | 765 | 735 | 710 | 700 |
| ◬ | 780 | 745 | 720 | 710 |

CIRCUMFERENTIAL VELOCITY OF PHOTORECEPTOR (mm/sec)

| | SLIT WIDTH (mm) | | | | |
|---|---|---|---|---|---|
| | 1.2 | 1.4 | 2.4 | 2.6 | |
| —◇— | 480 | 580 | 640 | 685 | PHOTORECEPTOR CHARGING POTENTIAL (-V) |
| —□— | 540 | 630 | 655 | 690 | |
| —△— | 580 | 645 | 680 | 705 | |
| —✕— | 610 | 675 | 730 | 740 | |
| —✳— | 655 | 685 | 735 | 745 | |
| —◉— | 440 | 570 | 620 | 660 | |
| —+— | 510 | 610 | 640 | 670 | |
| —▬— | 550 | 640 | 655 | 690 | |
| —○— | 580 | 660 | 705 | 715 | |
| —◈— | 625 | 675 | 710 | 720 | |
| —▣— | 390 | 560 | 610 | 640 | |
| —▲— | 485 | 600 | 640 | 660 | |
| ----✕---- | 520 | 630 | 645 | 675 | |
| ----✳---- | 560 | 640 | 685 | 695 | |
| ----◉---- | 620 | 650 | 700 | 710 | |
| ----+---- | 350 | 550 | 600 | 630 | |
| ----▬---- | 460 | 590 | 630 | 640 | |
| ----◈---- | 490 | 600 | 640 | 655 | |
| ----▣---- | 530 | 620 | 660 | 670 | |
| ----▲---- | 600 | 630 | 685 | 690 | |

SECTION A-A

CHARGING DEVICE AND ELECTROPHOTOGRAPHIC APPARATUS INCLUDING THE SAME

This Nonprovisional application claims priority under 35 U.S.C. § 119(a) on Patent Application Nos. 311936/2005, 311937/2005, 311938/2005, 311939/2005 all of which were filed in Japan on Oct. 26, 2005, and Patent Application No. 285151/2006 filed in Japan on Oct. 19, 2006 the entire contents of which are hereby incorporated by reference.

FIELD OF THE INVENTION

The present invention relates to (i) a charging device which is installed in an electrophotographic apparatus and charges a surface of a photoreceptor that is an electrostatic latent image carrier, and (ii) an electrophotographic apparatus including the charging device.

BACKGROUND OF THE INVENTION

In recent years, a print speed of image forming apparatuses has been further increased. In case of an electrophotographic apparatus utilizing electrophotography among the image forming apparatuses, a circumferential velocity of a photoreceptor that is an electrostatic latent image carrier needs to be increased for a high-speed printing.

Techniques for increasing a circumferential velocity of a photoreceptor are: (a) a technique of increasing a diameter of a photoreceptor without increasing an RPM and (b) a technique of increasing an RPM without increasing a diameter of a photoreceptor. However, the technique (b) is exclusively chosen to avoid upsizing of the apparatus.

Especially in a high-speed apparatus including a photoreceptor of a high circumferential velocity, an essential technique is a technique of stably charging the photoreceptor in a state where a surface potential of the photoreceptor is at a predetermined potential (set charging potential). This is because an unstable surface potential of the photoreceptor results in (i) the phenomenon called "base fogging" caused by changes of the surface potential and (ii) decrease in print density. Further, a too high surface potential contributes to "deterioration of a photoreceptor" in consideration of a withstand voltage for a charging potential of the photoreceptor.

Charging devices which charge the surface of a photoreceptor are classified into (i) contact-type charging devices using a charging roller, a charging brush, or the like and (ii) noncontact-type charging devices typified by a corona charging device using corona discharge.

In the contact-type charging devices, electrons are attached onto a photoreceptor while a charging member such as roller or brush is brought into direct contact with the photoreceptor. This realizes an efficient charging and circumvents the need for a high voltage as a voltage applied to the charging member. Besides, the contact-type charging devices generates an extremely small amount of ozone, which is a cause of environmental pollution, and are excellent in terms of ecological activities.

However, in the contact-type charging devices, a voltage can be usually applied only to a 3 to 5 mm wide nip region where the photoreceptor and a contact member come into contact with each other. Because of this, the contact-type charging devices have a small voltage application area. For the reason of this drawback, it is possible to charge the photoreceptor at a predetermined potential in a low-speed apparatus, but it is difficult to charge the photoreceptor at the predetermined potential in a high-speed apparatus. In addition, since the charging member is in direct contact with the photoreceptor, dust or the like on the contact member is likely to adhere to the photoreceptor. In the high-speed apparatus adopting the contact-type charging device, damage to the surface of the photoreceptor caused by the adherents is a big problem.

On the other hand, since the noncontact-type. charging devices use corona discharge, the noncontact-type charging devices requires a higher voltage than that of the contact-type charging device and therefore generates ozone. However, the noncontact-type charging devices have a merit that a large voltage application area can be secured, and makes it possible to charge the surface of the photoreceptor at the predetermined potential even in a high-speed apparatus. Moreover, since the noncontact-type charging device eliminates a direct contact with the photoreceptor, damage to the surface of the photoreceptor occurs less often.

Now, referring to FIG. 45, the structure of a corona charging device is briefly described. As illustrated in FIG. 45, the corona charging device has charger lines 141 which are subjected to application of a high voltage. The charger lines 141 are held and shielded in a charger case 142. The charger case 142 has an open surface facing a photoreceptor. The charger case 142 is located in such a manner that the charger lines 141 face the photoreceptor via the open surface. The charger lines 141 are located in such a manner that an axial direction of the charger lines 141 is orthogonal to a rotational direction of the photoreceptor.

In such a structure, the voltage application area is determined depending upon a width of the charger case 142 (width of the photoreceptor in the rotational direction of the photoreceptor). The width of the charger case 142 can be increased with increase of the number of charger lines 141 provided in the charger case 142.

The corona charging devices are classified into corotron charging devices and scorotron charging devices as described in Japanese Unexamined Patent Publication No. 142904/1998 (Tokukaihei 10-142904; published on May 29, 1998), for example.

The corotron charging devices and the scorotron charging devices are different in the presence or absence of a grid electrode. The corona charging device illustrated in FIG. 45 is a scorotron charging device wherein a meshed grid electrode 143 which is subjected to a bias voltage is disposed between the charger lines 141 and the photoreceptor.

The charger lines 141 vibrate when a high voltage is applied thereto. In the corotron charging device which does not include the grid electrode 143 has the problem that a distance between the photoreceptor and the charger liens 141 changes during voltage application and a charging potential varies in a direction orthogonal to the rotational direction of the photoreceptor.

On the contrary, in the scorotron charging device including the grid electrode 143, even when the charger lines 141 vibrate, a current supplied from the charger lines 141 and passing through the grid electrode 143 is absorbed at a bias voltage applied to the photoreceptor and the grid electrode 143, which regulates the charging potential. This saturates and uniforms the surface potential of the photoreceptor.

A saturation value that is a charging potential of the photoreceptor can be controlled by a voltage applied to the grid electrode 143. Assume that a discharge potential which occurs when a high voltage is applied to the charger lines 141 is represented by "A", and a bias voltage which is applied to the grid electrode 143 is represented by "B". When $A>B$, the saturation value takes B. When $A \leqq B$, the saturation value is below B.

Thus, as compared with the corotron charging device, the scorotron charging device is of more complex structure and inferior in charging efficiency due to provision of the grid electrode 143. However, the scorotron charging device has been used in most cases as a charging device using a corona discharge because the scorotron charging device has an advantage of controlling a charging potential and is capable of uniformly charging the surface of the photoreceptor.

The grid electrode 143 is realized by an electrically conductive thin plate made of a material such as SUS (0.1 mm thick) having a plurality of slits or polygonal openings, such as hexagonal openings, formed by etching or the like method.

Conventionally, in case of the grid electrode 143 having slits as the openings, a grid electrode having a slit width ranging from 1.0 mm to 1.4 mm and a slit pitch ranging from 1.16 mm to 1.56 mm is used in most cases. In case of the grid electrode 143 having hexagonal openings as the openings, a grid electrode having a 2.5 mm to 3.4 mm diameter of a circumcircle around the hexagonal opening and a 2.75 mm to 3.65 mm pitch between the circumcircles is used in most cases.

However, the conventional corona charging device has the following problems to be solved.

A circumferential velocity of the photoreceptor has been increased to meet a demand for high-speed printing. However, it is difficult to make a potential of the photoreceptor reach the predetermined potential only by the measure of increasing a voltage application area by increasing the width of the charger case.

In other words, in the corona charging device, the voltage application area can be increased with increase of the width of the charger case 142 (width in a rotational direction of the photoreceptor). However, various kinds of known members used in the Carlson process, including not only the charging device, but also a developing device, cleaning device, and a transfer device, are disposed around the photoreceptor. As such, increase of the voltage application area by increasing a width of the charger case 142 has a ceiling. Excessive increase of a width of the charger case 142 takes up a space for disposing other members. This results in increase of a drum diameter of the photoreceptor, thus upsizing the image forming apparatus.

Further, Japanese Unexamined Patent Publication No. 137368/2000 (Tokukai 2000-137368; published on May 16, 2000) discloses the arrangement in which a plurality of scorotron charging sections are provided side by side around a photoreceptor drum, wherein the charging section located. on the most upstream side in the rotational direction of the photoreceptor drum includes openings of the highest aperture ratio and the charging section on the most downstream side in the rotational direction of the photoreceptor drum includes openings of the lowest aperture ratio.

However, even the arrangement disclosed in Japanese Unexamined Patent Publication No. 137368/2000, i.e. the arrangement in which a plurality of corona charging devices are provided side by side around the photoreceptor drum cannot solve the problem of up sizing.

Apart from the measure of increasing the voltage application area, application of an extremely high voltage to the charger lines 141 is also considered as a measure for causing a potential of the photoreceptor to reach a predetermined potential in the high-speed apparatus. However, such a measure is not preferable because it inevitably increases the amount of ozone generation and it runs counter to ecological activities.

It was found out that further increase of a circumferential velocity of the photoreceptor makes it difficult to uniformly and stably charge the photoreceptor at a predetermined potential, which is determined by the grid electrode.

FIG. 46 illustrates a result of the examination on a relation between a current flown to the charger lines (hereinafter also referred to as "wire current") and a surface potential of the photoreceptor (hereinafter also referred to as "drum surface potential") in an image forming apparatus serving as an electrophotographic apparatus and including the scorotron charging device in a state where a circumferential velocity of the photoreceptor is increased stepwise to a higher value than a conventional value. Here, assume that the upper limit of the wire current is 900 μA. This is because the amount of ozone generation remarkably increases when the wire current exceeds 900 μA.

In FIG. 46, a horizontal axis represents the wire current, and vertical axes represent the drum surface potential and a voltage applied to the charger lines 141 (hereinafter also referred to as "wire voltage"). Assume that a voltage applied to the grid electrode 143 (grid potential) was 650 (—V) that is a target potential for the drum surface potential. The grid electrode 143 was a 0.1 mm-thick thin plate made of SUS including a plurality of slits, wherein a width of an electrode line provided between the slits was in the range from 0.15 mm to 0.17 mm (error of 0.16 mm±0.01 mm), and a slit width was 1.2 mm (slit pitch ranging from 1.35 mm to 1.37 mm (error of 1.36 mm±0.01 mm)). The two charger lines 141, which were made of Φ60-μ tungsten wire, were placed side by side in a rotational direction of the photoreceptor. The charger lines 141 shared one electrode.

As illustrated in FIG. 46, when the circumferential velocity is 240 mm/sec, the drum surface potential reaches −650 V, which is a grid potential, and saturates. However, when the circumferential velocity is 420 mm/sec, the drum surface potential stops rising before reaching the grid potential. When the circumferential velocity is further increased to 600 mm/sec, the drum surface potential becomes far below the grid potential.

As a result, it was found out that the relation between the wire current and the drum surface potential was significantly influenced by the circumferential velocity of the photoreceptor, and that the drum surface potential became far below the grid potential as the circumferential velocity increased. It was found out that curves representing the drum surface potential relative to the wire current were similar to each other regardless of the circumferential velocity, and that the curves shifted to 0V as the circumferential velocity increased.

SUMMARY OF THE INVENTION

An object of the present invention is to provide a charging device and an electrophotographic apparatus which can charge a photoreceptor at a predetermined potential in a high-speed apparatus or can uniformly and stably charge a photoreceptor at a predetermined potential, without increase of the amount of ozone generation and without upsizing of the image forming apparatus.

In order to achieve the above object, the Applicant of the present invention conducted various kinds of studies to realize stable charging of an electrostatic latent image carrier that rotates at a high speed at a predetermined potential with the use of a charging device which performs scorotron charging by a method other than the method of increasing a width of the charger case for increase of the voltage application area.

As a result of the studies, the Applicant found out that by using a grid electrode having a more coarse mesh when a circumferential velocity of the photoreceptor is high than that of a grid electrode used when the circumferential velocity is low, it is possible to cause a surface potential of the photoreceptor to reach a grid potential without application of so high voltage to generate ozone in an amount that brings a problem, and completed the invention of the present application.

A first charging device of the present invention is a charging device which is installed in an electrophotographic apparatus and charges at a predetermined potential a surface of an electrostatic latent image carrier which is driven for rotation, the charging device comprising: at least one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a meshed grid electrode which is placed so as to face the open surface of the shield electrode, wherein: the grid electrode is arranged to be a fine-meshed grid electrode as a circumferential velocity of the electrostatic latent image carrier is low, and to be a coarse-meshed grid electrode as a circumferential velocity of the electrostatic latent image carrier is high.

A first electrophotographic apparatus of the present invention is an electrophotographic apparatus comprising: an electrostatic latent image carrier which retains an electrostatic latent image formed on a surface thereof and is driven for rotation; and a charging device which charges a surface of the electrostatic latent image carrier at a predetermined potential, the charging device being realized by one scorotron charger, the scorotron charger comprising: at least one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a meshed grid electrode which is placed so as to face the open surface of the shield electrode, wherein: the grid electrode is arranged to be a fine-meshed grid electrode as a circumferential velocity of the electrostatic latent image carrier is low, and to be a coarse-meshed grid electrode as a circumferential velocity of the electrostatic latent image carrier is high.

According to this arrangement, the grid electrode used in the high-speed apparatus is meshed more coarse than the grid electrode used in a low-speed apparatus. It is considered that the use of a coarse-meshed grid electrode decreases a current absorbed by the grid electrode (current supplied from the charger line to the electrostatic latent image carrier) and therefore causes much more currents to reach the electrostatic latent image carrier. For the high-speed apparatus, even when the length of a time that the electrostatic latent image carrier passes through the voltage application region (width of the shield electrode) becomes shorter in the high-speed apparatus, it is possible to enhance charging performance.

As a result, it is possible to charge an electrostatic latent image carrier at a predetermined potential in the high-speed apparatus, without increase of the amount of ozone generation and without upsizing of the image forming apparatus.

In order to achieve the above object, the Applicant of the present invention has conducted various studies. As a result of the studies, the Applicant found out that a photoreceptor could be charged uniformly and stably at a predetermined potential in the high-speed apparatus while increase in the amount of ozone generation and upsizing of the image forming apparatus were minimized, by a stepwise-charging such that the surface of the electrostatic latent image carrier was charged at a potential close to a desired set charging potential (predetermined potential) and then uniformly charged at the set charging potential, and the Applicant completed the invention of the present application.

A second charging device of the present invention is a charging device which is installed in an electrophotographic apparatus and charges at a predetermined potential a surface of an electrostatic latent image carrier which is driven for rotation, the charging device comprising: a coarse charging section which charges the surface of the electrostatic latent image carrier at a potential close to the predetermined potential; and an adjustment charging section which uniformly charges at the predetermined potential the surface of the electrostatic latent image carrier that has been charged by the coarse charging section, the coarse charging section and the adjustment charging section being realized by one scorotron charger, the scorotron charger comprising: at least one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a grid electrode which is realized by a mesh member and placed so as to face the open surface of the shield electrode, wherein: the grid electrode has a coarse region that is coarse meshed and a fine region that is fine meshed, and the coarse region is located on a upstream side in the rotational direction of the electrostatic latent image carrier.

In order to achieve the above object, a second electrophotographic apparatus of the present invention is an electrophotographic apparatus comprising: an electrostatic latent image carrier which retains an electrostatic latent image formed on a surface thereof and is driven for rotation; and a charging device which charges a surface of the electrostatic latent image carrier at a predetermined potential, the charging device comprising: a coarse charging section which charges the surface of the electrostatic latent image carrier at a potential close to the predetermined potential; and an adjustment charging section which uniformly charges at the predetermined potential the surface of the electrostatic latent image carrier that has been charged by the coarse charging section, the coarse charging section and the adjustment charging section being realized by one scorotron charger, the scorotron charger comprising: at least one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a grid electrode which is realized by a mesh member and placed so as to face the open surface of the shield electrode, wherein: the grid electrode has a coarse region that is coarse meshed and a fine region that is fine meshed, and the coarse region is located on a upstream side in the rotational direction of the electrostatic latent image carrier.

Here, the predetermined potential is a charging potential of the electrostatic latent image carrier determined by an electrophotographic apparatus in which a charging device is installed, and is also expressed as a set charging potential.

According to this arrangement, the coarse charging section coarsely charges the surface of the electrostatic latent image carrier at a potential close to the predetermined potential. Thereafter, the adjustment charging section uniformly charges the surface of the electrostatic latent image carrier at the predetermined potential. Since an object of charging in the coarse charging section is to attract the surface potential to a potential close to the predetermined potential, the charging in the coarse charging section does not require importance on uniformity and stability of a potential. As such, it is possible to achieve the object in a short charging time.

Charging in the adjustment charging section is provided for uniforming a surface potential being attracted to a potential close to the predetermined potential so as to stabilize the surface potential to the predetermined potential. As such, the charging in the adjustment charging section can achieve the object in a shorter period of time than one which uniformly and stably charges the surface potential from scratch.

Thus, stepwise charging is performed with (a) the coarse charging of attracting the surface potential of the electrostatic latent image carrier to a potential close to the predetermined potential and (b) the adjustment charging of making the surface potential attracted to the potential close to the predetermined potential uniform so as to stabilize the surface potential to the predetermined potential. This makes it possible to uniformly and stably charge the photoreceptor at a predetermined potential while minimizing increase of the amount of ozone generation and upsizing of the electrophotographic apparatus, even when the circumferential velocity of the electrostatic latent image carrier is further increased.

Further, according to the above arrangement, the coarse region is a region such that the mesh member is larger in mesh size than that in the fine region. The fine region is a region such that the mesh member is smaller in mesh size than that in the coarse region.

That is, as compared with the fine region, the coarse region has a larger opening area and a smaller number of openings per unit area, assuming that the coarse region and the fine region are identical in width of the electrode line provided between the openings. As compared with the coarse region, the fine region has a smaller opening area and a larger number of openings per unit area, assuming that the coarse region and the fine region are identical in width of the electrode line provided between the openings.

However, the coarse region and the fine region are not necessarily identical in width of the electrode line provided between the openings. The coarse region is meshed so coarsely that openings thereof are larger in size than those of the fine region. The fine region is meshed so finely that openings thereof are smaller in size than those of the coarse region.

With the grid electrode arranged so as to have such a coarse region and a fine region, it is possible to adjust a discharge current flown to the electrostatic latent image carrier differently between the regions. Thus, it is possible to perform charging control of the electrostatic latent image carrier differently between the coarse region and fine region.

More specifically, since the coarse region located on the upstream side of the rotational direction is coarse-meshed, the coarse region brings a small effect of adjusting the amount of discharge current passing toward the electrostatic latent image carrier to make the potential on the surface of the electrostatic latent image carrier uniform and stabilize the potential to the predetermined potential. However, since the coarse region passes a large amount of discharge current, it is possible to supply a sufficient amount of current to the surface of the electrostatic latent image carrier. This makes it possible to coarsely charge the surface of the electrostatic latent image carrier at a potential close to the predetermined potential in a short period of time.

On the other hand, since the fine region located downstream of the coarse region is fine-meshed, the amount of discharge current that the fine region passes is small. Therefore, the fine region is not suited to charge the electrostatic latent image carrier in a short period of time. However, the fine region appropriately controls the amount of discharge current passage to make the potential on the coarsely charged surface of the electrostatic latent image carrier uniform and stabilize the potential to the predetermined potential.

That is, according to this arrangement, by causing the grid electrode in the scorotron charger to have the coarse-meshed coarse region and the fine-meshed fine region, it is possible to cause the coarse region to serve the function of the coarse charging section, and to cause the fine region to serve the function of the adjustment charging section. In addition, since the coarse charging section and the adjustment charging section are realized by one scorotron charger, it is possible to avoid upsizing of the charging device even in the arrangement in which separate charging functions are provided.

In order to achieve the above object, a third charging device of the present invention is a charging device which is installed in an electrophoto-graphic apparatus and charges at a predetermined potential a surface of an electrostatic latent image carrier which is driven for rotation, the charging device comprising: one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is on the upstream side in the rotational direction of the electrostatic latent image carrier in relation to a position corresponding to a peak of intensity distribution of a surface potential of the electrostatic latent image carrier.

In order to achieve the above object, a third electrophotographic apparatus of the present invention is an electrophotographic apparatus comprising: an electrostatic latent image carrier which retains an electrostatic latent image formed on a surface thereof and is driven for rotation; and a charging device which charges a surface of the electrostatic latent image carrier at a predetermined potential, the charging device being realized by one scorotron charger, the scorotron charger comprising: one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is on the upstream side in the rotational direction of the electrostatic latent image carrier in relation to a position corresponding to a peak of intensity distribution of a surface potential of the electrostatic latent image carrier.

According to the above arrangements, as with the second charging device and the second electrophotographic apparatus, the third charging device and the third electrophotographic apparatus can perform coarse charging and adjustment charging by using one scorotron charger.

In addition, according to the above arrangements, since one wire is used, the intensity distribution of a surface potential of the electrostatic latent image carrier has one peak. According to the above arrangements, the boundary between the coarse region and the fine region is located on the upstream side in the rotational direction of the electrostatic latent image carrier in relation to a position corresponding to the one peak.

When the electrostatic latent image carrier is charged, a current (drum current) flows on the surface of the electrostatic latent image carrier. Intensity distribution of the drum current corresponds to intensity distribution of the surface potential of the electrostatic latent image carrier. That is, a value of the drum current is high in an area where the surface potential of the electrostatic latent image carrier is high. A value of the drum current is low in an area where the surface potential of the electrostatic latent image carrier is low. More specifically, a peak of the intensity distribution of the surface potential of the electrostatic latent image carrier corresponds to a maximum value of the drum current (peak of the drum current).

Therefore, the charging device of the present invention can be also expressed as follow: a boundary between the coarse region and the fine region is on the upstream side in the rotational direction of the electrostatic latent image carrier in relation to the position corresponding to the peak of the intensity distribution of the drum current.

Since the boundary between the coarse region and the fine region is at a position on the upstream side in the rotational direction of the electrostatic latent image carrier in relation to the position corresponding to the peak of the intensity distribution of the surface potential of the electrostatic latent image carrier (intensity distribution of the drum current), a size of the fine region can be made larger than that of the coarse region. With this arrangement, the region for adjustment charging can be made larger. This makes it possible to realize a stable charging.

Thus, by making a size of the coarse region different from a size of the fine region and by placing the regions in the aforesaid order, it is possible for the regions to perform proper charging in a proper order. It is therefore possible to charge the electrostatic latent image carrier at a predetermined potential in a high-speed apparatus, without increasing the amount of ozone generation and without upsizing the electrophotographic apparatus.

In order to achieve the above object, a fourth charging device of the present invention is a charging device which is installed in an electrophotographic apparatus and charges at a predetermined potential a surface of an electrostatic latent image carrier which is driven for rotation, the charging device comprising: a plurality of wires which are subjected to application of a high voltage and placed at positions that face the electrostatic latent image carrier so that axial direction of the wires is orthogonal to a rotational direction of the electrostatic latent image carrier; a shield electrode which shields the wires and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is located at a position corresponding to a valley of intensity distribution of a surface potential of the electrostatic latent image carrier.

In order to achieve the above object, a fourth electrophotographic apparatus of the present invention is an electrophotographic apparatus comprising: an electrostatic latent image carrier which retains an electrostatic latent image formed on a surface thereof and is driven for rotation; and a charging device which charges a surface of the electrostatic latent image carrier at a predetermined potential, the charging device being realized by one scorotron charger, the scorotron charger comprising: a plurality of wires which are subjected to application of a high voltage and placed at positions that face the electrostatic latent image carrier so that axial direction of the wires is orthogonal to a rotational direction of the electrostatic latent image carrier; a shield electrode which shields the wires and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is located at a position corresponding to a valley of intensity distribution of a surface potential of the electrostatic latent image carrier.

According to the above arrangements, as with the second charging device and the second electrophotographic apparatus, the fourth charging device and the fourth electrophotographic apparatus can perform coarse charging and adjustment charging by using one scorotron charger.

In addition, according to the above arrangements, since a plurality of wires are used, the intensity distribution of the surface potential of the electrostatic latent image carrier has a plurality of peaks. In other words, a valley exists in the intensity distribution of the surface potential of the electrostatic latent image carrier.

As described previously, when the electrostatic latent image carrier is charged, a current (drum current) flows on the surface of the electrostatic latent image carrier. Intensity distribution of the drum current corresponds to intensity distribution of the surface potential of the electrostatic latent image carrier. That is, a value of the drum current is high in an area where the surface potential of the electrostatic latent image carrier is high. A value of the drum current is low in an area where the surface potential of the electrostatic latent image carrier is low. More specifically, a peak in the intensity distribution of the surface potential of the electrostatic latent image carrier is a maximum value of the drum current (peak of the drum current), and a valley in the intensity distribution of the surface potential of the electrostatic latent image carrier is a minimum value of the drum current (valley of the drum current).

According to the above arrangement, the grid electrode is arranged so as to be located at a position corresponding to a valley in the intensity distribution of the surface potential of the electrostatic latent image carrier (at a position corresponding to a valley of the drum current). That is, the grid electrode is arranged such that the boundary between the coarse region and the fine region is located at a position corresponding to a valley in the intensity distribution, which the valley exists between the peak in the intensity distribution of the surface potential of the electrostatic latent image carrier and its adjacent peak.

As described previously, the peak of the drum current corresponds to a high current flowing on the surface of the electrostatic latent image carrier. Therefore, at the peak of the drum current, contribution to charging of the electrostatic latent image carrier is significant. Thus, when the boundary between the coarse region and the fine region is sited in the vicinity of the peak of the drum current, slight displacement of the boundary significantly changes the amount of current flowing on the surface of the electrostatic latent image carrier. This makes it difficult to perform stable charging.

On the other hand, the valley of the drum current corresponds to a low current flowing on the surface of the electrostatic latent image carrier. Therefore, at the valley of the drum current, contribution to charging of the electrostatic latent image carrier is insignificant. Thus, when the boundary between the coarse region and the fine region is sited in the vicinity of the valley of the drum current, slight displacement of the boundary slightly changes the amount of current flowing on the surface of the electrostatic latent image carrier. As a result, stable charging and easy charging control become possible.

Thus, it is possible to charge the electrostatic latent image carrier at a predetermined potential in the high-speed apparatus, without increase of the amount of ozone generation and without upsizing of the image forming apparatus.

In the charging device of the present invention, it is preferable that the fine region has an area larger than that of the coarse region. According to the above arrangement, since the region for adjustment charging can be made larger, it is possible to efficiently perform stable charging.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 8 is a view illustrating results of photoreceptor charging with variations of a circumferential velocity of the photoreceptor and a slit width of a grid electrode in the scorotron charging device.

DESCRIPTION OF THE EMBODIMENTS

The following will describe embodiments of the present invention with reference to drawings. It is to be noted that the present invention is not limited to the embodiments.

[First Embodiment]

The following will describe an embodiment of the present invention with reference to FIGS. 1 through 8.

Figure 3:
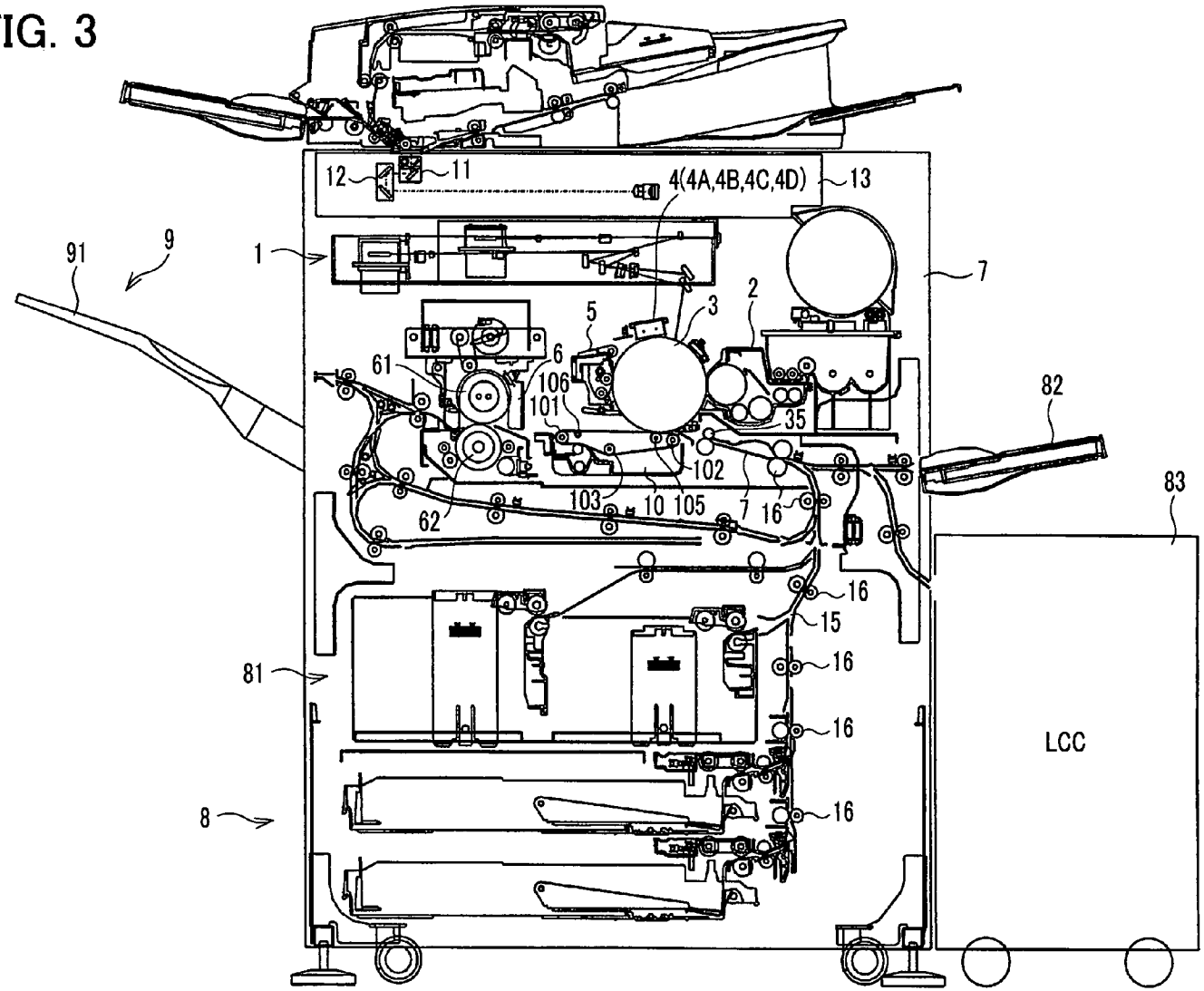
FIG. 3 is a view illustrating the structure of an image forming apparatus which includes charging devices of First through Fourth Embodiments of the present invention.

First of all, referring to FIG. 3, the following will briefly describe an overall structure of an image forming apparatus (electrophotographic apparatus) including a charging device 4A of the present embodiment installed therein.

The image forming apparatus of the present embodiment forms a monochrome image corresponding to image data on a predetermined sheet of paper (recording sheet). As illustrated in FIG. 3, the image forming apparatus of the present embodiment includes (i) an image forming section 7 including: an exposure unit 1; a developing device 2; a drum-shaped photoreceptor 3; a charging device 4A; a cleaner unit 5; a fixing unit 6; and others, (ii) a paper feed section 8, and (iii) a paper ejection section 9.

The charging device 4A charges a surface of the photoreceptor 3, which is an electrostatic latent image carrier, uniformly at a predetermined potential. In the image forming apparatus of the present embodiment, the photoreceptor 3 rotates at a high speed with a circumferential speed of 600 mm/sec, for example.

The charging device 4A undergoes improvements for uniformly and stably charging at a predetermined potential the surface of the photoreceptor 3 rotating at a high speed, which eliminates the need for upsizing of the image forming apparatus. The charging device 4A will be described in detail later.

The exposure unit 1 exposes the surface of the photoreceptor 3 having been charged uniformly by the charging device 4A to light according to the inputted image data so as to form an electrostatic latent image on the surface of the photoreceptor 3 according to the image data.

As an example of the exposure unit 1, provided herein is a laser scanning unit (LSU) 13 including a laser irradiating section 11 and a reflection mirror section 12. Apart from the LSU 13, the exposure unit 1 may be, for example, an EL or LED writing head where light emitting elements, such as ELs or LEDs, are arranged in array.

The image forming apparatus of the present embodiment adopts a technique of using a plurality of laser beams to reduce an increased irradiation timing according to high-speed printing (To be specific, two-beam method).

The developing device 2 develops with a black toner an electrostatic latent image formed on the surface of the photoreceptor 3. The cleaner unit 5 removes and collects residual toner remaining on the surface of the photoreceptor 3 after image transfer.

A transfer mechanism 10 transfers an electrostatic latent image (unfixed toner) having been developed on the surface of the photoreceptor 3 in the above-mentioned manner onto a sheet which the transfer mechanism 10 transports. The transfer mechanism 10 applies to the sheet an electric field which is opposite in polarity to electric charges of the electrostatic image. For example, when the electrostatic image has electric charges of '−' (negative) polarity, the polarity of electric field applied by the transfer mechanism 10 is '+' (positive) polarity.

In the transfer mechanism 10, a transfer belt 103 is disposed so as to be wound around a driving roller 101, a driven roller 102, and other rollers. The transfer belt 103 has a predetermined resistance (ranging from $1\times10^{9}$ to $1\times10^{13}$ Ω·cm).

Further, a conductive roller 105 is disposed at a place where the photoreceptor 3 comes into contact with the transfer belt 103. The conductive roller 105 applies a transfer electric field with electric conductivity which is different from electric conductivities of the driving roller 101 and the driven roller 102. The conductive roller 105 has elasticity. This allows the photoreceptor 3 and the transfer belt 103 to come into contact with each other at their surfaces having a given width, which is termed "transfer nip". This enhances efficiency of transfer to a sheet being transported.

Additionally, an electric-field removing roller 106 is disposed on a back side of the transfer belt 103 downstream from a transfer area of the transfer belt 103. The electric-field removing roller 106 removes the electric field having been applied to the transported sheet in the transfer area to facilitate a smooth shift to the subsequent step.

Besides, the transfer mechanism 10 includes a cleaning unit and an electric-field removing mechanism. The cleaning unit cleans toner contamination on the transfer belt 103. The electric-field removing mechanism removes an electric field of the transfer belt 103. It is to be noted that the electric-field removing mechanism and the electric-field removing roller 106 are grounded via the image forming apparatus of the present embodiment.

An electrostatic image (unfixed toner) having been transferred onto the sheet of paper by the transfer mechanism 10 is transported to the fixing unit 6 and fused in place.

The fixing unit 6 includes a heat roller 61 and a pressure roller 62. Around the perimeter of the heat roller 61, a sheet peeling portion, a roller surface temperature detecting member (thermistor), and a roller surface cleaning member are disposed. The heat roller 61 has a heat source inside thereof. The heat source holds the surface of the heat roller 61 at a predetermined temperature (preset fixing temperature: approximately 160 to 200° C.).

Meanwhile, on both ends of the pressure roller 62, pressure members are disposed. The pressure members cause the pressure roller 62 to press the heat roller 61 at a predetermined pressure. Around the perimeter of the pressure roller 62, a sheet peeling portion and a roller surface cleaning member are disposed as in the case with the perimeter of the heat roller 61.

A part where the heat roller 61 and the pressure roller 62 are in contact with each other pressing against each other is termed "fixing nip". The sheet is transported to the fixing nip. The fixing unit 6 fixes the unfixed toner on the sheet being transported with (a) fusion at a temperature on the surface of the heat roller 61 and (b) push of the unfixed toner onto the sheet by a pressure force.

The paper feed section 8 stores sheets used for image formation and supplies the sheets to the image forming section 7. The image forming apparatus of the present embodiment aims at high speed print processing. Under the image forming section 7, disposed is a multi-stage paper feeder 81 including a plurality of paper feed trays each capable of holding 500 to 1500 sheets of paper of standard size. In the neighborhood of the multi-stage paper feeder 81, disposed is a large paper feed cassette 83 capable of holding a large amount of sheets of different types. On the side wall of the image forming section 7, a manual paper feed tray 82 is disposed. The manual paper feed tray 82 is mainly used in printing sheets of irregular size and other operations.

The paper ejection section 9 is disposed at a side surface of the present image forming apparatus which is opposite to the surface thereof having the manual paper feed tray 82. FIG. 3 illustrates a single-stage paper ejection tray 91 as an example of the paper ejection section 9. Optionally, the paper ejection tray 91 may be replaced by (i) a device which subjects ejected sheets to postprocessing (e.g. stapling and hole-punching) or (ii) a multi-stage paper ejection tray.

Next, the following will describe a sheet transporting step. From among the paper feed trays of the paper feed section 8, a paper feed tray which holds sheets consistent with a print job is selected. A sheet is fed from the selected paper feed tray. The fed sheet is transported by a plurality of transport rollers 16 through a transport path 15 illustrated in FIG. 3 to a resist roller 35 which is disposed immediately in front of the transfer mechanism 10. Then, the sheet stops at the resist roller 35. The stopped sheet is transported to the transfer mechanism 10 by the resist roller 35 rerotating again at a timing when a leading edge of the sheet is aligned with an electrostatic image on the photoreceptor 3. Then, the unfixed toner image is transferred thereon. Thereafter, the sheet is transported to the fixing unit 6 for fixing of the unfixed toner and then ejected to the paper ejection tray 91 of the paper ejection section 9.

The present image forming apparatus of the present embodiment is arranged so as to change the transport path leading from the fixing unit 6 to the paper ejection tray 91 depending upon (i) operation mode, such as copy mode, printer mode, or facsimile mode or (ii) printing mode that is a single-sided printing mode or a double-sided printing mode.

Generally, in the case of the copy mode, face-up ejection is often performed because users perform operations of the copy mode near the apparatus. The face-up ejection is an ejection of the sheet with its printed side (image forming side) facing up. Meanwhile, in the case of the printer mode and the facsimile mode, face-down ejection is often performed because users are not near the apparatus during the operations for the printer mode and the facsimile mode in many cases. The face-down ejection is an ejection of the sheet with its printed side (image forming side) facing down and is capable of collating the ejected sheets by page.

Figure 4:
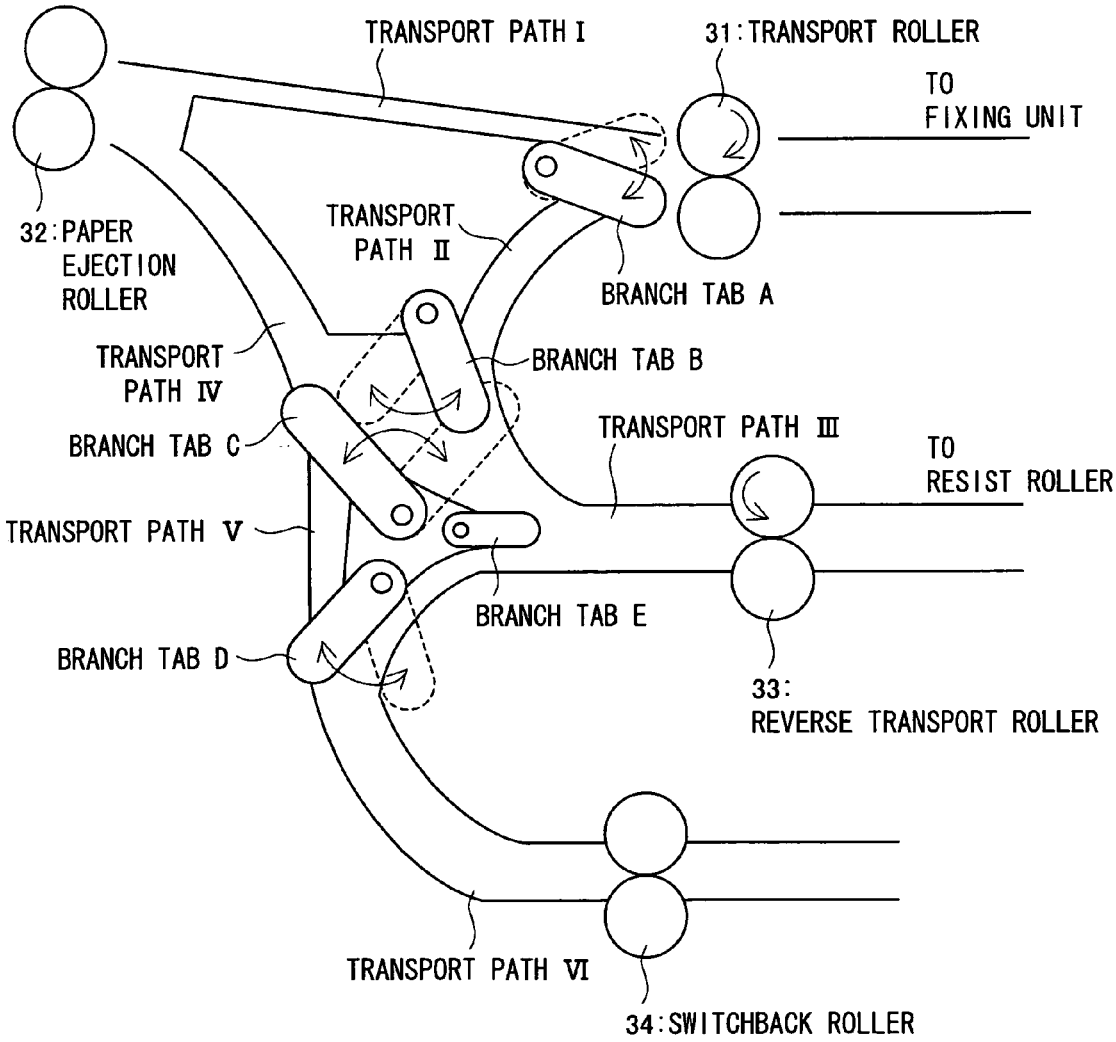
FIG. 4 is an explanatory view of the structure of a transport path shown in FIG. 3 extending from a fixing unit to a paper ejection tray.

In the present image forming apparatus, as illustrated in FIG. 4, the transport path leading from the fixing unit 6 to the paper ejection tray 91 includes: a plurality of transport paths I through VI and a plurality of branch tabs A through E. Except for the branch tab E provided at a fixed location, each of the branch tabs A through D is provided with a tab location switchover mechanism (not shown) realized by a solenoid or the like. When a control device (not shown) realized by a CPU or the like turns on or off, the tab location switchover mechanism selects a transport path guiding a sheet from among the transport paths I through VI.

(1) Face-up Ejection with Single-sided Printing

Before the sheet having passed through the fixing unit 6 passes through the transport roller 30, the branch tab A opens the transport path I leading to the paper ejection roller 32 and closes the transport path II. Due to the branch tab A guiding a front end of the transported sheet, the transported sheet passes through the transport path I and then is ejected through the paper ejection roller 32 onto the paper ejection tray 91.

(2) Face-down Ejection with Single-sided Printing

Before the sheet having passed through the fixing unit 6 passes through the transport roller 30, the branch tab A opens the transport path II and closes the transport path I. Further, the branch tab C opens the transport path III and closes the transport path V. Due to the branch tab A guiding a front end of the transported sheet, the transported sheet passes through the transport path II. The sheet moves the branch tab B by firmness and transport force of the sheet to open the transport path III, and then is led to the transport path III due to guidance of the branch tab C.

When a back end of the sheet reaches the position of the branch tab E, transport of the sheet stops. Meanwhile, the branch tab C opens the transport path IV and closes the transport path V. At this moment, the branch tab B spontaneously changes its position by means of an elastic member (e.g. rubber) not shown provided to a branch tab holding shaft to close the transport path II. After such a situation occurs, transport of the sheet is restarted by a reverse transport roller 33 rotating backward. With this, the back end of the sheet having stayed at the position of the branch tab E passes through the transport path IV, and then is ejected through the paper ejection roller 32 onto the paper ejection tray 91.

(3) Ejection in Double-sided Printing

Before the sheet having passed through the fixing unit 6 passes through the transfer roller 31 after the completion of printing a first side (front side) of the sheet, the branch tab A opens the transport path II and closes the transport path I. Further, the branch tab C opens the transport path V and closes the transport path III. The branch tab D opens the transport path IV. Due to the branch tab A guiding a front end of the transported sheet, the transported sheet passes through the transport path II. After the sheet moves the branch tab B by firmness and transport force of the front end of the sheet, the sheet is led to the transport paths V and IV due to guidance of the branch tab C. When the back end of the sheet reaches the transport path IV, transport of the sheet stops (completion of switchback of the first side).

Then, the branch tab D closes the transport path V and opens the transport path to the branch tab E, and the transport of the sheet is restarted by a switchback roller 34 rotating backward. With this, the back end of the sheet having stayed at the position of the transport path IV passes through the transport path III, and then is transported to the resist roller 35 which is disposed immediately in front of the printing process (transfer mechanism). Thereafter, printing a second side (back side) of the sheet is completed, and the sheet passes through the fixing unit 6. Subsequently, the sheet is subjected to the same processing as the processing in the face-up ejection with single-sided printing, and then ejected onto the paper ejection tray 91.

Next, the following will describe the details of the charging device 4A of the present embodiment. In order to realize stable charging of the photoreceptor that rotates at a high speed at a predetermined potential with the use of a charging device which performs scorotron charging by a method other than the method of increasing a width of the charger case for increase of the voltage application area, the Applicant of the present invention conducted various kinds of studies.

As a result of the studies, the Applicant found out that by using a grid electrode having a more coarse mesh when a circumferential velocity of the photoreceptor is high than that of a grid electrode used when the circumferential velocity is low, it is possible to cause a surface potential of the photoreceptor to reach a grid potential without application of so high voltage to generate ozone in an amount that brings a problem, and completed the invention of the present application.

Figure 5:
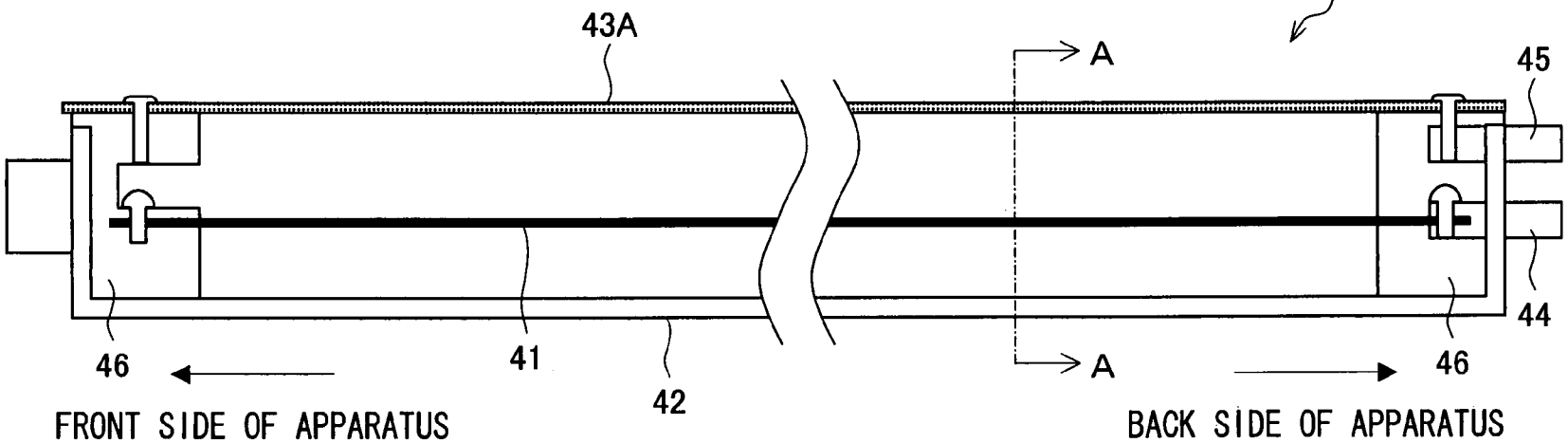
FIGS. 5(*a*) and 5(*b*) are views illustrating the structure of a scorotron charging device of First Embodiment of the present invention.
Figure 5:
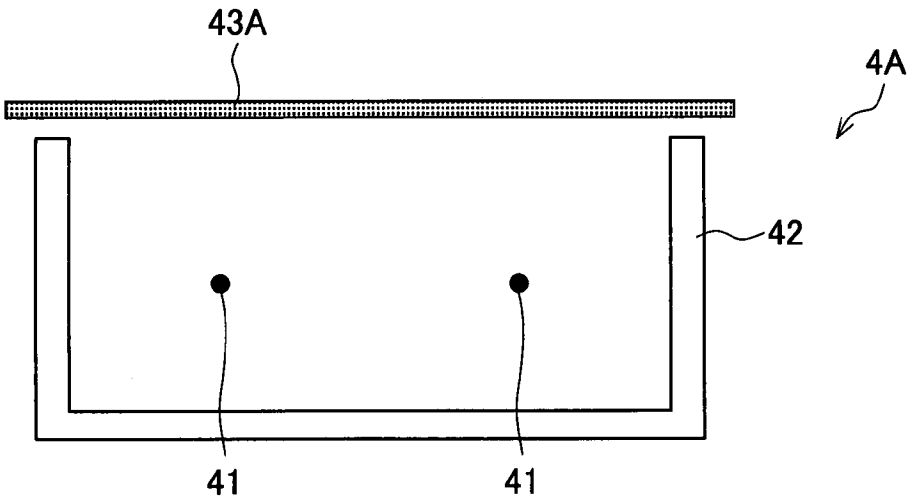

FIGS. 5(*a*) and 5(*b*) illustrate the structure of the charging device 4A. FIG. 5(*b*) is a cross-sectional view taken along line A-A in FIG. 5(*a*).

The charging device 4A includes charger lines 41, a charger case 42, and a grid electrode 43A. The charger line 41 is a wire member to which a high voltage is applied by the electrode 44. The charger line 41 is held by holder members 46 in the charger case 42. In the charging device 4A, two charger lines 41 are disposed. Identical voltages are applied to the two charger lines 41 by the electrode 44. The number of the charger lines 41 may be one, or may be three or more. In a case where a plurality of charger lines 41 are disposed, different voltages can be applied to the charger lines 41.

The charger case 42 is an electrically conducting box member where an axial direction of the charger lines 41 is a direction of the length of the charger case 42 and a surface thereof facing the photoreceptor is open. A voltage applied to the charger case 42 from the electrode 45 is different from the voltage applied to the charger lines 41. The grid electrode 43A is disposed so as to face the open surface of the charger case 42. A bias voltage applied to the grid electrode 43A by the electrode 45 is different from the voltage applied to the charger lines 41. Here, a voltage applied to the grid electrode 43A by the electrode 45 is identical with the voltage applied to the charger case 42. Alternatively, the grid electrode 43A and the charger case 42 can be isolated from each other so that mutually different voltages can be applied to the grid electrode 43A and the charger case 42.

Further, the grid electrode 43A is an electrically conducting mesh member having a plurality of openings. Examples of a shape of the opening include a slit indicated by reference numeral 50 of FIG. 1(*a*) and a polygon indicated by reference numeral 51 of FIG. 2(*a*). Hereinafter, the slit-shaped opening and the polygon-shaped opening are referred to as a slit 50 and a polygonal opening 51 (opening 51), respectively. FIG. 2(*a*) illustrates a hexagonal opening as an example of the polygonal opening 51.

A mesh size of the grid electrode 43A is arranged according to a circumferential velocity of the photoreceptor. The grid electrode 43A is arranged to be meshed coarsely as the circumferential velocity increases (becomes high).

Here, in the case of a slit-type opening, a mesh size of the grid electrode 43A can be defined by a slit width and a slit pitch. In the case of a polygonal opening, a mesh size of the grid electrode 43A can be defined by a diameter of a circumcircle around the polygonal opening and a pitch between circumcircles around the polygonal openings.

Figure 1:
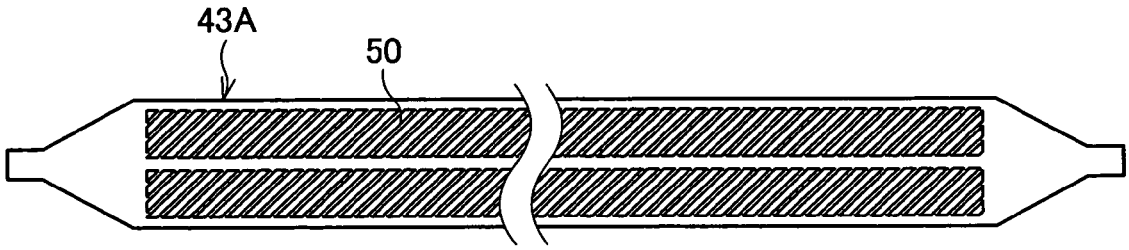
FIGS. 1(*a*) and 1(*b*) are views for explanation of a mesh size of a grid electrode provided in a scorotron charging device of First Embodiment of the present invention.
Figure 1:
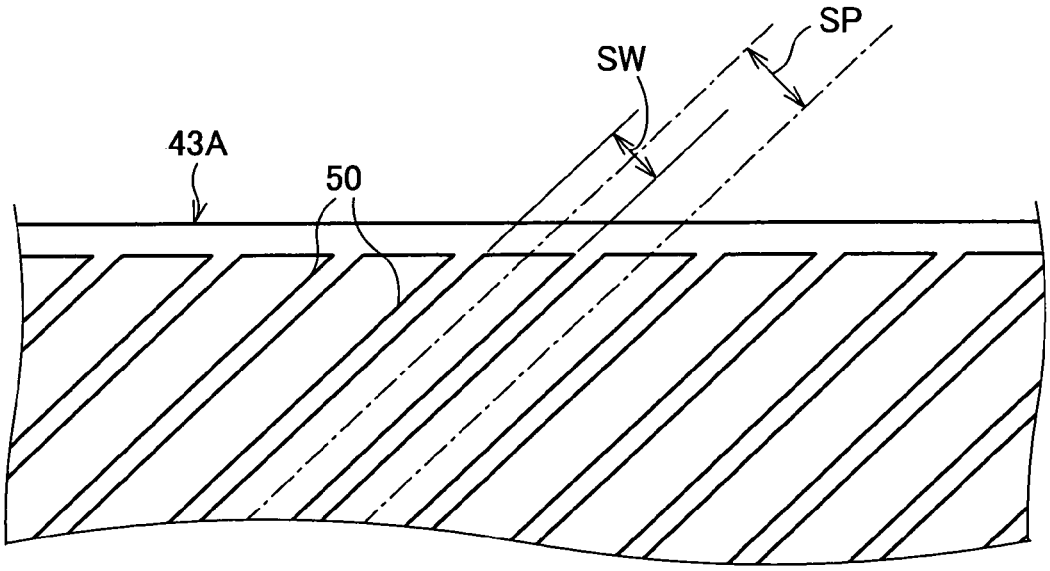
Figure 2:
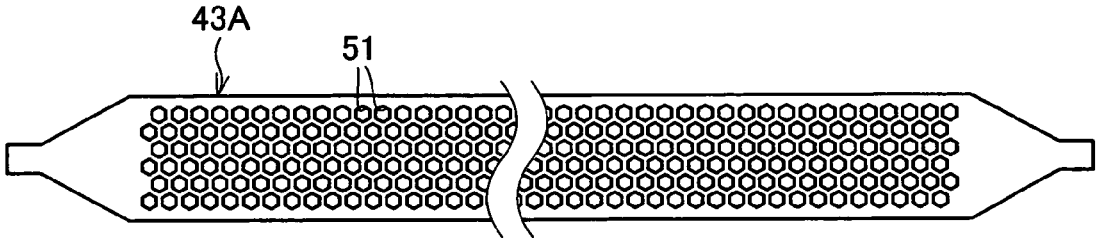
FIGS. 2(*a*) and 2(*b*) are views for explanation of a mesh size of another grid electrode provided in a scorotron charging device of First Embodiment of the present invention.
Figure 2:
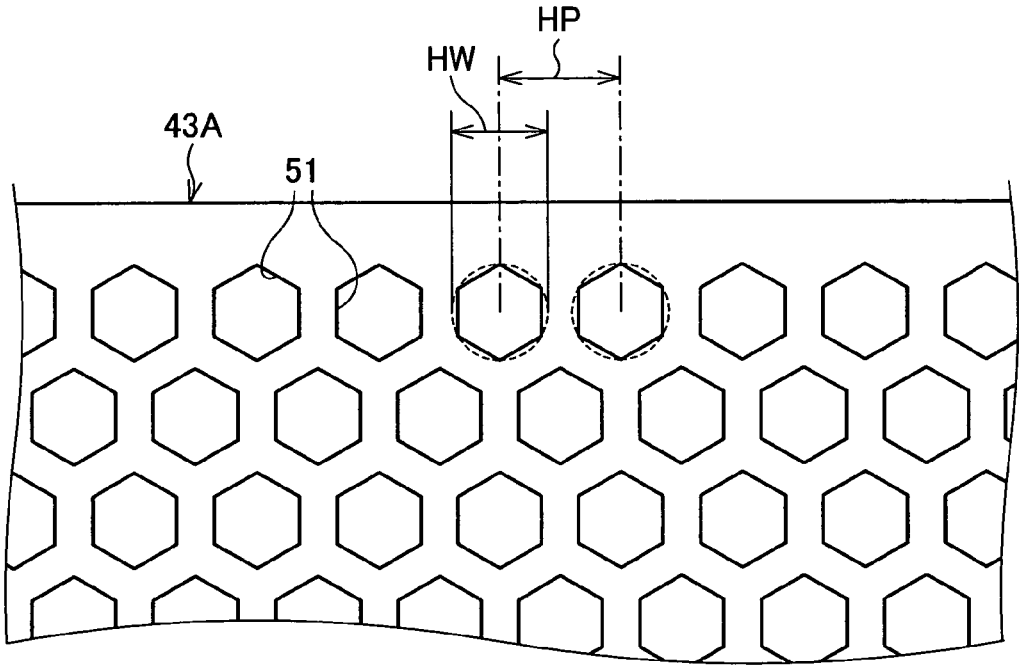

For example, FIG. 1(*b*) illustrates a slit width SW and a slit pitch SP in the grid electrode 43A illustrated in FIG. 1(*a*).

The slit width SW indicates a width of one slit (size of the slit on its side orthogonal to the length of the slit). The slit pitch SP indicates a distance between center lines of the two slits 50 (central lines extending in the direction of the length of the slit) which are adjacent to each other in a direction orthogonal to the direction of the length of the slit.

FIG. 2(*b*) illustrates a diameter HW of the circumcircle around the polygonal opening 51 of the grid electrode 43A of FIG. 2(*a*) and a pitch HP between the circumcircles around the polygonal openings 51. The pitch HP between the circumcircles indicates a distance between respective central points of the circumcircles of the adjacent two polygonal openings 51.

As compared with a fine-meshed grid electrode 43A, a coarse-meshed grid electrode 43A is in a state where an area of the slit 50 or the polygonal opening 51 is larger and the number of the slits 50 or the polygonal openings 51 per unit area is smaller, assuming that widths of electrode lines provided between the slits 50 or the polygonal openings 51 are identical between the fine-meshed grid electrode 43A and the coarse-meshed grid electrode 43A.

As compared with a coarse-meshed grid electrode 43A, a fine-meshed grid electrode 43A is in a state where an area of the slit 50 or the polygonal opening 51 is smaller and the number of the slits 50 or the polygonal openings 51 is larger, assuming that widths of electrode lines provided between the slits 50 or the polygonal openings 51 are identical between the fine-meshed grid electrode 43A and the coarse-meshed grid electrode 43A.

More specifically, according to 600-mm/sec circumferential velocity of the photoreceptor 3, the image forming apparatus of the present embodiment is set such that the slit width SW of the grid electrode 43A in the charging device 4A ranges from 1.8 mm to 2.4 mm (slit pitch SP is set to range from 1.95 mm to 2.57 mm), assuming that the width of the electrode line provided between the slits is in the range from 0.15 mm to 0.17 mm (error of 0.16 mm±0.01 mm).

In a case where the grid electrode having the polygonal openings 51 is adopted, the diameter HW of the circumcircle and the pitch HP between the circumcircles should be set to be in the range from 3.5 mm to 4.5 mm and in the range from 3.75 mm to 4.75 mm, respectively, in accordance with a circumferential velocity of 600 mm/sec.

The above-mentioned specific mesh sizes of the grid electrode 43A are just examples. The mesh size of the grid electrode 43A varies with variation in quality and thickness of the grid electrode 43A even at the same circumferential velocity, i.e. 600 mm/sec.

In other words, under the same conditions of quality and thickness of the grid electrode 43A, a mesh of the grid electrode 43A should be changed to be coarse as the circumferential velocity of the photoreceptor 3 increases, in order to appropriately determine a mesh size that realizes normal charging.

As illustrated in FIG. 5, the above-arranged charging device 4A is disposed to face the photoreceptor 3 in such a manner that an end of the charging device 4A having the electrodes 44 and 45 points toward the back of image forming apparatus, assuming that the length of the charging device 4A is orthogonal to a rotational direction of the photoreceptor 3.

In charging the photoreceptor 3, a voltage of approximately 4 KV to 6 KV is applied to the charger lines 41, and a bias voltage changing in accordance with a charging potential of the photoreceptor 3 is applied to the grid electrode 43A. A polarity of the voltage to be applied varies depending upon development schemes, a polarity of toner used, and/or other factors.

Additionally, the grid electrode 43A is set to be more coarsely meshed in accordance with a circumferential velocity of the photoreceptor 3 with high speed rotation than the grid electrode 43A supporting a low-speed apparatus. Thus, it is possible to stably charge the photoreceptor 3 in a high-speed apparatus at a predetermined potential, without increasing the amount of ozone generation and upsizing the image forming apparatus.

Next, the following will describe results of various kinds of studies conducted by the Applicant and led to the present invention.

(I) In the studies, used was an image forming apparatus that is an electrophotographic apparatus into which the charging device 4A was to be installed. With varying conditions, a relation between a current passed through the charger lines 41 (hereinafter also referred to as wire current) and a surface potential of the photoreceptor (hereinafter also referred to as drum surface potential) was found out. The upper limit of the wire current was 900 (−μA). This is because the amount of ozone generation remarkably increases when the wire current exceeds 900 (−μA).

Figure 6:
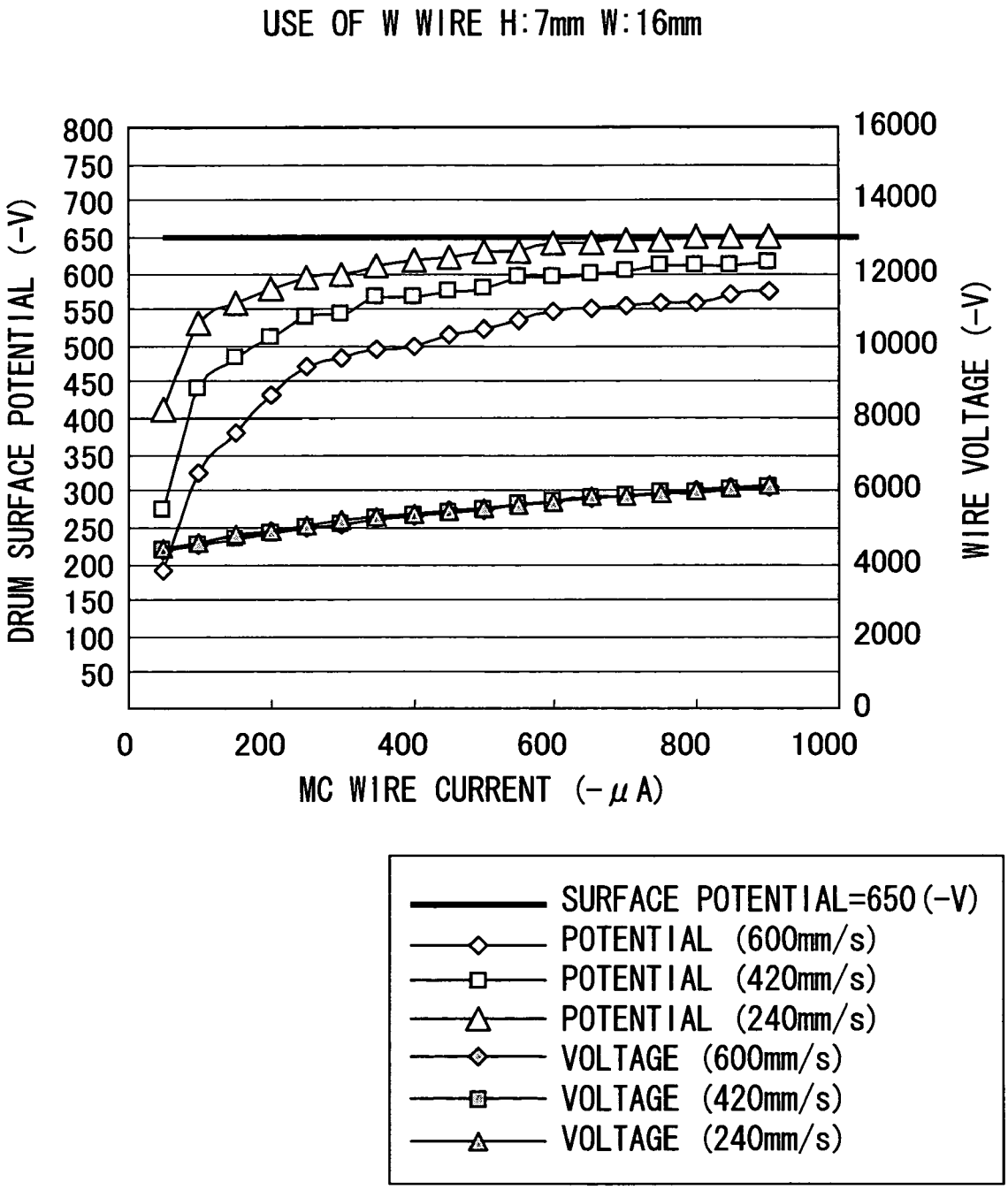
FIG. 6 is a view illustrating a relation between a wire current, a drum surface potential, and a wire voltage in the scorotron charging device when a circumferential velocity of a photoreceptor is changed.

FIG. 6 illustrates the results of changes in a relation between the wire current and the drum surface potential when a circumferential velocity of the photoreceptor was changed. A horizontal axis represents a wire current, and a vertical axis represents a voltage applied to the drum surface potential and the charger lines (hereinafter also referred to as wire voltage). In the present embodiment, since a reversal development scheme is adopted and a negative charging toner is used, it is necessary to negatively charge the surface of the photoreceptor at a predetermined voltage. That is why polarities of a current and a voltage are '−' negative. Accordingly, units of a current and a voltage are represented by (−V) and (−μA), respectively.

Here, a voltage (grid potential) applied to the grid electrode 43A was 650 (−V), which is a target potential for the drum surface potential. As the grid electrode 43A used was a 0.1-mm thick thin plate made of SUS having a plurality of slits each having a slit width of 1.2 mm (slit pitch ranging from 1.35 mm to 1.37 mm) and having a width of the electrode line provided between the slits in the range from 0.15 mm to 0.17 mm (error of 0.16 mm±0.01 mm). The two charger lines 41, which were made of Φ60-μ tungsten wire, were disposed side by side in a rotational direction of the photoreceptor. The charger lines 41 shared the electrode 44.

As illustrated in FIG. 6, when the circumferential velocity is 240 mm/sec, the drum surface potential reaches −650 V (650 (−V)) that is a grid potential and then become saturated. However, when the circumferential velocity is 420 mm/sec, the drum surface potential stops rising before reaching the grid potential. When the circumferential velocity is increased to 600 mm/sec, the drum surface potential becomes far below the grid potential.

As a result, it is obvious that the relation between the wire current and the drum surface potential is significantly influenced by the circumferential velocity of the photoreceptor, and that the drum surface potential becomes far below the grid potential as the circumferential velocity increases. It is obvious that curves representing the drum surface potential relative to the wire current are similar to each other regardless of the circumferential velocity, and that the curves shit to 0 (−V) as the circumferential velocity increases.

(II) The Applicant examined how the relation between the wire current and the drum surface potential changes under varying conditions of (i) a distance between the charger line 41 and the photoreceptor, (ii) a distance between the grid electrode 43A and the photoreceptor, (iii) a thickness of the charger line 41, (iv) slit width of the grid electrode 43A, or the like.

Figure 7:
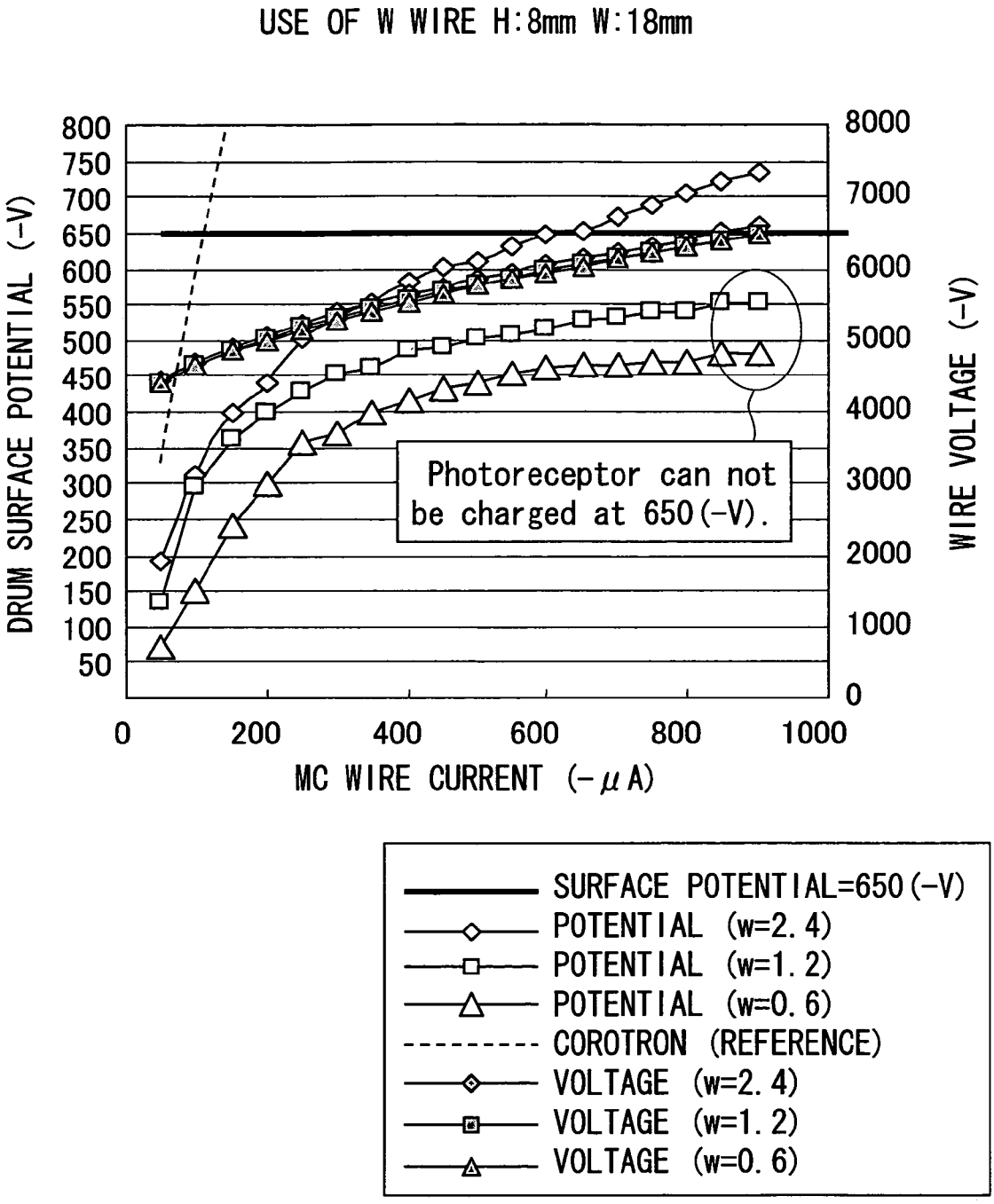
FIG. 7 is a view illustrating a relation between a wire current, a drum surface potential, and a wire voltage in the scorotron charging device when a slit width of a grid electrode is changed.
Figure 9:
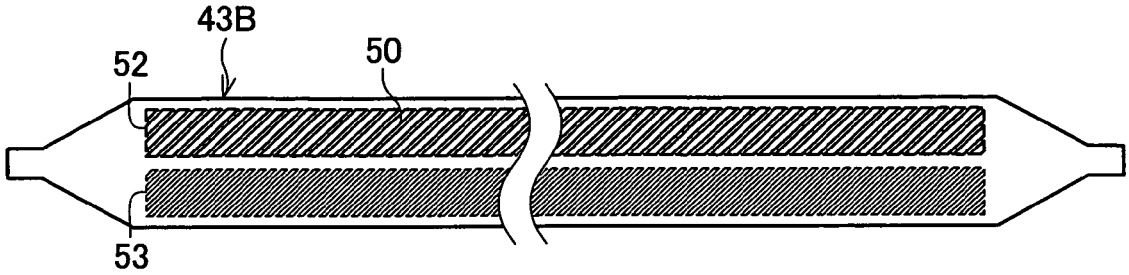
FIGS. 9(*a*) and 9(*b*) are views for explanation of a mesh size of a grid electrode provided in a scorotron charging device of Second Embodiment of the present invention.
Figure 9:
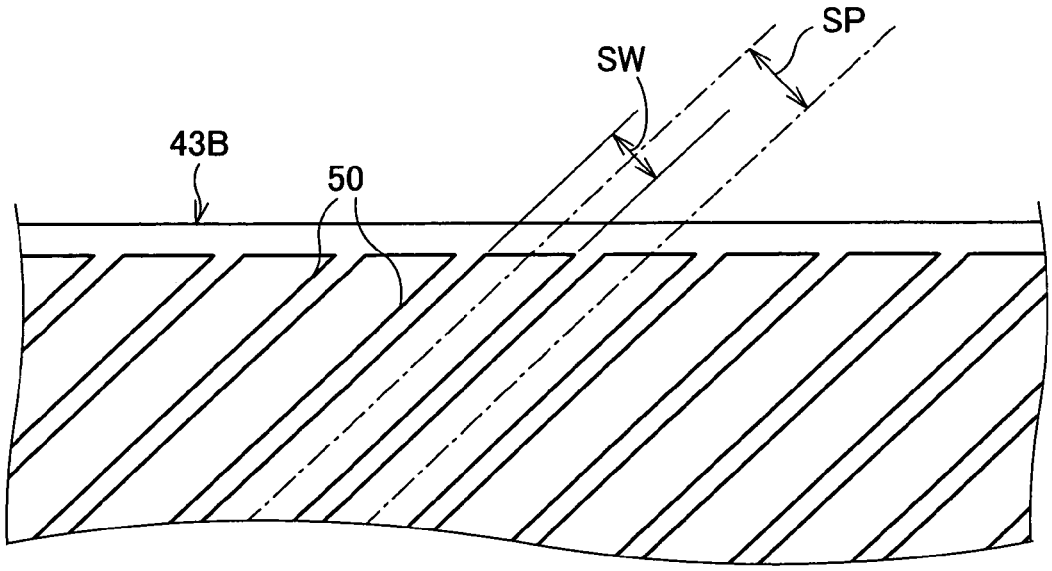
Figure 10:
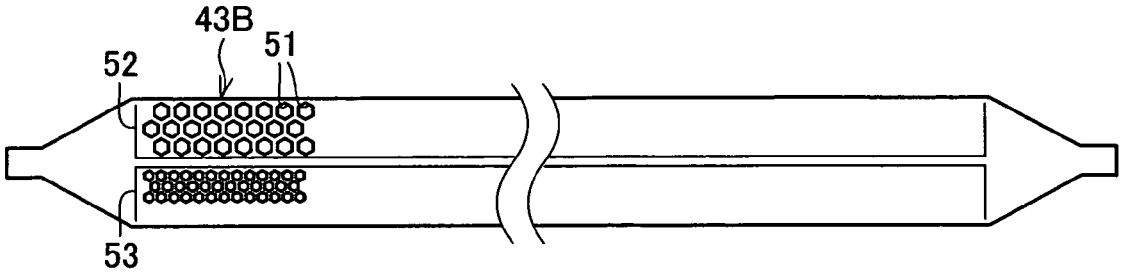
FIGS. 10(*a*) and 10(*b*) are views for explanation of a mesh size of another grid electrode provided in the scorotron charging device of Second Embodiment of the present invention.
Figure 10:
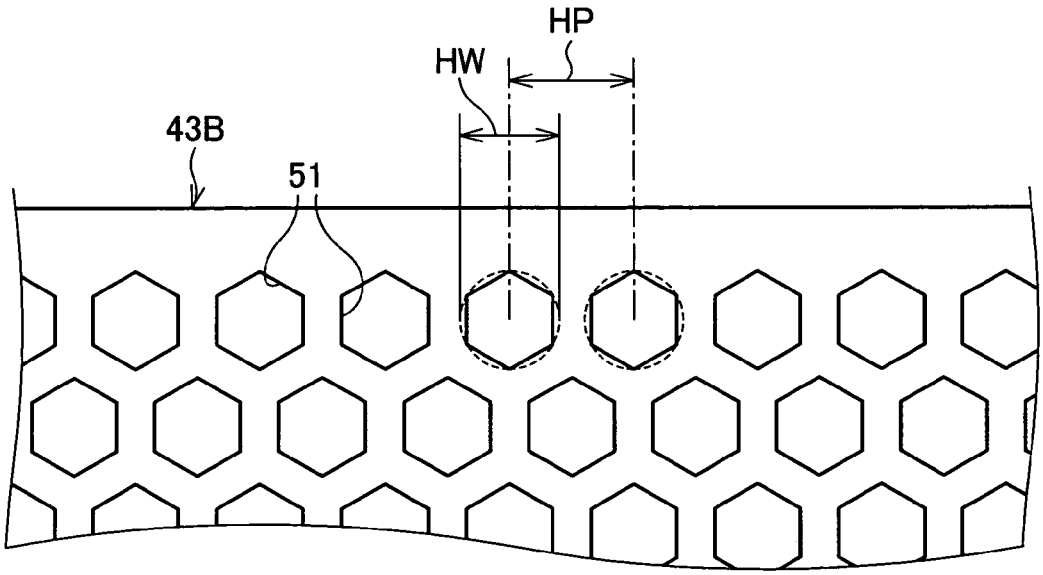

FIG. 7 illustrates the results brought by change in slit width of the grid electrode that is one of the above-listed conditions. As the grid electrode used was 0.1-mm thick thin plates made of SUS respectively having a slit width of 1.2 mm (slit pitch ranging from 1.35 mm to 1.37 mm), a slit width of 0.6 mm (slit pitch ranging from 0.75 mm to 0.77 mm), and a slit width of 2.4 mm (2.55 mm to 2.57 mm slit pitch), and having in common a width of the electrode line provided between the slits in the range from 0.15 mm to 0.17 mm (error of 0.16 mm±0.1 mm).

Here, the grid potential was also 650 (−V) that was a target potential for the drum surface potential. The two charger lines 41, which were made of Φ60-μ tungsten wire, were disposed side by side in a rotational direction of the photoreceptor. The charger lines 41 shared the electrode 44. The circumferential velocity of the photoreceptor was 600 mm/sec.

As illustrated in FIG. 7, when the slit width is 0.6 mm (w=0.6 in FIG. 7), the drum surface potential is not more than 500 (−V) and does not reach the grid potential of 650 (−V) even at 900 (−μA) wire current (−6500V (6500 (−V) wire voltage)). When the slit width is 1.2 mm (w=1.6 in FIG. 7), the drum surface potential is closer to the grid potential than the drum surface potential resulting from the slit width of 0.6 mm, but does not reach the grid potential. Meanwhile, when the slit width is 2.4 mm (w=2.4 in FIG. 7), the drum surface potential exceeds the grid potential at a wire current of 650 (−μA).

In other words, as a result, it is obvious that the relation between the wire current and the drum surface potential is influenced by the slit width of the grid electrode 43A, and that the drum surface potential can be brought close to the grid potential to some extent as the slit width increases, assuming that the widths of the electrode lines provided between the slits are identical.

The reason for this is considered as follows: In the scorotron charging, a current flowing from the charger lines 41 to the photoreceptor is absorbed by the grid electrode 43A. However, when the grid electrode 43A is coarse meshed, the amount of current the grid electrode 43A absorbs is small, and a large amount of current reaches the photoreceptor. A large amount of current reaching the photoreceptor increases charging performance even when a circumferential velocity of the photoreceptor is high and a time for passage of the voltage application area (wide of the shield electrode) (time for provision of electric charges) is short.

However, too much slit width causes excessive currents passing through the opening of the grid electrode 43A and flowing to the photoreceptor. As a result, regulation of charging potential by the provision of the grid electrode 43A does not completely work. The drum surface potential exceeds the grid potential although it is lower than the drum surface potential in a corotron charging given for reference. As such, it is obvious that stably charging at a predetermined potential (set charging potential) is difficult.

It should be noted that since the experiment was conducted by using the grid electrode 43A having slit-type openings, the explanations are given based on a slit width. Even if the experiment was conducted by using the grid electrode 43A having polygonal openings 51 such as hexagonal openings, the same can be said for a diameter of a circumcircle around the polygonal opening, assuming that a width of an electrode line provided between the openings is identical with a width of the electrode line in the grid electrode having slit-type openings. That is, the relation between the wire current and the drum surface potential is influenced by mesh size of the grid electrode.

(III) The Applicant of the present invention focused attention on the foregoing points and conducted a charging experiment with variations of the circumferential velocity of the photoreceptor in the range of 350 mm/sec to 600 mm/sec, in order to determine a mesh size of the grid electrode 43A which causes a surface potential of the photoreceptor to reach the grid potential and allows for stable charging at the set charging potential while suppressing the amount of ozone generation.

FIG. 8 illustrates results of the charging experiment when the circumferential velocity of the photoreceptor is 350 mm/sec, 400 mm/sec, 450 mm/sec, 500 mm/sec, and 600 mm/sec.

Used were ten types of the grid electrodes 43A which were made of 0.1 mm-thick thin plate made of SUS, wherein a width of electrode line provided between the slits was fixed in the range from 0.15 mm to 0.17 mm (error of 0.16 mm±0.01 mm) and a slit width was added in increments of 0.2 mm starting from 1.0 mm. The two charger lines 41, which were made of Φ60μ-tungsten wire, were disposed side by side in a rotational direction of the photoreceptor. The charger lines 41 shared the electrode 44. It was assumed that the upper limit of the wire current was 900 μA, and the grid potential was 650 (−V) that is a target potential of the drum surface potential. Further, it was assumed that as a maximum permissible value of the amount of ozone generation, a concentration of ozone emitted outside the apparatus through an ozone absorption filter placed on the apparatus was 2.0 mg/h or less.

In FIG. 8, the results are shown by the following symbols: "○" representing a result that normal charging was realized with the drum surface potential reaching the grid potential while the amount of ozone generated did not matter; "××" representing a result that the drum surface potential could not be reached the grid potential although the amount of ozone generated did not matter; "×1" representing a result that the drum surface potential could be reached the grid potential, but a large amount of ozone was generated; and "×2" representing a result that the drum surface potential could be reached the grid potential, but control of charging became difficult (the drum surface potential exceeded the grid potential).

As illustrated in FIG. 8, as a circumferential velocity of the photoreceptor increases, the slit width of the grid electrode 43A with which normal charging is possible tends to increase. As a circumferential velocity of the photoreceptor increases, the slit width of the grid electrode 43A increases with a permissible range of 0.6 to 0.8 mm, which is in the middle of the range between the upper slit width and the lower slit width.

For example, when the circumferential velocity is 600 mm/sec which is adopted in the image forming apparatus of the present embodiment, normal charging becomes possible by adjusting a slit width of the grid electrode 43A which is realized by a 0.1 mm-thick thin plate made of SUS to 1.8 to 2.6 mm (slit pitch of 1.95 to 0.77 mm/sec).

When the circumferential velocity is 400 mm/sec, normal charging becomes possible by adjusting a slit width of the grid electrode 43A which is realized by a 0.1. mm-thick thin plate made of SUS to 1.4 to 2.0 mm. When the circumferential velocity is 450 mm/sec, normal charging becomes possible by adjusting a slit width of the grid electrode 43A which is realized by a 0.1 mm-thick thin plate made of SUS to 1.6 to 2.2 mm. When the circumferential velocity is 500 mm/sec, normal charging becomes possible by adjusting a slit width of the grid electrode 43A which is realized by a 0.1 mm-thick thin plate made of SUS to 1.6 to 2.5 mm.

When used is the grid electrode 43A which is realized by a 0.1 mm-thick thin plate made of SUS, normal charging is possible at a circumferential velocity in the range of 350 to 600 mm/sec by adjusting a slit width of the grid electrode 43A to 2.0 mm. Similarly, when used is the grid electrode 43A which is realized by a 0.1 mm-thick thin plate made of SUS, a normal charging is possible at a circumferential velocity of the photoreceptor 3 in the range of 350 to 600 mm/sec by adjusting a diameter of the circumcircle (pitch between the circumcircles) around the grid electrode 43A to 4.0 mm although this will not be described in detail.

As described above, in the image forming apparatus of the present embodiment, the charging device 4A realized by a scorotron charging device is arranged according to a circumferential velocity of the photoreceptor 3 included in the image forming apparatus, such that the grid electrode 43A is finely meshed as the circumferential velocity decreases, and the grid electrode 43A is coarsely meshed as the circumferential velocity increases.

Thus, even in a high-speed apparatus wherein the photoreceptor 3 operates at a circumferential velocity of 600 mm/sec, it is possible to charge the electrostatic latent image carrier at a predetermined potential, without increasing the amount of ozone generation and without upsizing the image forming apparatus.

More specifically, in the case of the grid electrode having a plurality of slits, a slit width of the grid electrode should be in the range from 1.8 mm to 2.4 mm and a slit pitch should be in the range from 1.95 mm to 2.57 mm. In the case of the grid electrode having a plurality of polygonal openings, a diameter of a circumcircle around the polygonal opening should be in the range from 3.5 mm to 4.5 mm and a pitch between the circumcircles around the polygonal openings should be in the range from 3.75 mm to 4.75 mm. With this arrangement, it is possible to normally charge an electrostatic latent image carrier even when the electrostatic latent image carrier is driven for rotation at 500 mm/sec to 600 mm/sec or higher circumferential velocity.

[Second Embodiment]

The following will describe an embodiment of the present invention with reference to FIG. 3, FIGS. 9 through 17. It is to be noted that, for the purpose of explanation, members having the same functions as those described in the First Embodiment are given the same reference numerals and explanations thereof are omitted here.

FIG. 3 illustrates an overall structure of an image forming apparatus including a charging device 4B that is an embodiment of the present invention. The image forming apparatus of the present embodiment is different from the image display device of the First Embodiment in that the image forming apparatus of the present embodiment includes the charging device 4B instead of the charging device 4A. The charging device 4B undergoes improvements for uniformly and stably charging the surface of the photoreceptor 3 rotating at a high speed, without the need for upsizing of the image forming apparatus.

The Applicant of the present invention has conducted various studies, with the object of uniformly and stably charging a photoreceptor at a predetermined potential in the high-speed apparatus while increase in the amount of ozone generation and upsizing of the image forming apparatus are minimized.

As a result, the Applicant found out that the object could be attained by separate charging functions such that the surface of the photoreceptor was charged at a potential close to a desired set charging potential (predetermined potential) and then uniformly charged at the set charging potential, and the Applicant completed the invention of the present application.

Figure 11:
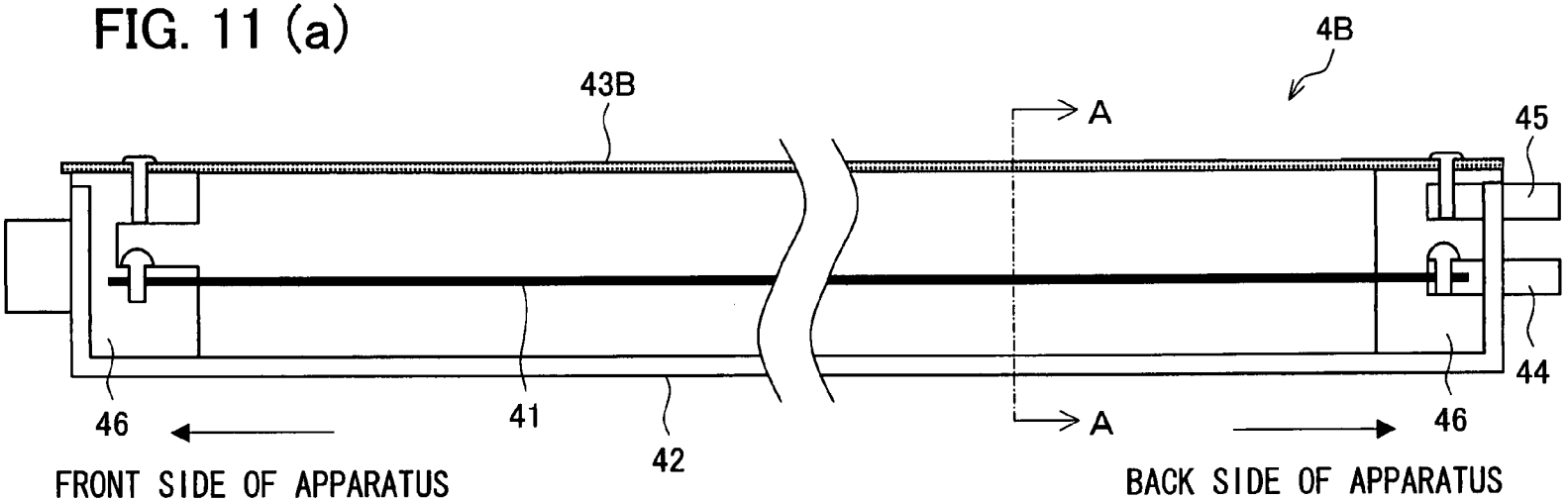
FIGS. 11(*a*) and 11(*b*) are views illustrating the structure of the scorotron charging device of Second Embodiment of the present invention.
Figure 11:
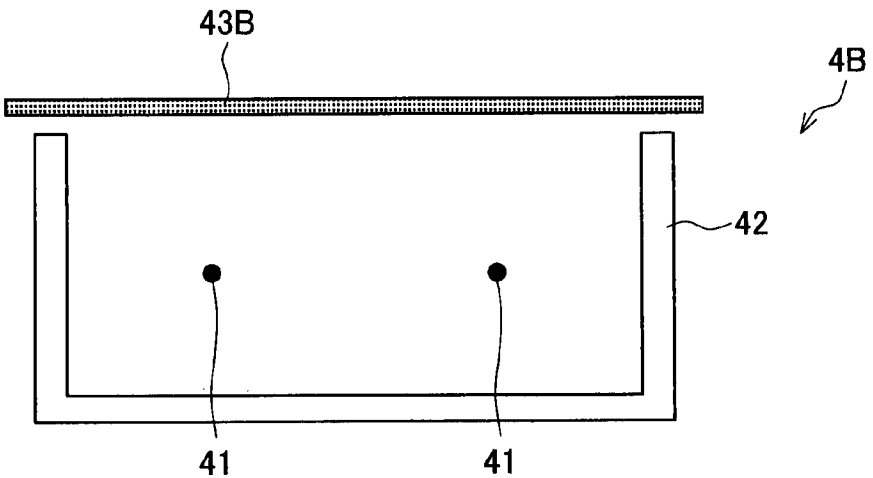

FIGS. 11(*a*) and (*b*) illustrate the structure of the charging device 4B of the present embodiment. The charging device 4B includes charger lines 41, a charger case 42, and a grid electrode 43B.

As with the grid electrode 43A, the grid electrode 43B is placed so as to face an open surface of the charger case 42, and a bias voltage is applied to the grid electrode 43B. The bias voltage is different from a voltage applied to the charger lines 41. Here, a voltage applied to the grid electrode 43B is identical with a voltage applied from the electrode 45 to the charger case 42. Alternatively, the grid electrode 43B and the charger case 42 can be isolated from each other so that mutually different voltage can be applied to the grid electrode 43B and the charger case 42.

The grid electrode 43B is an electrically conducting mesh member having a plurality of openings. As with the grid electrode 43A, the grid electrode 43B has slits 50 illustrated in FIGS. 9(*a*) and 9(*b*), polygonal openings 51 illustrated in FIGS. 10(*a*) and 10(*b*), or the like openings. The grid electrode 43B is different from the grid electrode 43A in that the grid electrode 43B has two regions, a coarse region 52 and a fine region 53. The coarse region 52 and the fine region 53 have mutually different mesh sizes.

As with a mesh size of the grid electrode 43A, in the case of a slit-type opening, a mesh size of the grid electrode 43B can be defined by a slit width and a slit pitch. In the case of a polygonal opening, a mesh size of the grid electrode 43B can be defined by a diameter of a circumcircle around the polygonal opening and a pitch between circumcircles around the polygonal openings.

In the grid electrode 43B, widths of electrodes provided between the slits 50 or the polygonal openings 51 are not necessarily identical with each other in the coarse region 52 and the fine region 53. The coarse region 52 is a region which has the openings whose size is larger than a size of the openings of the fine region 53 and has a coarse mesh. The fine region 53 is a region which has the openings whose size is smaller than a size of the openings of the coarse region 52 and has a fine mesh.

In the coarse region 52 and the fine region 53, even when the amounts of a current discharged from the charger lines 41 are identical, the coarse region 52 and the fine region 53 can adjust a discharge current flown to the photoreceptor 3 differently. Thus, it is possible to perform charging control of the photoreceptor 3 differently between the coarse region 52 and the fine region 53.

Figure 12:
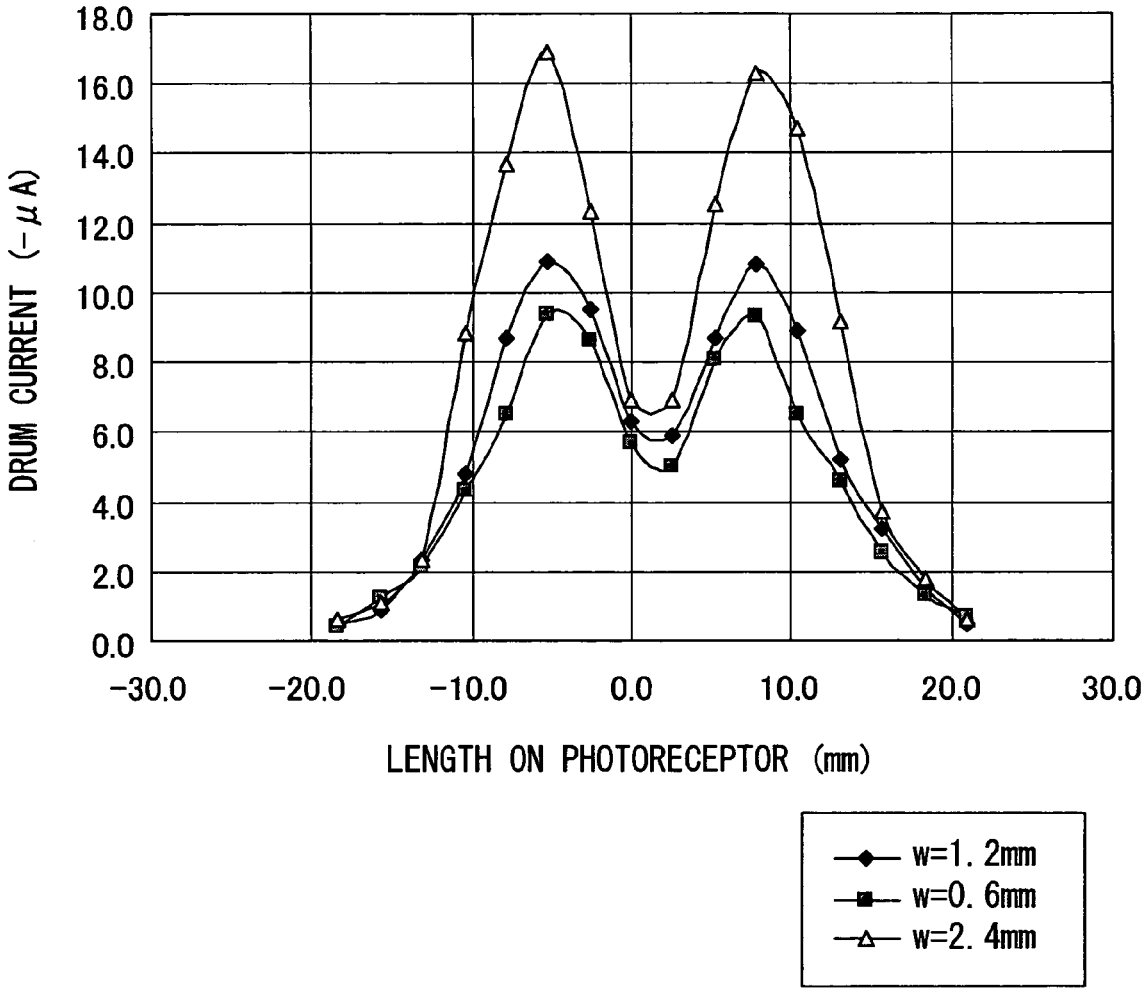
FIG. 12 is a view illustrating a relation between a length on the photoreceptor and a drum current in the scorotron charging device when a slit width of a grid electrode is changed.
Figure 13:
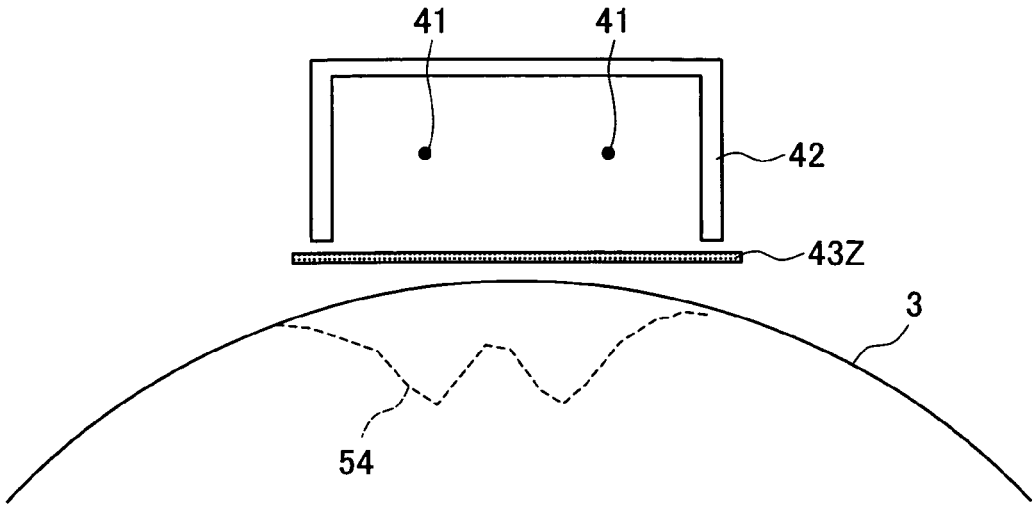
FIG. 13 is a view schematically illustrating distribution of the drum current shown in FIG. 12 projected on the photoreceptor along the length of the photoreceptor.

Here, how a charging state of the photoreceptor changes with variations of a mesh size of the grid electrode is described referring to FIGS. 12 and 13.

FIG. 12 illustrates an intensity distribution of drum currents flown on the surface of the photoreceptor when a voltage is applied to the charger lines with variations in mesh size of the grid electrode. The experiment uses three types of grid electrodes (single mesh pattern) having a slit width of 0.6 mm, 1.2 mm, and 2.4 mm, respectively.

In FIG. 12, a horizontal axis represents a length on the photoreceptor. The length on the photoreceptor indicates a distance from a point (0.0 mm) on the photoreceptor 3 corresponding to a center point of the charging device (midway point between the charger lines 41) to a downstream side or an upstream side in a rotational direction of the photoreceptor 3. The distances from the downstream side to the upstream side in the rotational direction of the photoreceptor 3 are indicated by values ranging from −0.0 mm to −0.0 mm.

In FIG. 12, a vertical axis represents a drum current. The drum current is a current flown on the surface of the photoreceptor when the surface of the photoreceptor is charged by a corona discharge of the charger lines 41. Variations of the drum current are in step with the changes in distribution of a surface potential of the photoreceptor, and there is a correspondence between distribution of the drum current and distribution of the surface potential of the photoreceptor. In other words, the drum current is high in an area of the photoreceptor where its surface potential is high, and the drum current is low in an area of the photoreceptor where its surface potential is low.

FIG. 13 schematically illustrates intensity distribution of the drum current projected on the photoreceptor 3 along the length of the photoreceptor 3. In FIG. 13, a drum current intensity distribution 54 is schematically illustrated. In FIG. 13, reference numeral 43Z represents a grid electrode with a single mesh pattern for use in the experiment.

As illustrated in FIG. 13, the drum current, i.e. the surface potential of the photoreceptor distributes in a Gaussian distribution manner that an the drum current becomes the highest in areas of the photoreceptor facing the charger lines 41 (To be exact, areas of the photoreceptor corresponding to straight lines that each connects the charger line. 41 and a center axis of the photoreceptor 3), and the drum current becomes low in areas between the straight lines.

As illustrated in FIG. 12, change in mesh size of the grid electrode 43Z does not change a state of the distribution, but changes a level of the drum current. As a mesh of the grid electrode 43Z becomes coarse (as a slit width of the grid electrode 43Z increases), the level of the drum current increases. From the result, it is obvious that change in mesh size of the grid electrode changes a manner in which the surface of the photoreceptor is charged even when the amount of current discharged from the charger lines 41 remains unchanged.

A coarse-meshed grid electrode decreases the effect of adjusting the amount of discharge current passing toward the photoreceptor 3 to make a potential on the surface of the photoreceptor 3 uniform and stabilize the potential to a predetermined potential. However, since the coarse-meshed grid electrode passes a large amount of discharge current, it is possible to supply a sufficient amount of current to the surface of the photoreceptor 3. This makes it possible to charge the surface of the photoreceptor 3 in a short period of time.

On the contrary, a fine-meshed grid electrode decreases the amount of discharge current passage, and is not suited to charge the photoreceptor 3 in a short period of time. However, the fine-meshed grid electrode appropriately controls the amount of discharge current passage to make a potential on the surface of the photoreceptor 3 uniform and stabilize the potential to the set charging potential.

Figure 14:
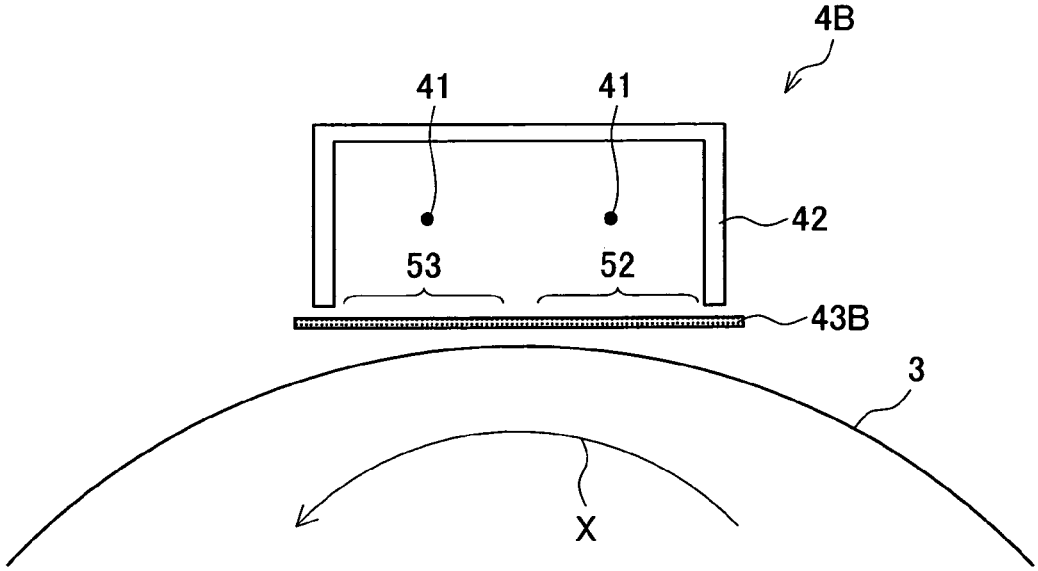
FIG. 14 is a view illustrating positions of (a) the scorotron charging device of Second Embodiment and (b) the photoreceptor.

The charging device 4B is installed in the image display apparatus as illustrated in FIG. 14. Specifically, the charging device 4B is provided in such a manner that the length of the charging device 4B is orthogonal to the rotational direction (indicated by an arrow X) of the photoreceptor 3, the coarse region 52 of the grid electrode 43B is located on the upstream side in the rotational direction of the photoreceptor 3, and the fine region 53 thereof is located on the downstream side in the rotational direction of the photoreceptor 3.

In charging the photoreceptor 3, a voltage of approximately 4KV to 6KV is applied to the charger lines 41, and a bias voltage changing in accordance with a desired charging potential of the photoreceptor 3 is applied to the grid electrode 43B. A polarity of the voltage to be applied varies depending upon development schemes, a polarity of toner used, and/or other factors.

Meanwhile, the photoreceptor 3 is driven for rotation with its surface facing the charging device 4B. When the photoreceptor 3 passes the voltage application area that faces the charging device 4B, the surface of the photoreceptor 3 is charged at a set charging potential (predetermined potential) which is determined in advance.

As described previously, the grid electrode 43B is provided with the coarse region 52 and the fine region 53. The coarse region 52 is located on the upstream side in the rotational direction of the photoreceptor 3, and the fine region 53 is located on the downstream side in the rotational direction of the photoreceptor 3.

With this arrangement, the surface potential of the photoreceptor 3 is attracted to a potential close to the set charging potential while the photoreceptor 3 faces the coarse region 52, which is a first region that the photoreceptor 3 passes (coarse charging). Thereafter, by an intrinsic charging performance of scorotron charging that stably and uniformly charges at a grid potential, the surface of the photoreceptor 3 having been subjected to coarse charging is charged uniformly at the set charging potential for stabilization while the photoreceptor 3 faces the fine region 53, which is a region following the coarse region 52 (adjustment charging).

Thus, stepwise charging is performed by the following separate charging functions: (a) the coarse charging of attracting the surface potential of the photoreceptor 3 to a potential close to the set charging potential and (b) the adjustment charging of making the surface potential attracted to the potential close to the set charging potential uniform so as to stabilize the surface potential to the set charging potential. This makes it possible to uniformly and stably charge the photoreceptor at a predetermined potential while minimizing increase of the amount of ozone generation and upsizing of the image forming apparatus, even when the circumferential velocity of the photoreceptor 3 is further increased to 600 mm/sec as in the present embodiment.

It is to be noted that mesh sizes of the coarse region 52 and the fine region 53 in the grid electrode 43B, which are not determined uniquely, are set appropriately in accordance with a circumferential velocity of a photoreceptor installed in an image forming apparatus. The mesh sizes of the coarse region 52 and the fine region 53 change in accordance with quality and thickness of the grid electrode 43B even when the coarse region 52 and the fine region 53 are arranged to suit for one circumferential velocity.

As illustrated in FIG. 12, in a case where the charger lines 41 are disposed in plurality and there is a valley in the distribution of the drum current, it is preferable that a boundary between the coarse region 52 and the fine region 53 of the grid electrode B is located so as to correspond to the valley. A performance to charge the photoreceptor 3 is low in the valley where the drum current is small. This minimizes the influence of a displaced boundary between the coarse region 52 and the fine region 53 on charging of the photoreceptor 3. This makes charging control easier.

In a case where the number of charger lines 41 is one, it becomes possible to charge more stably by making an area of the fine region 53 larger than that of the coarse region 52 and arranging the coarse region 52 and the fine region 53 so as to make a peak portion in the distribution of the drum current located corresponding to the fine region 53. This is because a charging ability of the coarse region 52 can be increased by making mesh of the grid electrode coarse, whereas an adjustment charging ability of the fine region 53 can be increased with time rather than by making mesh of the grid electrode coarse.

In the present embodiment, the grid electrode 43B having two regions, i.e. one each of the fine region 53 and the coarse region 52 is taken as an example. Alternatively, the grid electrode 43B may be arranged so as to have the coarse region 52 and the fine region 53 in an alternating manner, in a direction from the upstream side to the downstream side in the rotational direction of the photoreceptor 3.

The coarse charging section and the adjustment charging section are realized by one scorotron charger with the coarse region and the fine region provided in the grid electrode 43B. Such an arrangement has the effect of avoiding upsizing of the charging device even in the arrangement in which separate charging functions are provided.

Figure 16:
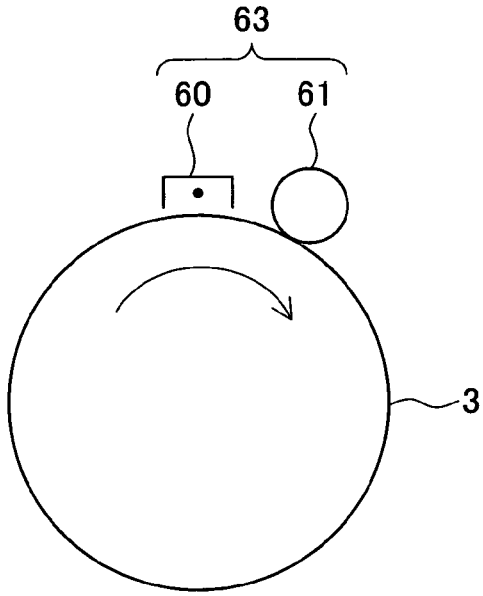
FIG. 16 is a view illustrating another embodiment of the present invention and illustrating the arrangement in which a coarse charging section is realized by a scorotron charger and an adjustment charging section is realized by a contact-type charger.

The coarse charging section and the adjustment charging section may be realized by separate chargers. Charging schemes may be combined appropriately. For example, as illustrated in FIG. 16, a charging device 63 may be constituted by (a) the coarse charging section realized by a corotron charger 60 and (b) the adjustment charging section realized by a charger 61 which is a contact-type charging device (In FIG. 16, the charger 61 is a charging roller).

The contact-type charging device can easily control a charging potential and stabilize a charging potential. For this reason, the contact-type charging device is preferably used as the adjustment charging section to attain the object of making a potential of the surface of the photoreceptor uniform and stabilize the potential to a predetermined potential. Of course, the coarse charging section may be realized by the contact-type charging device.

Figure 17:
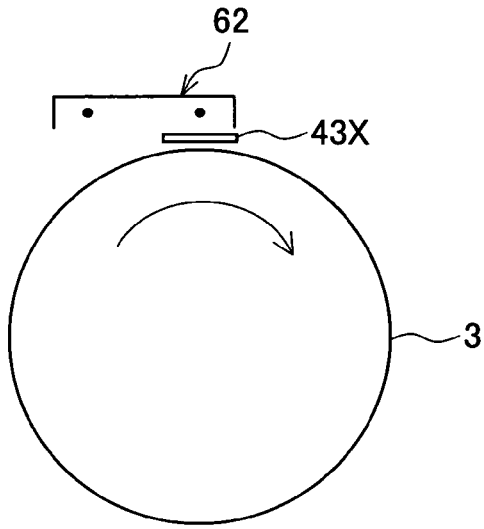
FIG. 17 is a view illustrating further another embodiment of the present invention and illustrating the arrangement in which a coarse charging section of corotron charging and an adjustment charging section of scorotron charging are realized by one scorotron charging device.

The corotron charging is not suitable for its use as the adjustment charging section because the corotron charging is not suited to control a charging potential. However, the corotron charging is suitable for its use as the coarse charging section because the corotron charging exerts high charging performance and allows for increasing a surface potential of the photoreceptor 3 in a short period of time. Therefore, in a case where the coarse charging section performs corotron charging, the adjustment charging section performs scorotron charging. Like a charging device 62 as illustrated in FIG. 17, a charging device may be one scorotron charger having a grid electrode 43X provided on the downstream side in a rotational direction of the photoreceptor 3.

EXAMPLE 1

The grid electrode 43B used in Example 1 was such that an electrode line provided between slits had a width in the range from 0.15 mm to 0.17 mm (error of 0.16 mm±0.01 mm), the coarse region 52 had a slit width of 2.4 mm (slit pitch ranging from 2.55 mm to 2.57 mm), and the fine region 53 had a slit width of 1.4 mm (slit pitch ranging from 1.55 mm to 1.57 mm).

A circumferential velocity of the photoreceptor 3 was 600 mm/sec, and a voltage applied to the grid electrode 43B (grid potential) was 650 (−V) that is a set charging potential (target potential) for the drum surface potential. The charger lines 41 were made of Φ60-μ tungsten wire, and shared one electrode. Under such conditions, the drum surface potential was measured with variations of the wire current in the range from 300 (−μA) to 900 (−μA).

As comparative examples used were grid electrodes with single mesh pattern each having uniform slit width and slit pitch in entire area of the grid electrode. The drum surface potential was measured in the same manner under the same conditions as those of Example 1, except that a mesh size of the grid electrode is different. In Comparative Example 1, a slit width was 1.4 mm (slit pitch ranging from 1.55 mm to 1.57 mm). In Comparative Example 2, a slit width was 1.8 mm.

Figure 15:
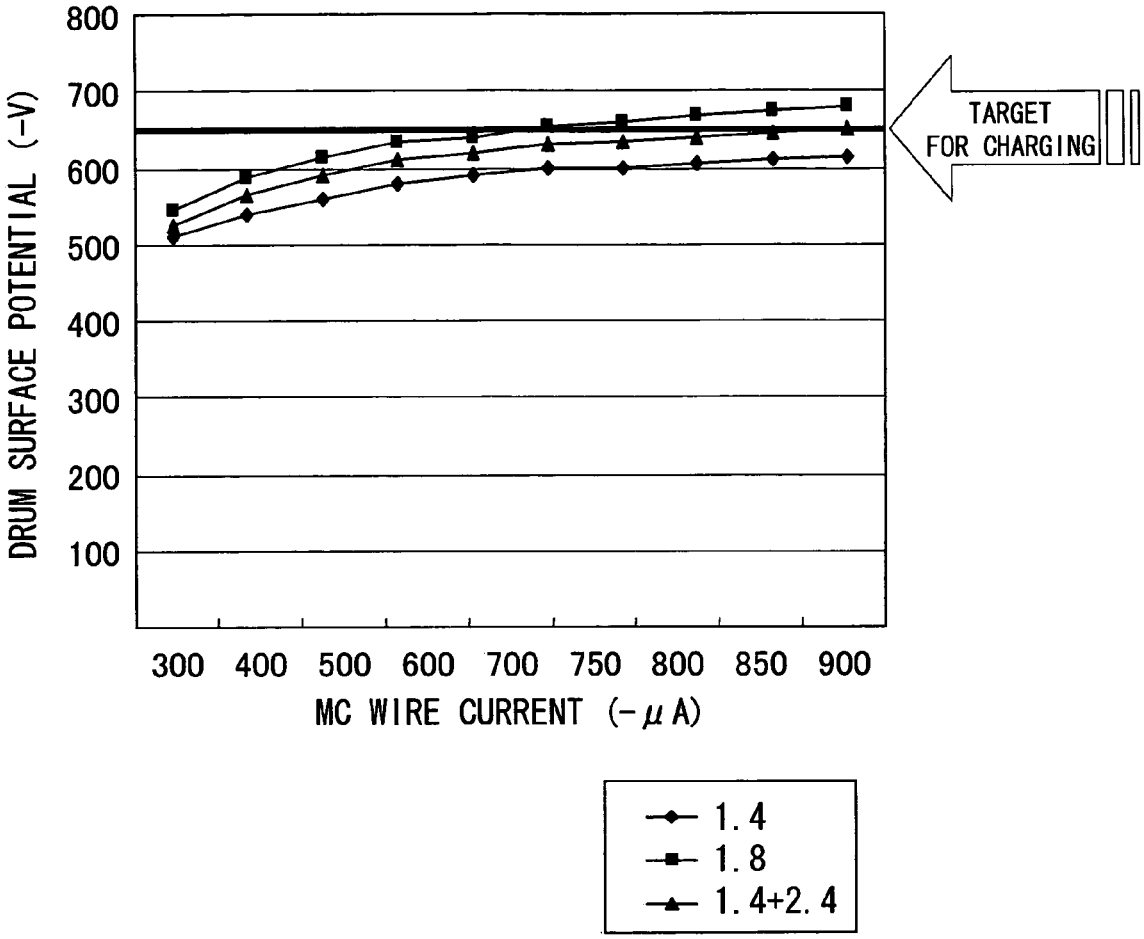
FIG. 15 is a view illustrating results of photoreceptor charging with variations of a slit width of a grid electrode in the scorotron charging device.

FIG. 15 illustrates results of the measurement. In FIG. 15, a horizontal axis represents a wire current, and a vertical axis represents a drum surface potential. As illustrated in FIG. 15, the drum surface potential increased with increase of the wire current in both Example 1 and Comparative Examples. In Example 1, the drum surface potential approached 650 (−V) as the wire current approached 900 (−μA), and the drum surface potential reached 650 (−V) when the wire current was 900 (−μA).

In other words, in Example 1, it is possible to obtain the set charging potential or a potential close to the set charging potential. Moreover, the drum surface potential does not exceed the set charging potential when the wire current is a high current. That is, it is obvious that stable charging of the photoreceptor 3 is realized even in the high-speed apparatus.

On the contrary, in Comparative Example 1, when a high current of 900 (−μA) was supplied as the wire current, the drum surface potential increased to 615 (−V), but did not reach the set charging potential. That is, it was impossible to stably charge the photoreceptor 3. In Comparative Example 2, when the wire current was 700 (−μA), the drum surface potential became 653 (−V), which exceeded the grid potential. It was impossible to perform stable charging control.

As described above, a charging device of the present invention is a charging device which is installed in an electrophotographic apparatus and charges at a predetermined potential a surface of an electrostatic latent image carrier that is driven for rotation, and the charging device includes: a coarse charging section which charges the surface of the electrostatic latent image carrier at a potential close to the predetermined potential; and an adjustment charging section which uniformly charges at the predetermined potential the surface of the electrostatic latent image carrier that has been charged by the coarse charging section.

Moreover, the adjustment charging section can be realized by a scorotron charger including: (a) at least one wire which is subjected to application of a high voltage and is displaced at a position that faces the electrostatic latent image carrier so that an axial direction of the wire is orthogonal to a rotational direction of the electrostatic latent image carrier; (b) a shield electrode which shields the wire and has an open surface that faces the electrostatic latent image carrier; and (c) a grid electrode which is realized by a mesh member and is placed so as to face the open surface of the shield electrode.

As described above, since the scorotron charger is excellent in making a charging potential uniform and stabilizes the charging potential, the scorotron charger can be preferably used as the adjustment charging section whose object is to uniform a potential on the surface of the electrostatic latent image carrier and stabilize the potential at a predetermined potential.

Further, the adjustment charging section can be realized by a contact-type charger including a contact member such as charging roller or charging brush.

Since the contact-type charger can easily control a charging potential and stabilize a charging potential, the contact-type charger can be preferably used as the adjustment charging section whose object is to uniform a potential on the surface of the electrostatic latent image carrier and stabilize the potential at a predetermined potential.

[Third Embodiment]

The following will describe an embodiment of the present invention with reference to FIG. 3, FIGS. 18 through 23. It is to be noted that, for the purpose of explanation, members having the same functions as those described in the First and Second Embodiments are given the same reference numerals and explanations thereof are omitted here.

FIG. 3 illustrates an overall structure of an image forming apparatus including a charging device 4C that is an embodiment of the present invention. The image forming apparatus of the present embodiment is different in the main from the image display device of the First Embodiment in that the image forming apparatus of the present embodiment includes the charging device 4C instead of the charging device 4A. The charging device 4C undergoes improvements for uniformly and stably charging the surface of the photoreceptor 3 rotating at a high speed, without the need for upsizing of the image forming apparatus.

Figure 20:
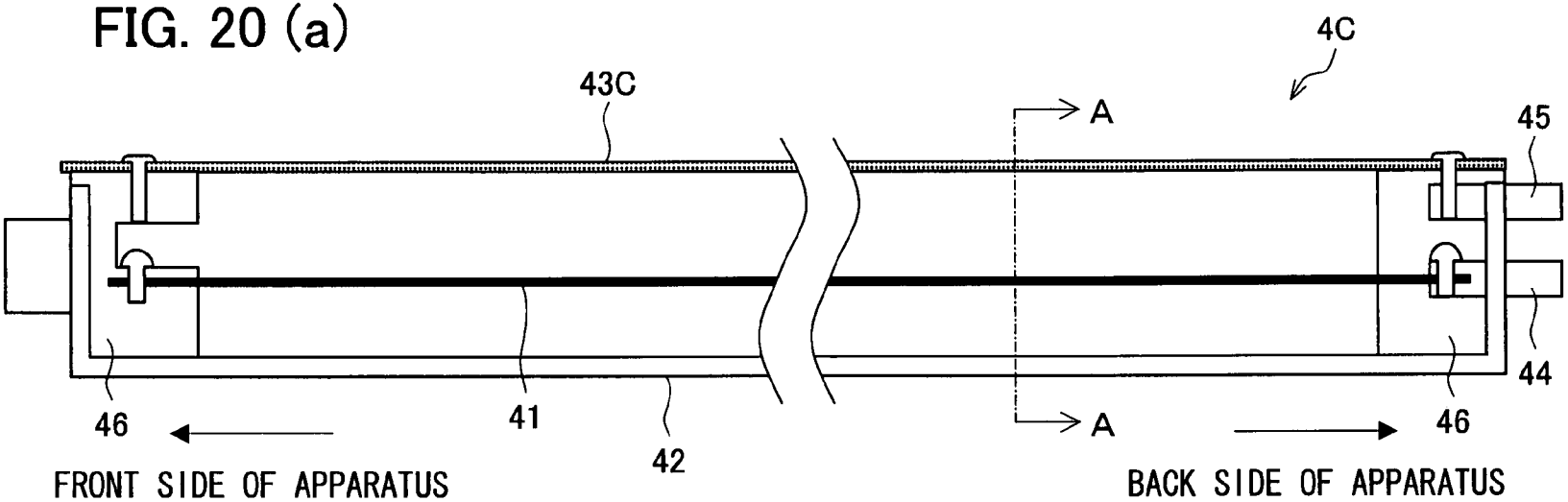
FIGS. 20(*a*) and 20(*b*) are views illustrating the structure of the scorotron charging device of Third Embodiment of the present invention.
Figure 20:
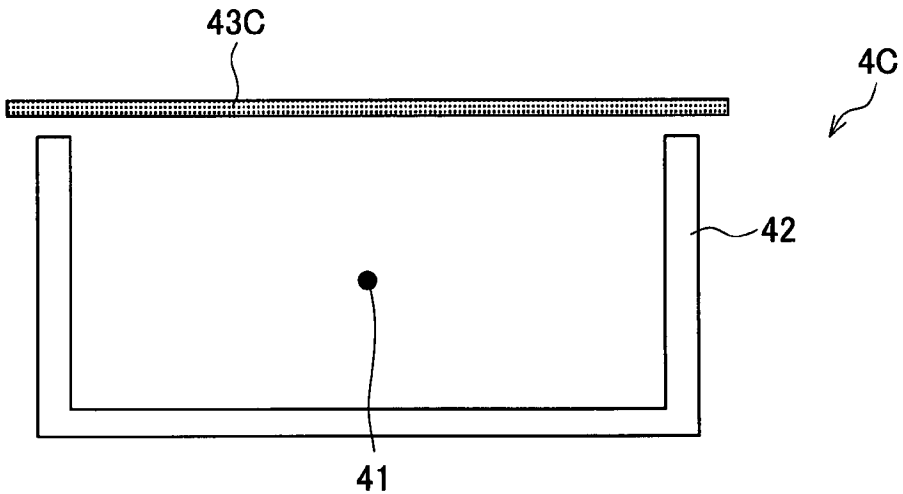

The charging device 4C of the present embodiment will be described in detail. FIGS. 20(*a*) and 20(*b*) illustrate the structure of the charging device 4C. FIG. 20(*b*) is a cross-sectional view taken along line A-A in FIG. 20(*a*).

The charging device 4C includes a charger line 41, a charger case 42, and a grid electrode 43C. Moreover, the charging device 4C of the present invention includes one charger line, which is the feature of the charging device 4C.

The grid electrode 43C is an electrically conducting mesh member having a plurality of openings. As with the grid electrodes 43*a* and 43B, the grid electrode 43C is placed so as to face an open surface of the charger case 42. A bias voltage applied to the grid electrode 43C is different from the voltage applied to the charger line 41. Here, a voltage applied to the grid electrode 43C by the electrode 45 is identical with the voltage applied to the charger case 42. Alternatively, the grid electrode 43C and the charger case 42 can be isolated from each other so that mutually different voltages can be applied to the grid electrode 43B and the charger case 42.

Figure 18:
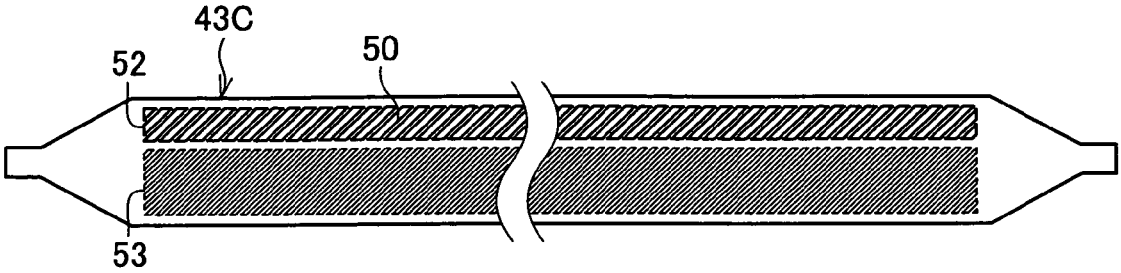
FIGS. 18(*a*) and 18(*b*) are views for explanation of a mesh size of a grid electrode provided in a scorotron charging device of Third Embodiment of the present invention.
Figure 18:
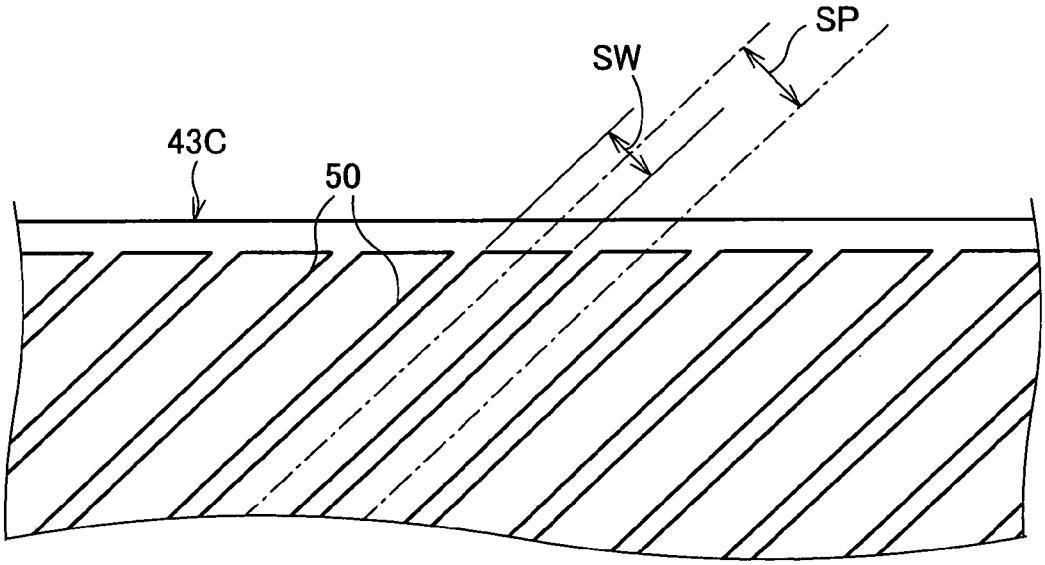
Figure 19:
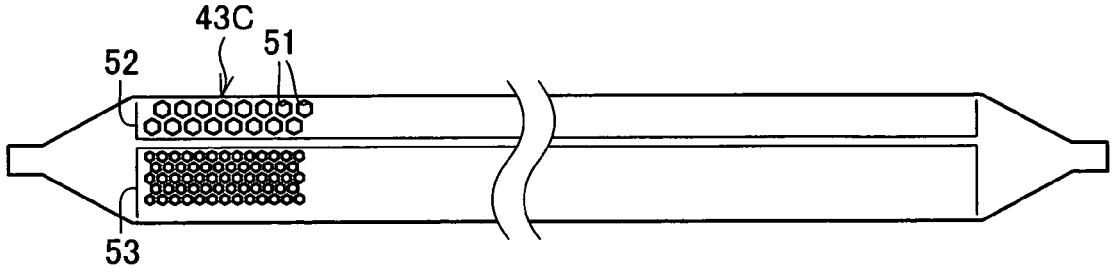
FIGS. 19(*a*) and 19(*b*) are views for explanation of a mesh size of another grid electrode provided in a scorotron charging device of Third Embodiment of the present invention.
Figure 19:
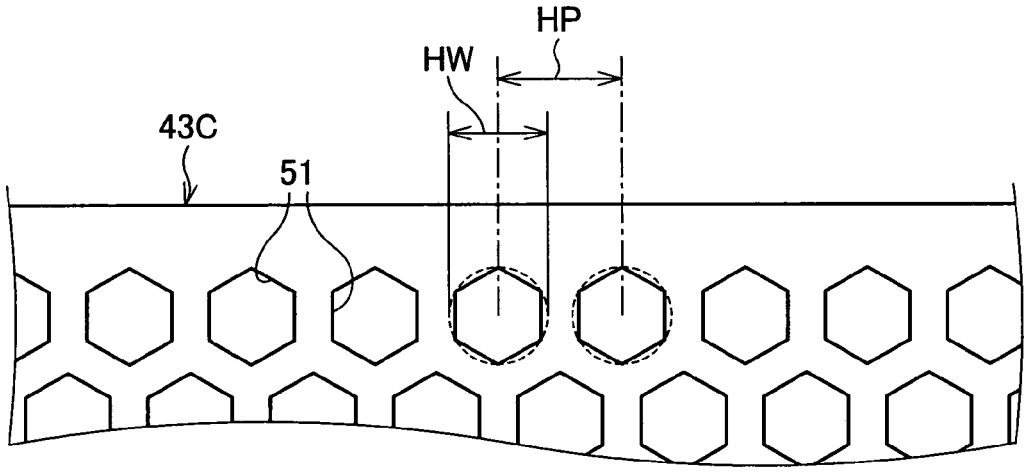

As with the grid electrodes 43A and 43B, the grid electrode 43C has slits 50 as illustrated in FIGS. 18(*a*) and 18(*b*), polygonal openings 51 as illustrated in FIGS. 19(*a*) and 19(*b*), or the like openings.

As with the grid electrode 43B, the grid electrode 43C has a coarse region 52 that is coarse-meshed and a fine region 53 that is fine-meshed.

More specifically, the grid electrode 43C illustrated in FIG. 18(*a*) is such that a width of an electrode provided between the slits is in the range of 0.15 mm to 0.17 mm (error of 0.16 mm±0.01 mm), a slit width SW of the coarse region 52 is 2.4 mm (slit pitch SP in the range of 2.55 mm to 2.57 mm), and a slit width of the fine region 53 is 1.4 mm (slit pitch SP in the range of 1.55 mm to 1.57 mm).

The above-mentioned specific mesh size of the grid electrode 43C is just an example. The present invention is not limited to this. For example, in a case where a width of an electrode line provided between the slits is in the range of 0.15 mm to 0.17 mm (error of 0.16 mm±0.01 mm), the slit width SW of the coarse region 52 and the slit width SW of the fine region 53 can be arranged to be in the range of 2.0 mm to 2.6 mm (slit pitch SP in the range of 2.15 mm to 2.77 mm) and in the range of 1.2 mm to 1.6 mm (slit pitch SP in the range of 1.35 mm to 1.77 mm), respectively.

The grid electrode 43C illustrated in FIG. 19(*a*) is arranged such that a width of an electrode line provided between the slits is in the range of 0.25 mm to 0.27 mm (error of 0.26 mm±0.01 mm), a diameter HW of a circumcircle in the coarse region 52 is 4.25 mm (pitch HP between the circumcircles in the range of 4.5 mm to 4.52 mm), a diameter HW of a circumcircle in the fine region 53 is 3.75 mm (pitch HP between the circumcircles in the range of 4.0 mm to 4.02 mm).

In the grid electrode 43C illustrated in FIG. 19(*a*), the above-mentioned specific mesh size of the grid electrode 43C is just an example. The present invention is not limited to this. For example, in a case where a width of an electrode line provided between the slits is in the range of 0.25 mm to 0.27 mm (error of 0.26 mm±0.01 mm), a diameter HW of a circumcircle in the coarse region 52 and a diameter HW of a circumcircle in the fine region 53 can be arranged to be in the range of 4.0 mm to 4.5 mm (pitch HP between the circumcircles in the range of 4.25 mm to 4.77 mm) and in the range of 3.5 mm to 4.0 mm (pitch HP between the circumcircles in the range of 3.75 mm to 4.27 mm), respectively.

That is, in both of the cases illustrated in FIGS. 18(*a*) and 19(*a*), the widths of the electrode lines which form the slit widths are substantially identical with each other. As compared with the fine region 53, the coarse region 52 has the slit 50 (polygonal opening 51) which is larger in area, and has a smaller number of slits 50 (polygonal openings 51) per unit area. On the other hand, as compared with the coarse region 52, the fine region 53 has the slit 50 (polygonal opening 51) which is smaller in area, and has a larger number of slits 50 (polygonal openings 51) per unit area.

In charging the photoreceptor 3, when a voltage is applied to the charger line 41 of the charging device 4C, the surface of the photoreceptor 3 is charged by corona discharge of the charger line 41. This causes a current to flow on the surface of the photoreceptor 3. This current is referred to as "drum current".

A surface potential of the photoreceptor 3 varies in intensity from place to place. A distribution showing the variations in intensity of the surface potential is a distribution of the photoreceptor surface potential. The drum current takes a current value according to the intensity distribution of the photoreceptor surface potential. In other words, the intensity distribution of the drum current (distribution of the drum current) corresponds to the intensity distribution of the photoreceptor surface potential (distribution of the photoreceptor surface potential). Therefore, a value of the drum current is high in an area where the photoreceptor surface potential is high, whereas a value of the drum current is low in an area where the photoreceptor surface potential is low.

The photoreceptor surface potential is the highest in an area of the surface of the photoreceptor corresponding to a straight line that connects the charger line and a center axis of the photoreceptor. The photoreceptor surface potential decreases with distance from the straight line. That is, the distribution of the photoreceptor surface potential has a peak on the surface of the photoreceptor on the straight line that connects the charger line and a center axis of the photoreceptor.

The grid electrode 43C of the charging device 4C is disposed in such a manner that a boundary between the coarse region 52 and the fine region 53 is located on the upstream side in the rotational direction of the photoreceptor in relation to the peak of the photoreceptor surface potential. That is, the grid electrode 43C is disposed in such a manner that a straight line that connects the boundary and the center axis of the photoreceptor 3 is on the upstream side in the rotational direction of the photoreceptor in relation to the straight line that connects the charger line and the center axis of the photoreceptor.

Figure 21:
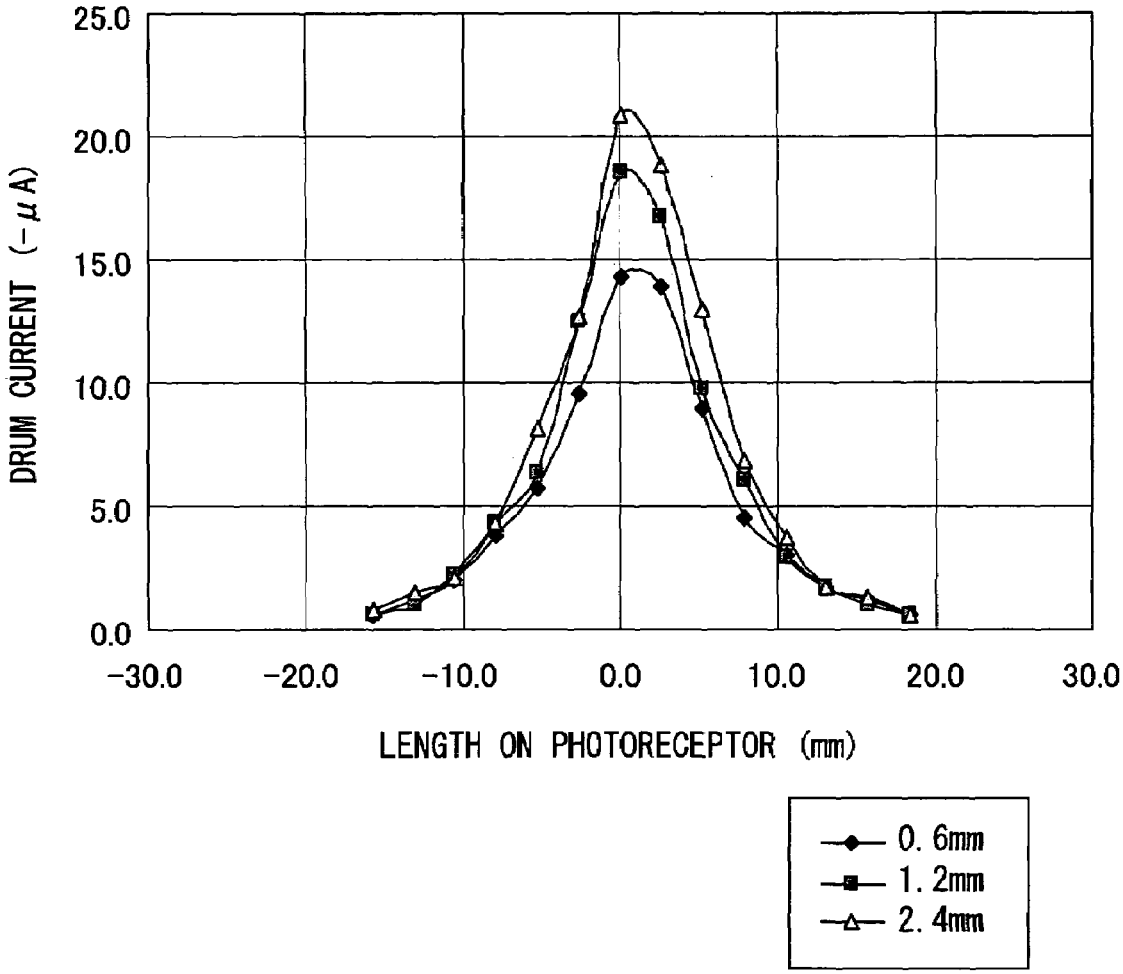
FIG. 21 is a view illustrating a relation between a length on the photoreceptor and a drum current in the scorotron charging device when a slit width of a grid electrode is changed.

Now, the distribution of the drum current (photoreceptor surface potential) flowing on the surface of the photoreceptor 3 is described below. FIG. 21 is a graph showing intensity distribution of the drum current flowing on the surface of the photoreceptor 3 when a voltage is applied to the charger line 41. FIG. 21 takes as examples the cases of using grid electrodes 43Z each having slits of single mesh pattern without the coarse region and the fine region (see FIG. 21). The grid electrodes used are three types of grid electrodes which have different slit widths (0.6 mm, 1.2 mm, and 2.4 mm).

A length on the photoreceptor illustrated in FIG. 21 indicates a distance from a point (0.0 mm) on the photoreceptor corresponding to a center point of the charging device (where the charger line is provided) to a downstream side or an upstream side in a rotational direction of the photoreceptor 3. The distances from the downstream side to the upstream side in the rotational direction of the photoreceptor 3 are indicated by values ranging from −30.0 mm to 30.0 mm.

Figure 22:
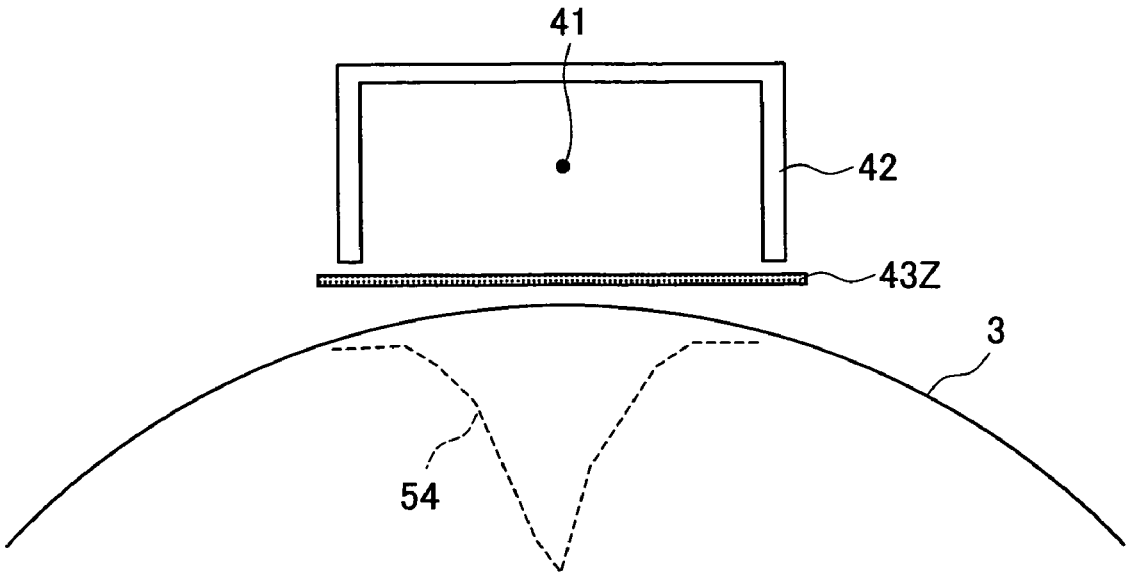
FIG. 22 is a view schematically illustrating distribution of the drum current shown in FIG. 21 projected on the photoreceptor along the length of the photoreceptor.

As illustrated in FIG. 21, all of the results obtained by using the foregoing grid electrodes showed that the distribution of the drum current has one peak (maximum value). FIG. 22 schematically illustrates intensity distribution of the drum current projected on the photoreceptor along the length of the photoreceptor. In FIG. 22, a drum current intensity distribution 54 is schematically illustrated. As illustrated in FIGS. 21 and 22, a peak of the drum current is located corresponding to a position where the charger line 41 is provided (a position on the surface of the photoreceptor on a straight line that connects the charger line 41 and the center axis of the photoreceptor 3).

As is apparent from this distribution, the drum current increases with increase of the slit width. However, even in a case where the slit pitch is different, the peak of the distribution are in substantially identical positions. From this, it is obvious that even in a case where the slit pitch is different, the shapes of the distributions are substantially the same with varying peak levels.

Thus, in a case where a grid electrode having two regions of different slit pitches (coarse region and fine region) is used, it is considered that a peak position is substantially the same as that in the distribution illustrated in FIG. 21, the intensity of the drum current changes on the border between both the regions.

The coarse region and the fine region are placed in this order in a direction from the upstream side to the downstream side in the rotational direction of the photoreceptor. That is, the grid electrode is displaced in such a manner that the coarse region is on the upstream side and the fine region is on the downstream side in the rotational direction of the photoreceptor. With such a placement, the coarse charging and the adjustment charging can be performed in this order. In this case, it is possible to adjust the amount of current supplied in two steps for the change in the amount of current supplied. That is, charging can be controlled in such a manner that the coarse region supplies a certain amount of the drum current, and the fine region performs fine adjustments in the amount of currents supplied.

Moreover, the grid electrode 43C of the present embodiment is displaced in such a manner that the boundary between the coarse region and the fine region is on the upstream side in the rotational direction of the photoreceptor 3 in relation to the position corresponding to the peak of the drum current. With this arrangement, the area of the fine region can be larger than that of the coarse region. In other words, the region for the adjustment charging is larger than the region for the coarse charging.

Thus, with the arrangement in which the fine region is made larger than the coarse region in order to increase the region for fine adjustment in the amount of currents, it is possible to sufficiently perform adjustment for charging the surface of the photoreceptor at a predetermined potential, which allows for a stable charging.

The boundary between the coarse region and the fine region should be located in such a position that (a) the coarse charging for charging the surface potential of the photoreceptor at a certain degree of potential and (b) the adjustment potential for increase the surface potential to a predetermined potential are balanced with each other. Such a positioning makes it possible to avoid the high-speed apparatus from suffering from lack of charging and excessive charging.

The position of the boundary can be set appropriately in consideration of a circumferential velocity of the photoreceptor, a voltage applied to the charger line, a potential at which the photoreceptor is to be charged, and others. For example, the boundary between the coarse region and the fine region may be provided so that one-third area of the grid electrode on the upstream side is the coarse region and two-thirds area of the grid electrode on the downstream side is the fine region. With this arrangement, the coarse charging is performed in one-third area of the grid electrode on the upstream side, the adjustment charging is performed in two-thirds area of the grid electrode on the downstream side. This makes it possible to balance the coarse charging and the adjustment charging.

Thus, with the arrangement in which the coarse region and the fine region are displaced in the aforesaid order and the arrangement in which the fine region is larger in size than the coarse region in order to make the region for adjustment charging larger than the region for coarse charging, it is possible to realize uniform and stable charging.

Further, the charging device 4C is displaced in such a manner that the length of the charging device 4C is orthogonal to the rotational direction of the photoreceptor 3 and that an end of the charging device 4C having the electrodes 44 and 45 points toward the back of image forming apparatus.

In charging the photoreceptor 3, a voltage of approximately 4 KV to 6 KV is applied to the charger line 41, and a bias voltage changing in accordance with a charging potential of the photoreceptor 3 is applied to the grid electrode 43C. The grid electrode 43 is arranged to have the coarse region 52 and the fine region 53, which are of different mesh size, in a direction from the upstream side to the downstream side. This enables the photoreceptor 3 to be charged stably at a predetermined potential in the high-speed apparatus, without increasing the amount of ozone generation and upsizing the image forming apparatus. A polarity of the voltage to be applied varies depending upon development schemes, a polarity of toner used, and/or other factors.

The Applicant of the present invention conducted various kinds of studies, with the object of realizing stable charging of the photoreceptor that rotates at a high speed at a predetermined potential with the use of a charging device which performs scorotron charging by a method other than the method of increasing a width of the charger case for increase of the voltage application area.

In the studies, used was an image forming apparatus that is an electrophotographic apparatus into which the charging device 4B was to be installed. With varying conditions, a relation between a current passed through the charger line 41 (hereinafter also referred to as wire current) and a surface potential of the photoreceptor 3 (hereinafter also referred to as drum surface potential). The upper limit of the wire current was 900 (−μA). This is because the amount of ozone generation remarkably increases when the wire current exceeds 900 (−μA).

With the use of the grid electrode having the coarse region and the fine region, the present invention realizes stable charging and suppresses increase of the amount of ozone generation. However, in case of using a grid electrode having the coarse region and the fine region wherein one charger line is provided, an ascending curve of the drum surface potential becomes steep in a desired range. This may make control charging difficult. In view of this, Reference Example using a method that realizes easy charging control is described below.

REFERENCE EXAMPLE

Grid electrodes used in the present Reference Example were: a grid electrode having a slit width of 2.4 mm (slit pitch ranging from 2.55 mm to 2.57 mm); a grid electrode having a slit width of 1.8 mm (slit pitch ranging 1.95 mm to 1.97 mm); a grid electrode having a slit width of 1.2 mm (slit pitch ranging from 1.35 mm to 1.37 mm); and a grid electrode having a slit width of 0.6 mm (slit pitch ranging from 0.75 mm to 0.77 mm).

In the present Reference Example, a circumferential velocity of the photoreceptor was 600 mm/s. Moreover, a voltage applied to the grid electrode (grid potential) was 650 V, which is a target potential for the drum surface potential. One charger line, which was made of Φ60-μ tungsten wire, was displaced. Under such conditions, the drum surface potential was measured with variations of the wire current in the range from 50 μA to 900 μA. The result of the measurement is shown in FIG. 23.

Figure 23:
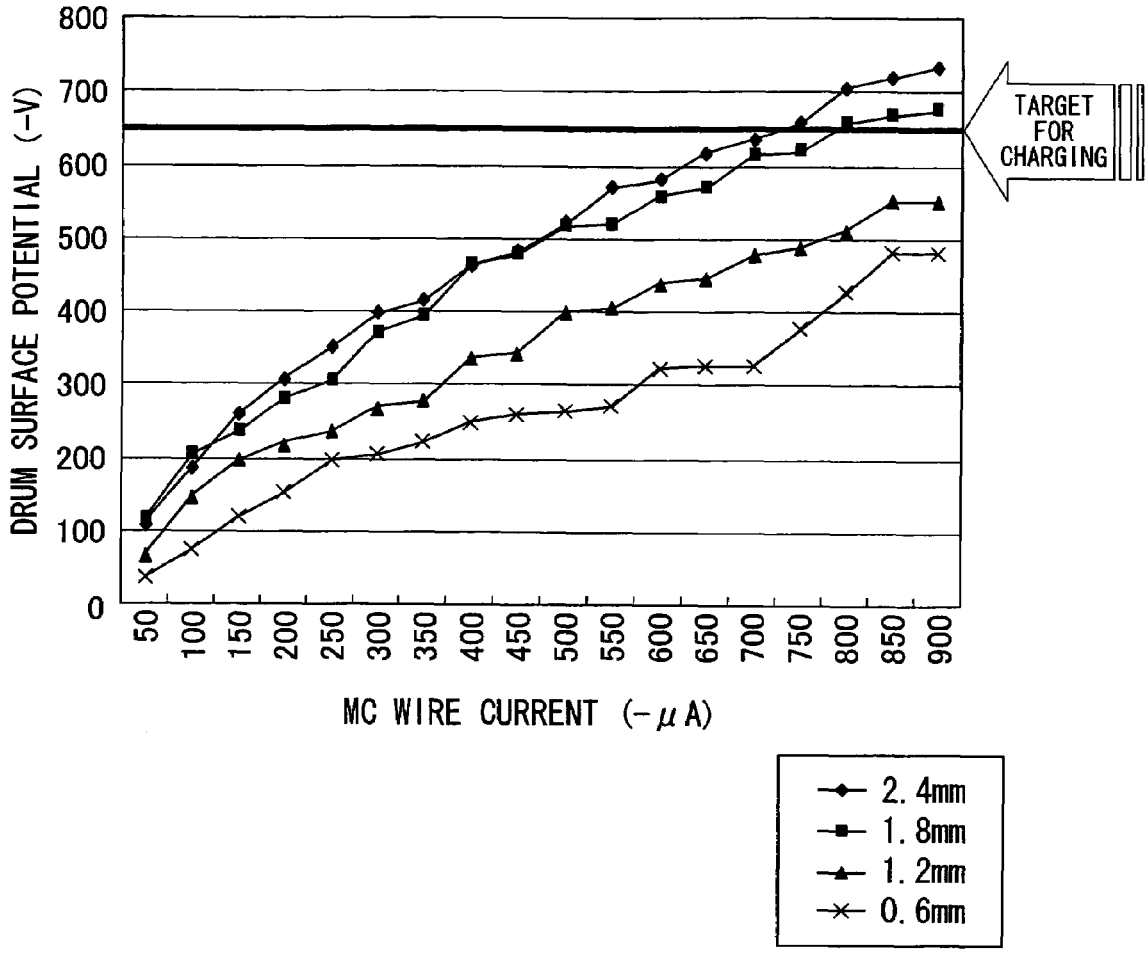
FIG. 23 is a view illustrating results of photoreceptor charging with variations of a slit width of a grid electrode in the scorotron charging device.

FIG. 23 is a graph showing a relation between the wire current and the drum surface potential. As illustrated in FIG. 23, what all of the grid electrodes have in common is that the drum surface potential increases as the wire current increases.

In the case of the grid electrode having a slit width of 1.8 mm, the drum surface potential approached 650 (−V), which is the target potential, as the wire current approached 900 (−μA), and the drum surface potential reached 650 (−V) when the wire current was 800 (−μA). That is, it was possible to obtain the target potential or a potential close to the target potential. Moreover, the drum surface potential became substantially 650 (−V) even when the wire current was a high current.

On the other hand, in the case of the grid electrode having a slit width of 2.4 mm, when the wire current was 750 μA, the drum surface potential reached 650 (−V). Then, when the wire current was 800 μA, the drum surface potential exceeded 650 V, which is the target potential.

In the case of the grid electrode having a slit width of 0.6 mm and the grid electrode having a slit width of 1.2 mm, when a high current of 900 (−μA) was supplied as the wire current, the drum surface potential did not reach 650 (−V), which is the target potential.

As described above, the charging device of the present invention is a charging device which is installed in an electrophotographic apparatus and charges at a predetermined potential a surface of an electrostatic latent image carrier which is driven for rotation, the charging device comprising: one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is on the upstream side in the rotational direction of the electrostatic latent image carrier in relation to a position corresponding to a peak of intensity distribution of a surface potential of the electrostatic latent image carrier.

The charging device of the present invention is installed in an electrophotographic apparatus, and charges at a predetermined potential a surface of an electrostatic latent image carrier which is driven for rotation. The charging device is disposed at a position that faces the electrostatic latent image carrier so that an axial direction of the charging device is orthogonal to the rotational direction of the electrostatic latent image carrier, and the charging device includes one wire, a shield electrode, and a grid electrode.

The shield electrode shields the wire and has an open surface that faces the electrostatic latent image carrier. The wire performs corona discharge when a high voltage is applied to the wire. The grid electrode is a mesh and adjusts an intensity of a current flown by the corona discharge.

Further, the grid electrode has the coarse region and the fine region which are different in mesh size. That is, the grid electrode has a plurality of openings (mesh), and the grid electrode has the coarse region and the fine region which are different in mesh size, number of openings, and density.

Here, the coarse region is a region such that the mesh member is larger in mesh size than that in the fine region. The fine region is a region such that the mesh member is smaller in mesh size than that in the coarse region. That is, as compared with the fine region, the coarse region has a larger opening area and a smaller number of openings per unit area, assuming that the coarse region and the fine region are identical in width of the electrode line provided between the openings. As compared with the coarse region, the fine region has a smaller opening area and a larger number of openings per unit area, assuming that the coarse region and the fine region are identical in width of the electrode line provided between the openings. However, the coarse region and the fine region are not necessarily identical in width of the electrode line provided between the openings. The coarse region is meshed so coarsely that openings thereof are larger in size than those of the fine region. The fine region is meshed so finely that openings thereof are smaller in size than those of the coarse region.

Thus, with the arrangement in which the grid electrode has the coarse region and the fine region, different current adjustments are performed in the coarse region and the fine region. This makes it possible to control charging differently between the regions.

For example, the coarse region has larger mesh size and therefore can sufficiently pass a current discharged from the wire. As such, by supplying a sufficient current to the surface of the electrostatic latent image carrier, it is possible to sufficiently charge the electrostatic latent image carrier. In the following descriptions, the charging performed in the coarse region is also referred to as coarse charging.

Meanwhile, the fine region has smaller mesh size and therefore can perform control a current discharged from the wire to be a preferable current value. As such, by controlling an intensity of a current to be supplied to the surface of the electrostatic latent image carrier, it is possible to control charging of the electrostatic latent image carrier for charging at a preferable value. In the following descriptions, the charging performed in the fine region is also referred to as adjustment charging.

In the charging device of the present invention, the coarse region and the fine region are placed in this order in a direction from the upstream side to the downstream side in the rotational direction of the electrostatic latent image carrier. Accordingly, the coarse charging and the adjustment charging are performed in this order.

Thus, with the arrangement in which the grid electrode has a plurality of regions that are capable of different adjustments in intensity of a current to be applied to the surface of the electrostatic latent image carrier, it is possible to perform both the coarse charging and the adjustment charging. Further, since the coarse charging and the adjustment charging are performed in this order, it is possible to perform more stable charging even in the high-speed apparatus.

Since the charging device of the present invention uses one wire, intensity distribution of surface potential of the electrostatic latent image carrier has one peak. Further, in the charging device of the present invention, a boundary between the coarse region and the fine region is on the upstream side in the rotational direction of the electrostatic latent image carrier in relation to the position corresponding to the peak of the intensity distribution of surface potential of the electrostatic latent image carrier.

When the electrostatic latent image carrier is charged, a current (drum current) flows on the surface of the electrostatic latent image carrier. Intensity distribution of the drum current corresponds to intensity distribution of the surface potential of the electrostatic latent image carrier. That is, a value of the drum current is high in an area where the surface potential of the electrostatic latent image carrier is high. A value of the drum current is low in an area where the surface potential of the electrostatic latent image carrier is low. More specifically, a peak of the intensity distribution of the surface potential of the electrostatic latent image carrier corresponds to a maximum value of the drum current (peak of the drum current).

Therefore, the charging device of the present invention can be also expressed as follow: a boundary between the coarse region and the fine region is on the upstream side in the rotational direction of the electrostatic latent image carrier in relation to the position corresponding to the peak of the intensity distribution of the drum current.

Since the boundary between the coarse region and the fine region is at a position on the upstream side in the rotational direction of the electrostatic latent image carrier in relation to the position corresponding to the peak of the intensity distribution of the surface potential of the electrostatic latent image carrier (intensity distribution of the drum current), a size of the fine region can be made larger than that of the coarse region. With this arrangement, the region for adjustment charging can be made larger. This makes it possible to realize a stable charging.

Thus, by making a size of the coarse region different from a size of the fine region and by placing the regions in the aforesaid order, it is possible for the regions to perform proper charging in a proper order. It is therefore possible to charge the electrostatic latent image carrier at a predetermined potential in a high-speed apparatus, without increasing the amount of ozone generation and without upsizing the electrophotographic apparatus.

In the charging device of the present invention, it is preferable that the grid electrode has a plurality of slits, and the slit in the coarse region has a slit width ranging from 2.0 mm to 2.6 mm and a slit pitch ranging from 2.15 mm to 2.77 mm, and the slit in the fine region has a slit width ranging from 1.2 mm to 1.6 mm and a slit pitch ranging from 1.35 mm to 1.77 mm. With the above arrangement, it is possible to charge the electrostatic latent image carrier at a predetermined potential in a high-speed apparatus.

In the charging device of the present invention, it is preferable that the grid electrode has a plurality of polygonal openings, and a diameter of each of circumcircles around the polygonal openings of the coarse region ranges from 4.0 mm to 4.5 mm and a pitch between the circumcircles ranges from 4.25 mm to 4.77 mm, and a diameter of each of circumcircles around the polygonal openings of the fine region ranges from 3.5 mm to 4.0 mm and a pitch between the circumcircles ranges from 3.75 mm to 4.27 mm. With the above arrangement, it is possible to charge the electrostatic latent image carrier at a predetermined potential in a high-speed apparatus.

In order to solve the above problem, the electrophotographic apparatus of the present invention is an electrophotographic apparatus comprising: an electrostatic latent image carrier which retains an electrostatic latent image formed on a surface thereof and is driven for rotation; and a charging device which charges a surface of the electrostatic latent image carrier at a predetermined potential, the charging device being realized by one scorotron charger, the scorotron charger comprising: one wire which is subjected to application of a high voltage and placed at a position that faces the electrostatic latent image carrier so that an axial direction of the wire is orthogonal to a rotational direction of the electrostatic latent image carrier; a shield electrode which shields the wire and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is on the upstream side in the rotational direction of the electrostatic latent image carrier in relation to a position corresponding to a peak of intensity distribution of a surface potential of the electrostatic latent image carrier.

According to the above arrangement, as explained previously in the case of the charging device, it is possible to perform a stable charging. It is therefore possible to charge the electrostatic latent image carrier at a predetermined potential in a high-speed apparatus, without increasing the amount of ozone generation and without upsizing the electrophotographic apparatus.

In the electrophotographic apparatus of the present invention, it is preferable that the grid electrode has a plurality of slits, and the slit in the coarse region has a slit width ranging from 2.0 mm to 2.6 mm and a slit pitch ranging from 2.15 mm to 2.77 mm, and the slit in the fine region has a slit width ranging from 1.2 mm to 1.6 mm and a slit pitch ranging from 1.35 mm to 1.77 mm. Further, in the electrophotographic apparatus of the present invention, it is preferable that the grid electrode has a plurality of polygonal openings, and a diameter of each of circumcircles around the polygonal openings of the coarse region ranges from 4.0 mm to 4.5 mm and a pitch between the circumcircles ranges from 4.25 mm to 4.77 mm, and a diameter of each of circumcircles around the polygonal openings of the fine region ranges from 3.5 mm to 4.0 mm and a pitch between the circumcircles ranges from 3.75 mm to 4.27 mm. With the above arrangement, it is possible to charge the electrostatic latent image carrier at a predetermined potential in a high-speed apparatus.

In the electrophotographic apparatus of the present invention, a circumferential velocity of the electrostatic latent image carrier is preferably 400 mm/sec or more. With the above arrangement, it is possible to perform a stable charging even when the electrophotographic apparatus is a high-speed apparatus.

In the electrophotographic apparatus of the present invention, it is preferable that a potential applied to the grid electrode is substantially the same as a potential set as a charging potential on the surface of the electrostatic latent image carrier. With the above arrangement, it is possible to charge the surface of the electrostatic latent image carrier at a potential that is the same as a potential applied to the grid electrode.

[Fourth Embodiment]

The following will describe an embodiment of the present invention with reference to FIG. 3, FIGS. 24 through 29. It is to be noted that, for the purpose of explanation, members having the same functions as those described in the First, Second, and Third Embodiments are given the same reference numerals and explanations thereof are omitted here.

FIG. 3 illustrates an overall structure of an image forming apparatus including a charging device 4D that is an embodiment of the present invention. The image forming apparatus of the present embodiment is different in the main from the image forming apparatus of the First Embodiment in that the image forming apparatus of the present embodiment includes the charging device 4D instead of the charging device 4A. The charging device 4D undergoes improvements for uniformly and stably charging the surface of the photoreceptor 3 rotating at a high speed, without the need for upsizing of the image forming apparatus.

Figure 26:
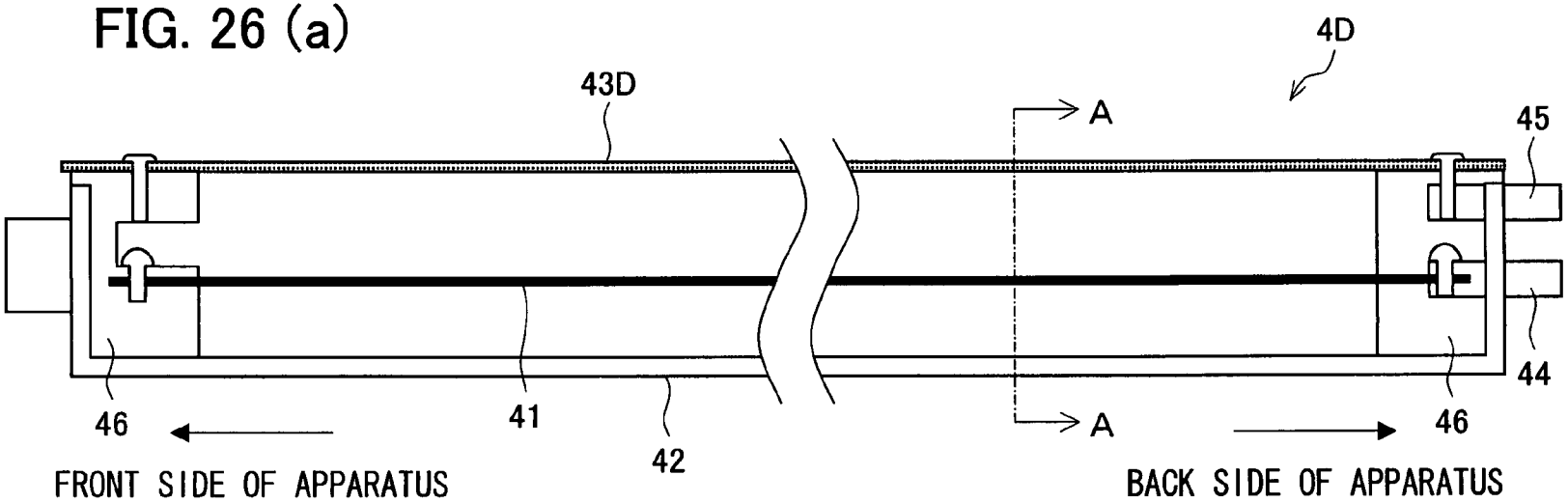
FIGS. 26(*a*) and 26(*b*) are views illustrating the structure of the scorotron charging device of Fourth Embodiment of the present invention.
Figure 26:
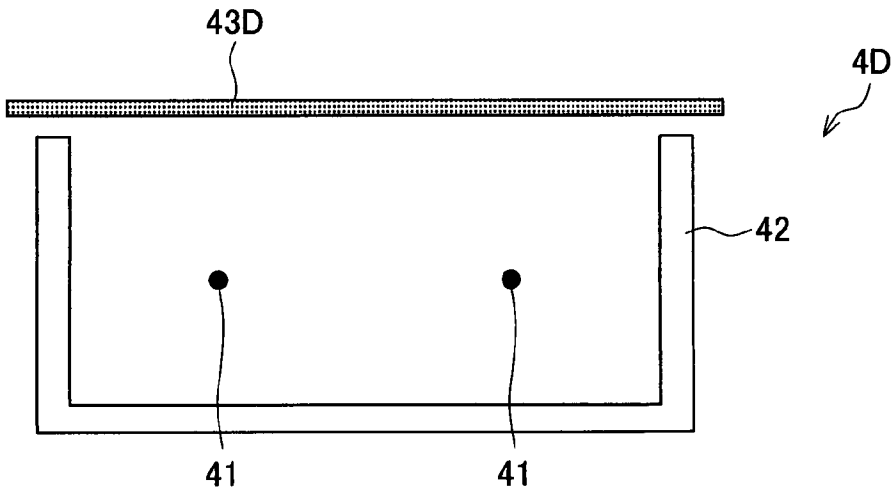

The charging device 4D of the present embodiment will be described in detail. FIGS. 26(*a*) and 26(*b*) illustrate the structure of the charging device 4D that is an embodiment of the present invention. The charging device 4C includes charger lines 41, a charger case 42, and a grid electrode 43D.

In the charging device 4D, two charger lines 41 are disposed. Identical voltages are applied to the two charger lines 41 by the electrode 44. The number of the charger lines 41 is two or more, and may be three or more. Different voltages can be applied to the charger lines 41.

As with the grid electrodes 43A through 43C, the grid electrode 43D is disposed so as to face an open surface of the charger case 42 so that a bias voltage different from a voltage applied to the charger lines 41 is applied to the grid electrode 43D. Here, a voltage applied to the grid electrode 43D by the electrode 45 is identical with the voltage applied to the charger case 42. Alternatively, the grid electrode 43 and the charger case 42 may be isolated from each other so that mutually different voltages can be applied to the grid electrode 43 and the charger case 42.

The grid electrode 43D is an electrically conducting mesh member having a plurality of openings. As with the grid electrode 43B, the grid electrode 43D has slits 50 illustrated in FIGS. 24(*a*) and 24(*b*), polygonal openings 51 illustrated in FIGS. 25(*a*) and 25(*b*), or the like openings.

As with the grid electrodes 43B and 43C, the grid electrode 43D has a coarse region 52 that is coarse-meshed and a fine region 53 that is fine-meshed.

Figure 24:
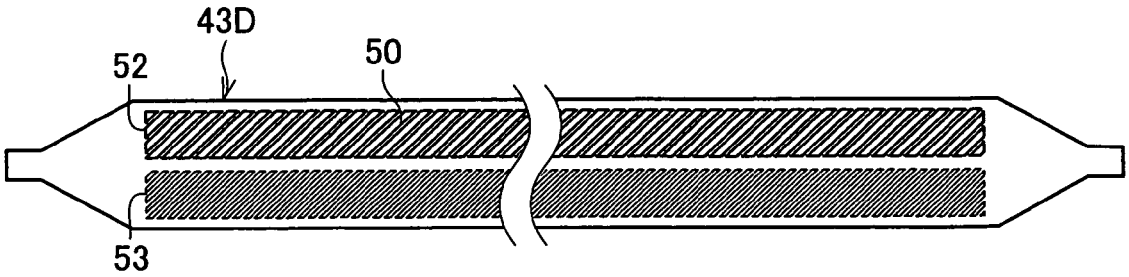
FIGS. 24(*a*) and 24(*b*) are views for explanation of a mesh size of a grid electrode provided in a scorotron charging device of Fourth Embodiment of the present invention.
Figure 24:
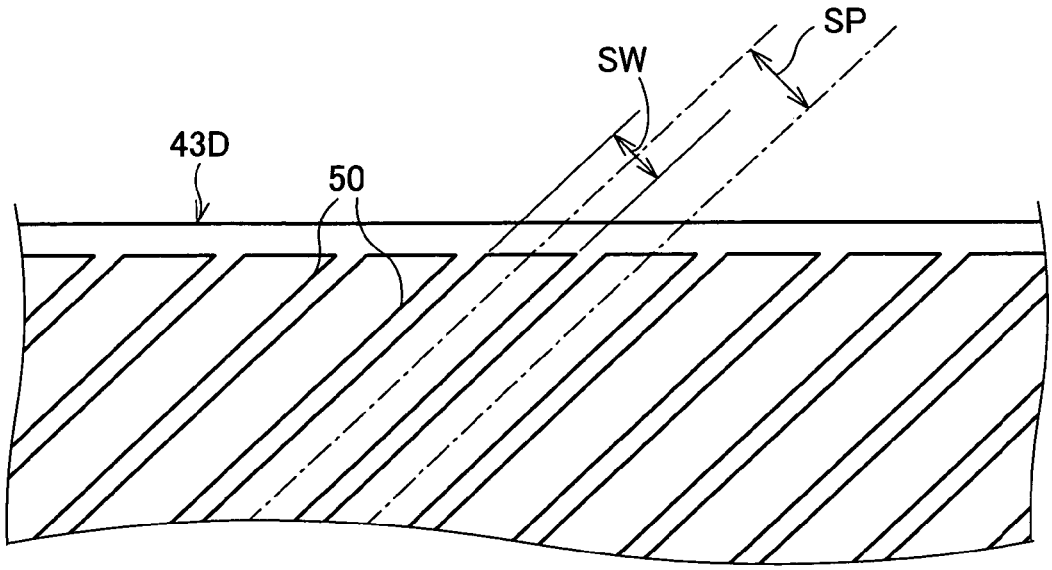

More specifically, the grid electrode 43D illustrated in FIG. 24 is such that a width of an electrode provided between the slits is in the range of 0.15 mm to 0.17 mm (error of 0.16 mm±0.01 mm), a slit width SW of the coarse region 52 is 2.4 mm (slit pitch SP in the range of 2.55 mm to 2.57 mm), and a slit width of the fine region 53 is 1.4 mm (slit pitch SP in the range of 1.55 mm to 1.57 mm).

The above-mentioned specific mesh size of the grid electrode 43 is just an example. The present invention is not limited to this. For example, in a case where a width of an electrode line provided between the slits is in the range of 0.15 mm to 0.17 mm (error of 0.16 mm±0.01 mm), the slit width SW of the coarse region 52 and the slit width SW of the fine region 53 can be arranged to be in the range of 2.0 mm to 2.6 mm (slit pitch SP in the range of 2.15 mm to 2.77 mm) and in the range of 1.2 mm to 1.6 mm (slit pitch SP in the range of 1.35 mm to 1.77 mm), respectively.

Figure 25:
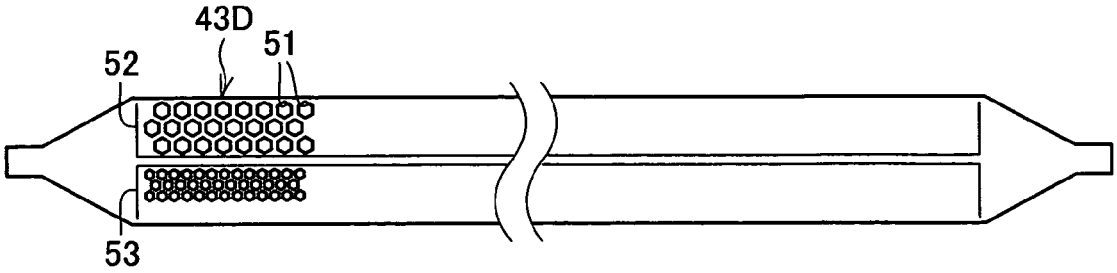
FIGS. 25(*a*) and 25(*b*) are views for explanation of a mesh size of another grid electrode provided in a scorotron charging device of Fourth Embodiment of the present invention.
Figure 25:
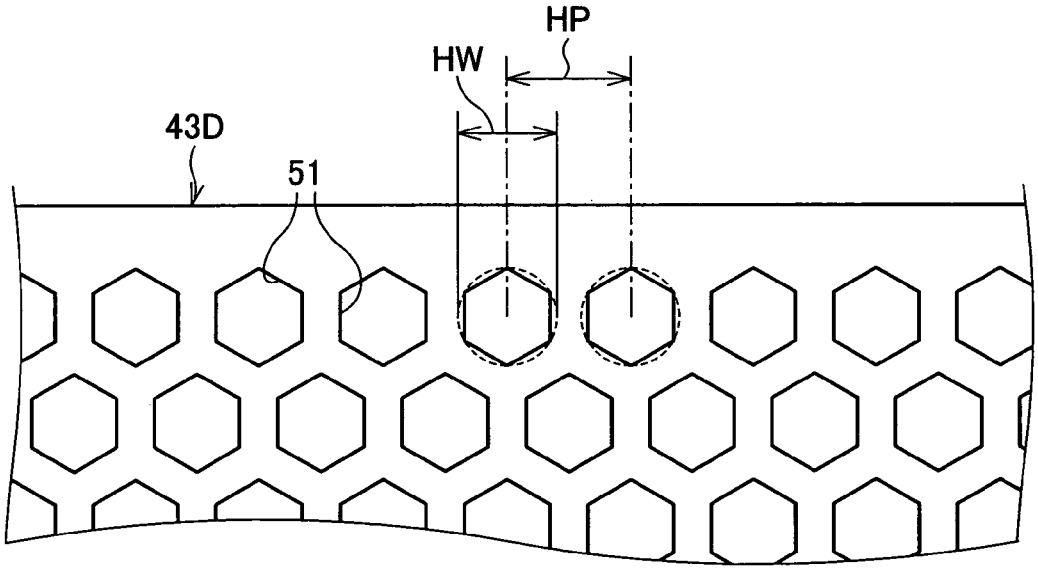

The grid electrode 43 illustrated in FIG. 25(*a*) is arranged such that a width of an electrode line provided between the slits is in the range of 0.25 mm to 0.27 mm (error of 0.26 mm±0.01 mm), a diameter HW of a circumcircle in the coarse region 52 is 4.25 mm (pitch HP between the circumcircles in the range of 4.5 mm to 4.52 mm), a diameter HW of a circumcircle in the fine region 53 is 3.75 mm (pitch HP between the circumcircles in the range of 4.0 mm to 4.02 mm).

In the grid electrode 43 illustrated in FIG. 25(*a*), the above-mentioned specific mesh size of the grid electrode 43 is just an example. The present invention is not limited to this. For example, in a case where a width of an electrode line provided between the slits is in the range of 0.25 mm to 0.27 mm (error of 0.26 mm±0.01 mm), a diameter HW of a circumcircle in the coarse region 52 and a diameter HW of a circumcircle in the fine region 53 can be arranged to be in the range of 4.0 mm to 4.5 mm (pitch HP between the circumcircles in the range of 4.25 mm to 4.77 mm) and in the range of 3.5 mm to 4.0 mm (pitch HP between the circumcircles in the range of 3.75 mm to 4.27 mm), respectively.

That is, in both of the cases illustrated in FIGS. 24(*a*) and 25(*a*), the widths of the electrode lines which form the slit widths are substantially identical with each other. As compared with the fine region 53, the coarse region 52 has the slit 50 (opening 51) which is larger in area, and has a smaller number of slits 50 (openings 51) per unit area. On the other hand, as compared with the coarse region 52, the fine region 53 has the slit 50 (opening 51) which is smaller in area, and has a larger number of slits 50 (openings 51) per unit area.

In charging the photoreceptor 3, when a voltage is applied to the charger line 41 of the charging device, the surface of he photoreceptor 3 is charged by corona discharge of the charger lines 41. This causes a current to flow on the surface of the photoreceptor 3. This current is referred to as "drum current".

A surface potential of the photoreceptor 3 varies in intensity from place to place. A distribution showing the variations in intensity of the surface potential is a distribution of the photoreceptor surface potential. The drum current takes a current value according to the intensity distribution of the photoreceptor surface potential. In other words, the intensity distribution of the drum current (distribution of the drum current) corresponds to the intensity distribution of the photoreceptor surface potential (distribution of the photoreceptor surface potential). Therefore, a value of the drum current is high in an area where the photoreceptor surface potential is high, whereas a value of the drum current is low in an area where the photoreceptor surface potential is low.

The photoreceptor surface potential is the highest in areas on the surface of the photoreceptor corresponding to straight lines that each connects the charger line and the center axis of the photoreceptor. The photoreceptor surface potential is low in areas on the surface of the photoreceptor between the straight lines. That is, the distribution of the photoreceptor surface potential has peaks on the surface of the photoreceptor on the straight lines that each connects the respective center axes of the charger line and the photoreceptor, and has a valley between the peaks.

The grid electrode of the charging device 4D is disposed in such a manner that a boundary between the coarse region 52 and the fine region 53 is located in the aforesaid area where the photoreceptor surface potential is low. That is, the grid electrode is disposed in such a manner that another straight line that connects the boundary and the center axis of the photoreceptor 3 exists between the straight lines that each connects the charger line and the center axis of the photoreceptor. It is preferable that the another straight line is located at a position corresponding to the valley of the photoreceptor surface potential.

Figure 27:
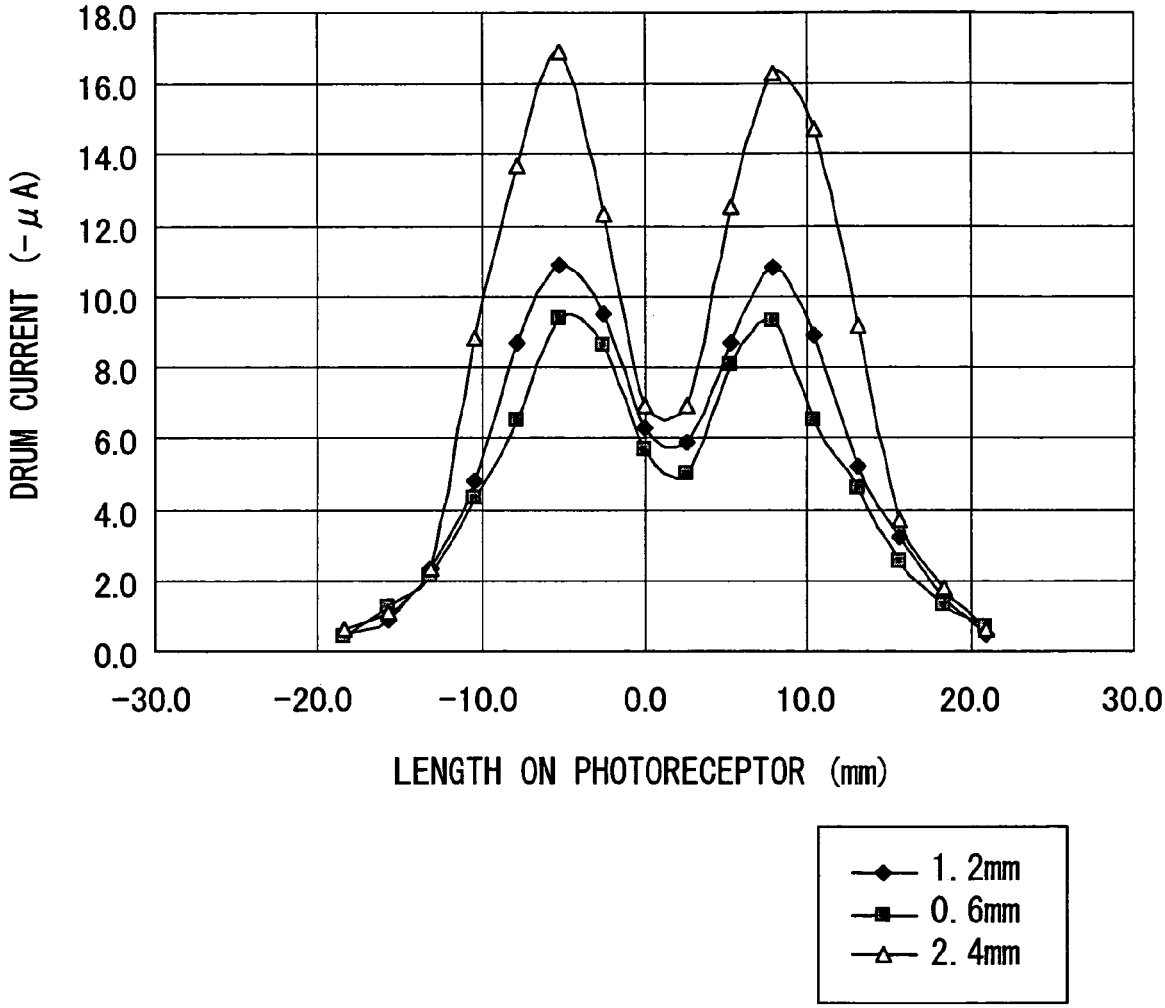
FIG. 27 is a view illustrating a relation between a length on the photoreceptor and a drum current in the scorotron charging device when a slit width of a grid electrode is changed.

Now, the distribution of the drum current (photoreceptor surface potential) flowing on the surface of the photoreceptor 3 is described below. FIG. 27 is a graph showing intensity distribution of the drum current flowing on the surface of the photoreceptor 3 when a voltage is applied to the charger lines 41. FIG. 27 takes as examples the cases of using grid electrodes each having slits of single mesh pattern without the coarse region and the fine region. The grid electrodes used are three types of grid electrodes which have different slit widths (0.6 mm, 1.2 mm, and 2.4 mm).

A length on the photoreceptor illustrated in FIG. 27 indicates a distance from a point (0.0 mm) on the photoreceptor corresponding to a center point of the charging device (midway point between the charger lines) to a downstream side or an upstream side in a rotational direction of the photoreceptor 3. The distances from the downstream side to the upstream side in the rotational direction of the photoreceptor 3 are indicated by values ranging from −30.0 mm to 30.0 mm.

Figure 28:
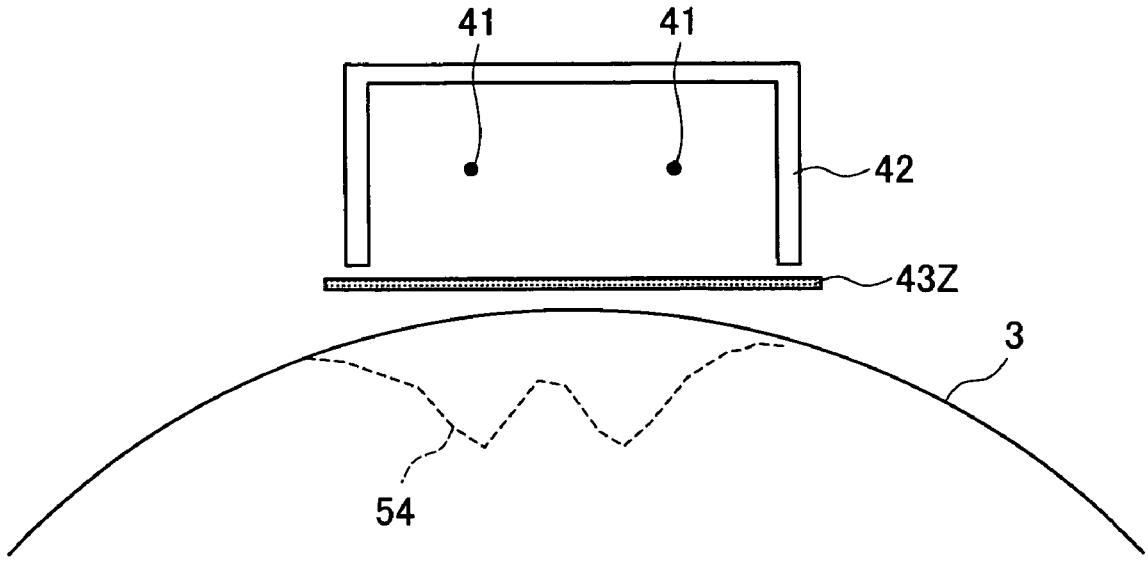
FIG. 28 is a view schematically illustrating distribution of the drum current shown in FIG. 27 projected on the photoreceptor along the length of the photoreceptor.

As illustrated in FIG. 27, all of the results obtained by using the foregoing grid electrodes showed that the distribution of the drum current has two peaks (maximum value) and one valley (minimum value). FIG. 28 schematically illustrates intensity distribution of the drum current projected on the photoreceptor along the length of the photoreceptor. In FIG. 28, a drum current intensity distribution 54 is schematically illustrated. As illustrated in FIGS. 27 and 28, the peaks of the drum current are located corresponding to positions where the charger lines 41 are provided (positions on the surface of the photoreceptor on straight lines that each connects the charger line and the center axis of the photoreceptor). The valley of the drum current is located a bit on the upstream side in relation to a position corresponding to a center point between the two charger lines (position between straight lines that each connects the charger line and the center axis of the photoreceptor).

As is apparent from this distribution, the drum current increases with increase of the slit width. However, even in a case where the slit pitch is different, the peaks and the valley of the distribution are in substantially identical positions. From this, it is obvious that even in a case where the slit pitch is different, the shapes of the distributions are substantially the same with varying peak levels.

Thus, in a case where a grid electrode having two regions of different slit pitches (coarse region and fine region) is used, it is considered that positions of the peaks and the valley are substantially the same as positions of the peaks and the valley in the distribution illustrated in FIG. 27, and the intensity of the drum current varies depending upon the peaks.

Further, the grid electrode of the present embodiment is disposed in such a manner that the boundary between the coarse region and the fine region is at a position corresponding to the valley of the drum current. In this case, it is possible to flow drum currents in different amounts between both of the regions between which the valley is sandwiched in the distribution of the drum current. That is, when the boundary between the coarse region and the fine region is located at substantially the same position as the position of the valley in the distribution of the drum current, the peaks of the drum current caused by corona discharge of the wires correspond to the coarse region and the fine region. Therefore, change between the coarse charging and the adjustment charging can be caused in the area where the drum current is low.

The area where the drum current is low (valley) corresponds to a low current flowing on the surface of the photoreceptor, and therefore insignificantly contributes to charging of the photoreceptor. On the other hand, the area where the drum current is high (peak) corresponds to a high current flowing on the surface of the photoreceptor, and therefore significantly contributes to charging of the photoreceptor. That is, when the boundary between the coarse region and the fine region is sited in the vicinity of the peak of the drum current, slight displacement of the boundary significantly changes a value of the current flowing on the surface of the photoreceptor. This makes it difficult to perform stable charging. On the contrary, when the boundary between the coarse region and the fine region is sited in the vicinity of the valley of the drum current, slight displacement of the boundary slightly changes the amount of current flowing on the surface of the photoreceptor. As a result, stable charging becomes possible. This realizes easy charging control.

The grid electrode is placed in such a manner that the coarse region and the fine region are located respectively on the upstream side and on the downstream side in the rotational direction of the photoreceptor. With such a placement, the coarse charging and the adjustment charging can be performed in this order. In this case, it is possible to adjust the amount of current supplied in two steps for the change in the amount of current supplied. That is, charging can be controlled in such a manner that the coarse region supplies a certain amount of the drum current, and the fine region performs fine adjustments in the amount of currents supplied. As a result it is possible to avoid the high-speed apparatus from suffering from lack of charging and excessive charging.

Further, the charging device 4D is disposed in such a manner that the length of the charging device 4D is orthogonal to the rotational direction of the photoreceptor 3 and that an end of the charging device 4D having the electrodes 44 and 45 points toward the back of image forming apparatus. In charging the photoreceptor 3, a voltage of approximately 4 KV to 6 KV is applied to the charger lines 41, and a bias voltage changing in accordance with a charging potential of the photoreceptor 3 is applied to the grid electrode 43. The grid electrode 43 is arranged to have the coarse region 52 and the fine region 53, which are of different mesh size, in a direction from the upstream side to the downstream side. This enables the photoreceptor 3 to be charged stably at a predetermined potential in the high-speed apparatus, without increasing the amount of ozone generation and upsizing the image forming apparatus. A polarity of the voltage to be applied varies depending upon development schemes, a polarity of toner used, and/or other factors.

In a case where the number of charger lines is three or more, a distribution of the drum current has (a) peaks as many as the charger lines and (b) valleys the number of which is less by one than the number of peaks. In this case, the boundary between the coarse region and the fine region of the grid electrode is located at a position corresponding to any of the valleys. It is especially preferable that the boundary between the coarse region and the fine region is located so that a size of the fine region is equal to or larger than that of the coarse region.

More specifically, in a case where the number of peaks is an even number, it is preferable that the boundary between the coarse region and the fine region is located at a position corresponding to a valley in the center or a valley provided on the upstream side in relation to the valley in the center. In a case where the number of peaks is an odd number, it is preferable that the boundary between the coarse region and the fine region is located at a position corresponding to a valley on the upstream side in relation to a peak in the center.

Thus, by making a size of the fine region equal to or larger than that of the coarse region, the region for adjustment charging can be made larger. This makes it possible to perform more stable charging.

In the present embodiment, identical voltages are applied to a plurality of wires. However, the present invention is not limited to this. Alternatively, different voltages may be applied to a plurality of wires.

Te Applicant of the present invention conducted various kinds of studies, with the object of realizing stable charging of the photoreceptor that rotates at a high speed at a predetermined potential with the use of a charging device which performs scorotron charging by a method other than the method of increasing a width of the charger case for increase of the voltage application area.

In the studies, used was an image forming apparatus that is an electrophotographic apparatus into which the charging device 4 was to be installed. With varying conditions, a relation between a current passed through the charger lines (hereinafter also referred to as wire current) and a surface potential of the photoreceptor (hereinafter also referred to as drum surface potential) was found out. The upper limit of the wire current was 900 (−μA). This is because the amount of ozone generation remarkably increases when the wire current exceeds 900 (−μA). The relation will be explained in detail with the following Example and Comparative Examples.

EXAMPLE 1

In Example 1, used was a grid electrode such that a slit width in the coarse region is 2.4 mm (slit pitch ranging from 2.55 mm to 2.57 mm) and a slit width in the fine region is 1.4 mm (slit pitch ranging from 1.55 mm to 1.57 mm).

In the present Example, it was assumed that a circumferential velocity of the photoreceptor was 600 mm/s. Moreover, it was assumed that a voltage applied to the grid electrode (grid potential) was 650 (−V), a target potential for the drum surface potential. Two charger lines, which were made of Φ60-μ tungsten wire, were placed. The charger lines shared one electrode. Under such conditions, the drum surface potential was measured with variations of the wire current in the range from 300 μA to 900 μA. The result of the measurement is shown in FIG. 29

Figure 29:
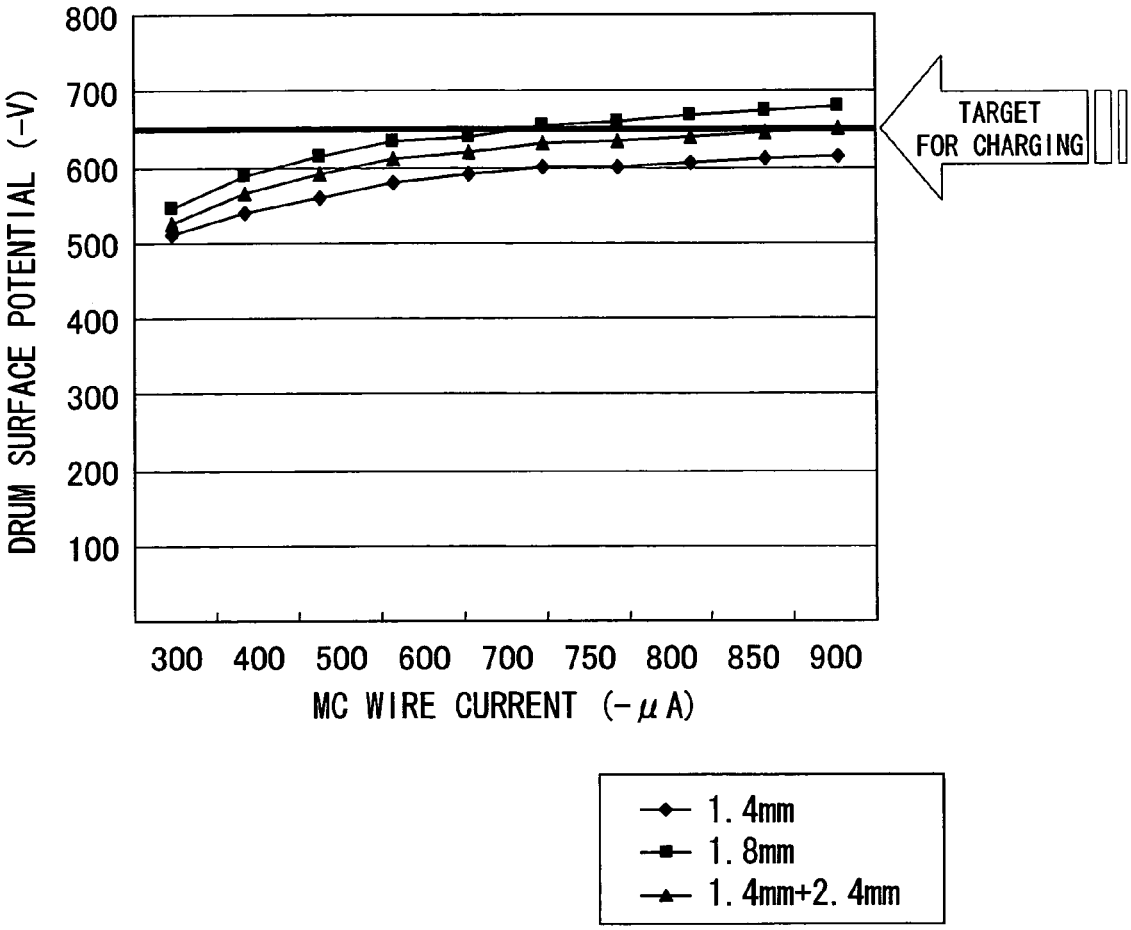
FIG. 29 is a view illustrating results of photoreceptor charging with variations of a slit width of a grid electrode in the scorotron charging device.

FIG. 29 is a graph showing a relation between the wire current and the drum surface potential. As illustrated in FIG. 29, the drum surface potential increased with increase of the wire current. The drum surface potential approached 650 (−V), target potential, as the wire current approached 900 (−μA), and the drum surface potential reached 650 (−V) when the wire current was 900 (−μA). In other words, in Example 1, it is possible to obtain the target potential or a potential close to the target potential. Moreover, the drum surface potential does not exceed the target potential, 650 (−V), when the wire current is a high current. That is, it is obvious that charging at the predetermined potential is realized even in the high-speed apparatus.

COMPARATIVE EXAMPLE 1

In Comparative Example 1, used was a single-pattern grid electrode having uniform slit width and slit pitch in entire area of the grid electrode. The grid electrode used in Comparative Example 1 has a slit width of 1.4 mm (slit pitch ranging from 1.55 mm to 1.57 mm).

Further, in Comparative Example 1, the drum surface potential was measured in the same manner under the same conditions as those of Example 1 in circumferential velocity of the photoreceptor, grid potential, wire current, and others. The results of the measurement is shown in FIG. 29.

As illustrated in FIG. 29, in Comparative Example 1, the drum surface potential increased with increase of the wire current. However, when a high current of 900 (−μA), the drum surface potential increased to 615 (−V), but did not reach the target potential. That is, it was impossible to charge at the predetermined potential.

COMPARATIVE EXAMPLE 2

In Comparative Example 2, the single-pattern grid electrode was used. The grid electrode used in Comparative Example 2 had a slit width of 1.8 mm (slit pitch ranging from 1.95 mm to 1.97 mm). In Comparative Example 2, the drum surface potential was measured the same conditions as those of Example 1 in circumferential velocity of the photoreceptor, grid potential, wire current, and others. The results of the measurement is shown in FIG. 29.

As illustrated in FIG. 29, in Comparative Example 2, the drum surface potential increased with increase of the wire current. However, when the wire current was 700 (−μA), the drum surface potential becames 653 (−V), which exceeds the target potential. That is, it was impossible to charge at a desired potential.

Besides, as compared with the charging device disclosed in the previously described Japanese Unexamined Patent Publication No. 137368/2000, the charging devices 4C and 4D of the present embodiments have the effect of bringing more excellent charging stability in a direction of the length of the photoreceptor as well as the effect of downsizing.

More specifically, in the arrangement disclosed in Japanese Unexamined Patent Publication No. 137368/2000, a plurality of scorotron charging sections each having one charger line are disposed, and the grid electrodes are different in aperture ratio. In such an arrangement, charging performance partially may decrease due to toner attached to a charger line of a charging section with a large aperture ratio and high charging performance. Thereafter, even though a charging section with a small aperture ratio uniformly charges, nonuniform charging occurs in a direction of the length of the photoreceptor.

On the contrary, the charging devices 4C and 4D of the present embodiment each has only one charger case 42, and the grid electrodes 43C or 43D provided to the charger case 42 has different mesh sizes (aperture ratios) in the rotational direction of the photoreceptor.

Therefore, even if charging performance partially decreases due to toner attached to the charger line 41, the grid electrode 43C or 43D having the coarse region and the fine region makes such failure uniform. This alleviates nonuniform charging on the surface of the photoreceptor 3, thus realizing a high charging stability in a direction of the length of the photoreceptor.

In order to solve the above problem, the charging device of the present invention is a charging device which is installed in an electrophotographic apparatus and charges at a predetermined potential a surface of an electrostatic latent image carrier which is driven for rotation, the charging device comprising: a plurality of wires which are subjected to application of a high voltage and placed at positions that face the electrostatic latent image carrier so that axial direction of the wires is orthogonal to a rotational direction of the electrostatic latent image carrier; a shield electrode which shields the wires and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is located at a position corresponding to a valley of intensity distribution of a surface potential of the electrostatic latent image carrier.

The charging device of the present invention is installed in an electrophotographic apparatus, and charges at a predetermined potential a surface of an electrostatic latent image carrier which is driven for rotation. The charging device is disposed at a position that faces the electrostatic latent image carrier so that an axial direction of the charging device is orthogonal to the rotational direction of the electrostatic latent image carrier, and the charging device includes a plurality of wires, a shield electrode, and a grid electrode.

The shield electrode shields the plurality of wires and has an open surface that faces the electrostatic latent image carrier. The wires perform corona discharge when a high voltage is applied to the wires. The grid electrode is a mesh and adjusts an intensity of a current flown by the corona discharge.

Further, the grid electrode has the coarse region and the fine region which are different in mesh size. That is, the grid electrode has a plurality of openings (mesh), and the grid electrode has the coarse region and the fine region which are different in mesh size, number of openings, and density.

Here, the coarse region is a region such that the mesh member is larger in mesh size than that in the fine region. The fine region is a region such that the mesh member is smaller in mesh size than that in the coarse region. That is, as compared with the fine region, the coarse region has a larger opening area and a smaller number of openings per unit area, assuming that the coarse region and the fine region are identical in width of the electrode line provided between the openings. As compared with the coarse region, the fine region has a smaller opening area and a larger number of openings per unit area, assuming that the coarse region and the fine region are identical in width of the electrode line provided between the openings. However, the coarse region and the fine region are not necessarily identical in width of the electrode line provided between the openings. The coarse region is meshed so coarsely that openings thereof are larger in size than those of the fine region. The fine region is meshed so finely that openings thereof are smaller in size than those of the coarse region.

Thus, with the arrangement in which the grid electrode has the coarse region and the fine region, different current adjustments are performed in the coarse region and the fine region. This makes it possible to control charging differently between the regions.

For example, the coarse region has larger mesh size and therefore can sufficiently pass a current discharged from the wire. As such, by supplying a sufficient current to the surface of the electrostatic latent image carrier, it is possible to sufficiently charge the electrostatic latent image carrier. In the following descriptions, the charging performed in the coarse region is also referred to as coarse charging.

Meanwhile, the fine region has smaller mesh size and therefore can perform control a current discharged from the wire to be a preferable current value. As such, by controlling an intensity of a current to be supplied to the surface of the electrostatic latent image carrier, it is possible to control charging of the electrostatic latent image carrier for charging at a preferable value. In the following descriptions, the charging performed in the fine region is also referred to as adjustment charging.

In the charging device of the present invention, the coarse region and the fine region are placed in this order in a direction from the upstream side to the downstream side in the rotational direction of the electrostatic latent image carrier. Accordingly, the coarse charging and the adjustment charging are performed in this order.

Thus, with the arrangement in which the grid electrode has a plurality of regions that are capable of different adjustments in intensity of a current to be applied to the surface of the electrostatic latent image carrier, it is possible to perform both the coarse charging and the adjustment charging. Further, since the coarse charging and the adjustment charging are performed in this order, it is possible to perform more stable charging even in the high-speed apparatus.

In addition, according to the charging device of the present invention, since a plurality of wires are used, the intensity distribution of the surface potential of the electrostatic latent image carrier has a plurality of peaks. In other words, a valley exists in the intensity distribution of the surface potential of the electrostatic latent image carrier.

When the electrostatic latent image carrier is charged, a current (drum current) flows on the surface of the electrostatic latent image carrier. Intensity distribution of the drum current corresponds to intensity distribution of the surface potential of the electrostatic latent image carrier. That is, a value of the drum current is high in an area where the surface potential of the electrostatic latent image carrier is high. A value of the drum current is low in an area where the surface potential of the electrostatic latent image carrier is low. More specifically, a peak in the intensity distribution of the surface potential of the electrostatic latent image carrier is a maximum value of the drum current (peak of the drum current), and a valley in the intensity distribution of the surface potential of the electrostatic latent image carrier is a minimum value of the drum current (valley of the drum current).

The grid electrode in the present invention is arranged so as to be located at a position corresponding to a valley in the intensity distribution of the surface potential of the electrostatic latent image carrier (at a position corresponding to a valley of the drum current). That is, the grid electrode is arranged such that the boundary between the coarse region and the fine region is located at a position corresponding to a valley in the intensity distribution, which the valley exists between the peak in the intensity distribution of the surface potential of the electrostatic latent image carrier and its adjacent peak.

As described previously, the peak of the drum current corresponds to a high current flowing on the surface of the electrostatic latent image carrier. Therefore, at the peak of the drum current, contribution to charging of the electrostatic latent image carrier is significant. Thus, when the boundary between the coarse region and the fine region is sited in the vicinity of the peak of the drum current, slight displacement of the boundary significantly changes the amount of current flowing on the surface of the electrostatic latent image carrier. This makes it difficult to perform stable charging.

On the other hand, the valley of the drum current corresponds to a low current flowing on the surface of the electrostatic latent image carrier. Therefore, at the valley of the drum current, contribution to charging of the electrostatic latent image carrier is insignificant. Thus, when the boundary between the coarse region and the fine region is sited in the vicinity of the valley of the drum current, slight displacement of the boundary slightly changes the amount of current flowing on the surface of the electrostatic latent image carrier. As a result, stable charging and easy charging control become possible.

Thus, it is possible to charge the electrostatic latent image carrier at a predetermined potential in the high-speed apparatus, without increase of the amount of ozone generation and without upsizing of the image forming apparatus.

In the charging device of the present invention, it is preferable that the fine region has an area larger than that of the coarse region. According to the above arrangement, since the region for adjustment charging can be made larger, it is possible to efficiently perform stable charging.

In the charging device of the present invention, it is preferable that the grid electrode has a plurality of slits, and the slit in the coarse region has a slit width ranging from 2.0 mm to 2.6 mm and a slit pitch ranging from 2.15 mm to 2.77 mm, and the slit in the fine region has a slit width ranging from 1.2 mm to 1.6 mm and a slit pitch ranging from 1.35 mm to 1.77 mm. With the above arrangement, it is possible to charge the electrostatic latent image carrier at a predetermined potential in a high-speed apparatus.

In the charging device of the present invention, it is preferable that the grid electrode has a plurality of polygonal openings, and a diameter of each of circumcircles around the polygonal openings of the coarse region ranges from 4.0 mm to 4.5 mm and a pitch between the circumcircles ranges from 4.25 mm to 4.77 mm, and a diameter of each of circumcircles around the polygonal openings of the fine region ranges from 3.5 mm to 4.0 mm and a pitch between the circumcircles ranges from 3.75 mm to 4.27 mm. With the above arrangement, it is possible to charge the electrostatic latent image carrier at a predetermined potential in a high-speed apparatus.

In order to solve the above problem, the electrophotographic apparatus of the present invention is an electrophotographic apparatus comprising: an electrostatic latent image carrier which retains an electrostatic latent image formed on a surface thereof and is driven for rotation; and a charging device which charges a surface of the electrostatic latent image carrier at a predetermined potential, the charging device being realized by one scorotron charger, the scorotron charger comprising: a plurality of wires which are subjected to application of a high voltage and placed at positions that face the electrostatic latent image carrier so that axial direction of the wires is orthogonal to a rotational direction of the electrostatic latent image carrier; a shield electrode which shields the wires and has an open surface that faces the electrostatic latent image carrier; and a meshed grid electrode which is placed so as to face the open surface of the shield electrode, wherein: the grid electrode has a coarse region and a fine region which are different in mesh size; the coarse region and the fine region are disposed in this order in a direction from an upstream side to a downstream side of the rotational direction of the electrostatic latent image carrier; and a boundary between the coarse region and the fine region is located at a position corresponding to a valley of intensity distribution of a surface potential of the electrostatic latent image carrier.

According to the above arrangement, as explained previously in the case of the charging device, it is possible to perform a stable charging and easily perform charging control. It is therefore possible to charge the electrostatic latent image carrier at a predetermined potential in a high-speed apparatus, without increasing the amount of ozone generation and without upsizing the image forming apparatus.

In the electrophotographic apparatus of the present invention, it is preferable that the fine region has an area larger than that of the coarse region. According to the above arrangement, since the region for adjustment charging can be made larger, it is possible to efficiently perform stable charging.

In the electrophotographic apparatus of the present invention, it is preferable that the grid electrode has a plurality of slits, and the slit in the coarse region has a slit width ranging from 2.0 mm to 2.6 mm and a slit pitch ranging from 2.15 mm to 2.77 mm, and the slit in the fine region has a slit width ranging from 1.2 mm to 1.6 mm and a slit pitch ranging from 1.35 mm to 1.77 mm. Further, in the electrophotographic apparatus of the present invention, it is preferable that the grid electrode has a plurality of polygonal openings, and a diameter of each of circumcircles around the polygonal openings of the coarse region ranges from 4.0 mm to 4.5 mm and a pitch between the circumcircles ranges from 4.25 mm to 4.77 mm, and a diameter of each of circumcircles around the polygonal openings of the fine region ranges from 3.5 mm to 4.0 mm and a pitch between the circumcircles ranges from 3.75 mm to 4.27 mm. With the above arrangement, it is possible to charge the electrostatic latent image carrier at a predetermined potential in a high-speed apparatus.

In the electrophotographic apparatus of the present invention, a circumferential velocity of the electrostatic latent image carrier is preferably 400 mm/sec or more. With the above arrangement, it is possible to perform a stable charging even when the electrophotographic apparatus is a high-speed apparatus.

In the electrophotographic apparatus of the present invention, it is preferable that a potential applied to the grid electrode is substantially the same as a potential set as a charging potential on the surface of the electrostatic latent image carrier. With the above arrangement, it is possible to charge the surface of the electrostatic latent image carrier at a potential that is the same as a potential applied to the grid electrode.

[Fifth Embodiment]

The following will describe an embodiment of the present invention with reference to FIGS. 30 through 44. It is to be noted that, for the purpose of explanation, members having the same functions as those described in the First Embodiment are given the same reference numerals and explanations thereof are omitted here.

In the present embodiment, used was an image forming apparatus that is an electrophotographic apparatus into which the charging device 4A was to be installed. A photoreceptor was an organic photoreceptor having a diameter of 120 mm.

As a grid electrode used were four types of grid electrodes each including 0.1 mm-thick thin film made of SUS and electrode lines provided between slits. The grid electrodes were such that a width of the electrode line ranged from 0.15 mm to 0.17 mm (error of 0.16 mm±0.01 mm), and slit widths thereof were 1.2 mm, 1.8 mm, 2.4 mm, and 2.6 mm, respectively.

Two charger lines, which were made of Φ60-μ tungsten wire, were placed side by side in a rotational direction of the photoreceptor. The charger lines shared one electrode.

Figure 30:
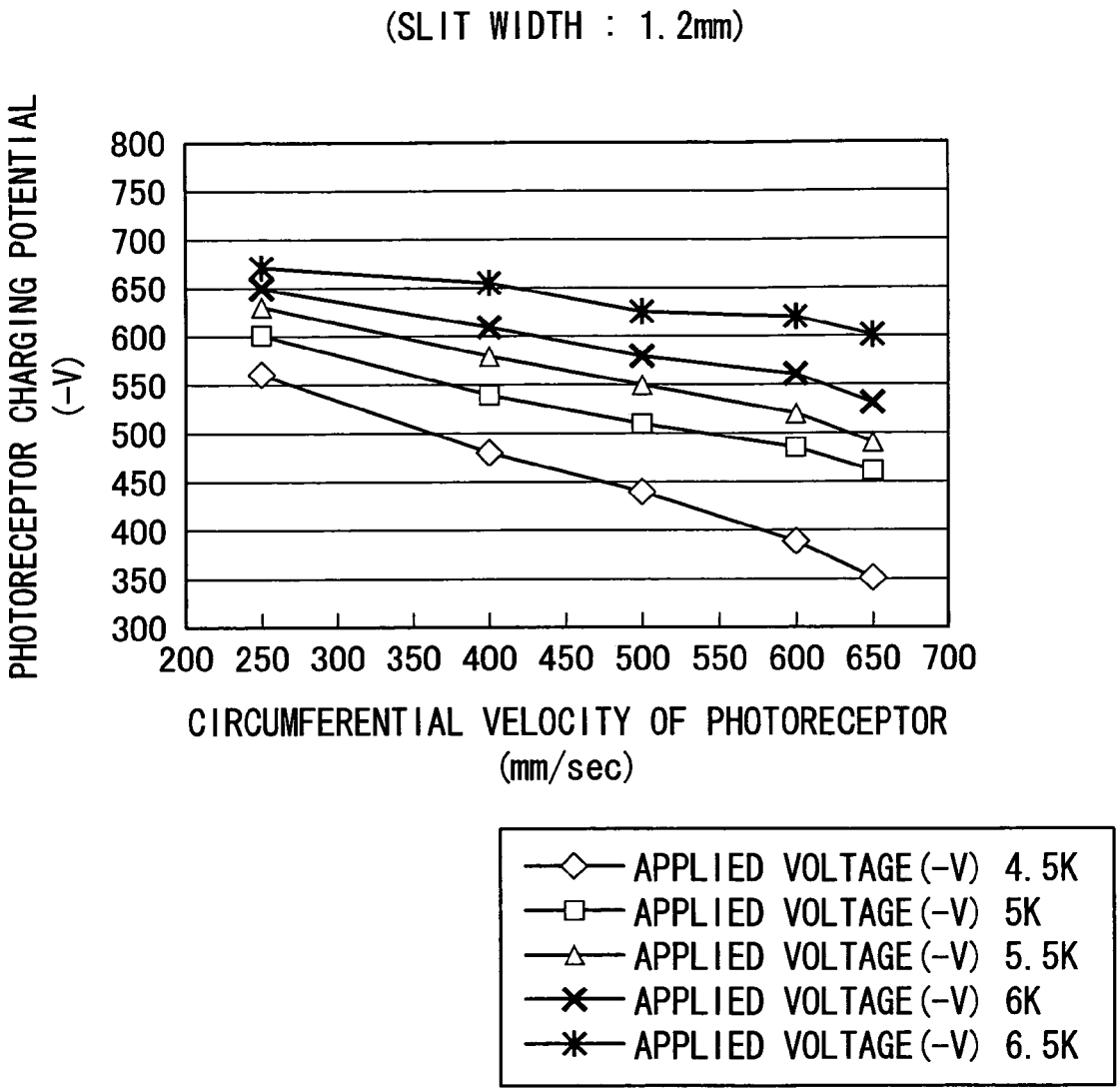
FIG. 30 is a view illustrating Fifth Embodiment of the present invention and illustrating a result of examination on a relation between a circumferential velocity of the photoreceptor and a charging potential of the photoreceptor in a situation where no grid voltage is applied, at a certain slit width in the scorotron charging device for each of applied voltages.

By using the grid electrode having a slit width of 1.2 mm, a relation between a circumferential velocity of the photoreceptor and a charging potential (ultimate potential) of the photoreceptor in a situation where no grid voltage is applied was examined with variations of a voltage applied to the charger lines. FIG. 30 shows a result of the examination.

A voltage applied to the charger lines varied from 4.5 K to 6.5 K (−V) in increments of 0.5 K (−V). Circumferential velocities of the photoreceptor were 250 mm/sec, 400 mm/sec, 500 mm/sec, 600 mm/sec, and 650 mm/sec.

Figure 31:
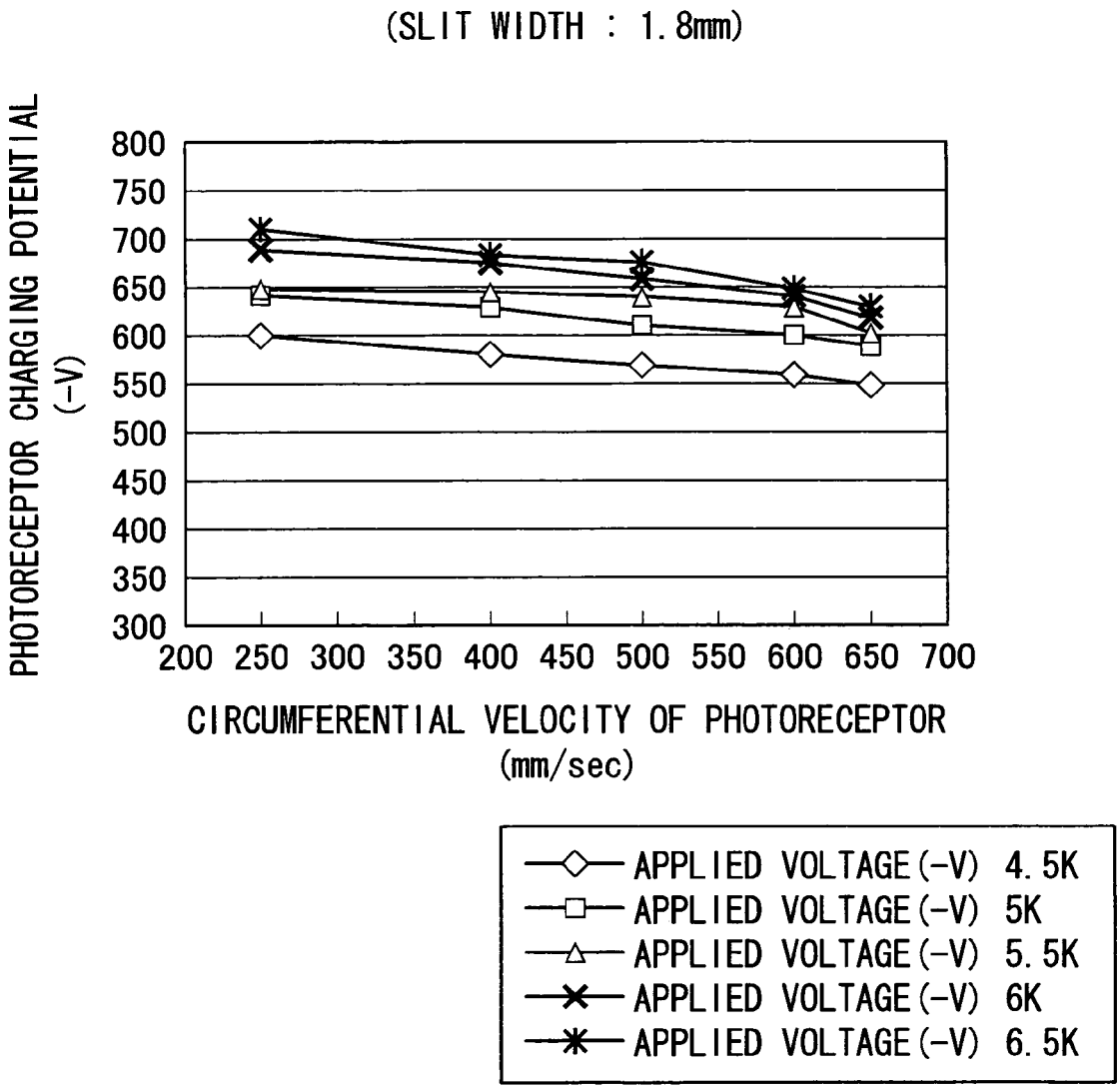
FIG. 31 a view illustrating a result of examination on a relation between a circumferential velocity of the photoreceptor and a charging potential of the photoreceptor in a situation where no grid voltage is applied, at a certain slit width for each of applied voltages.
Figure 32:
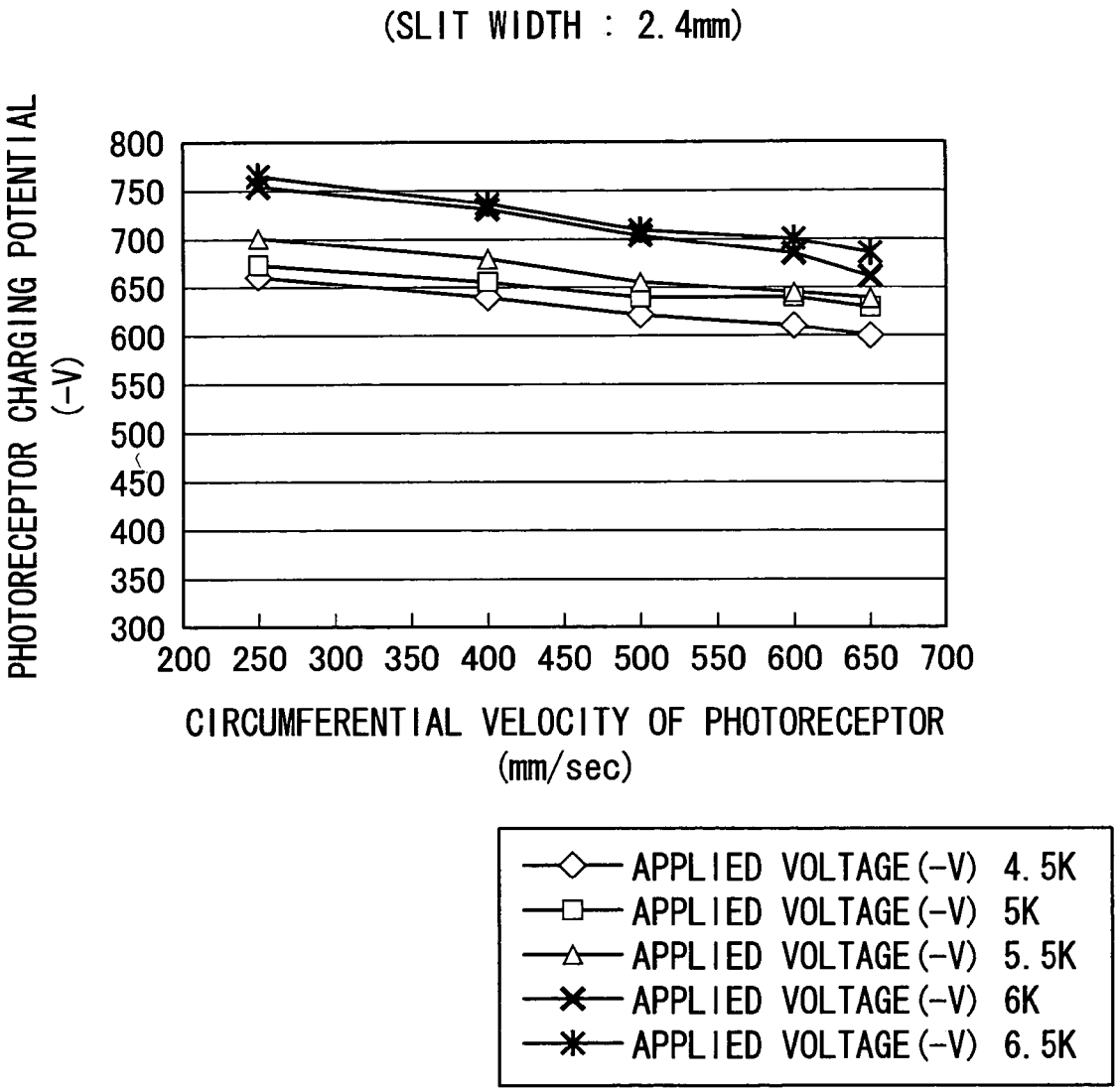
FIG. 32 a view illustrating a result of examination on a relation between a circumferential velocity of the photoreceptor and a charging potential of the photoreceptor in a situation where no grid voltage is applied, at a certain slit width for each of applied voltages.
Figure 33:
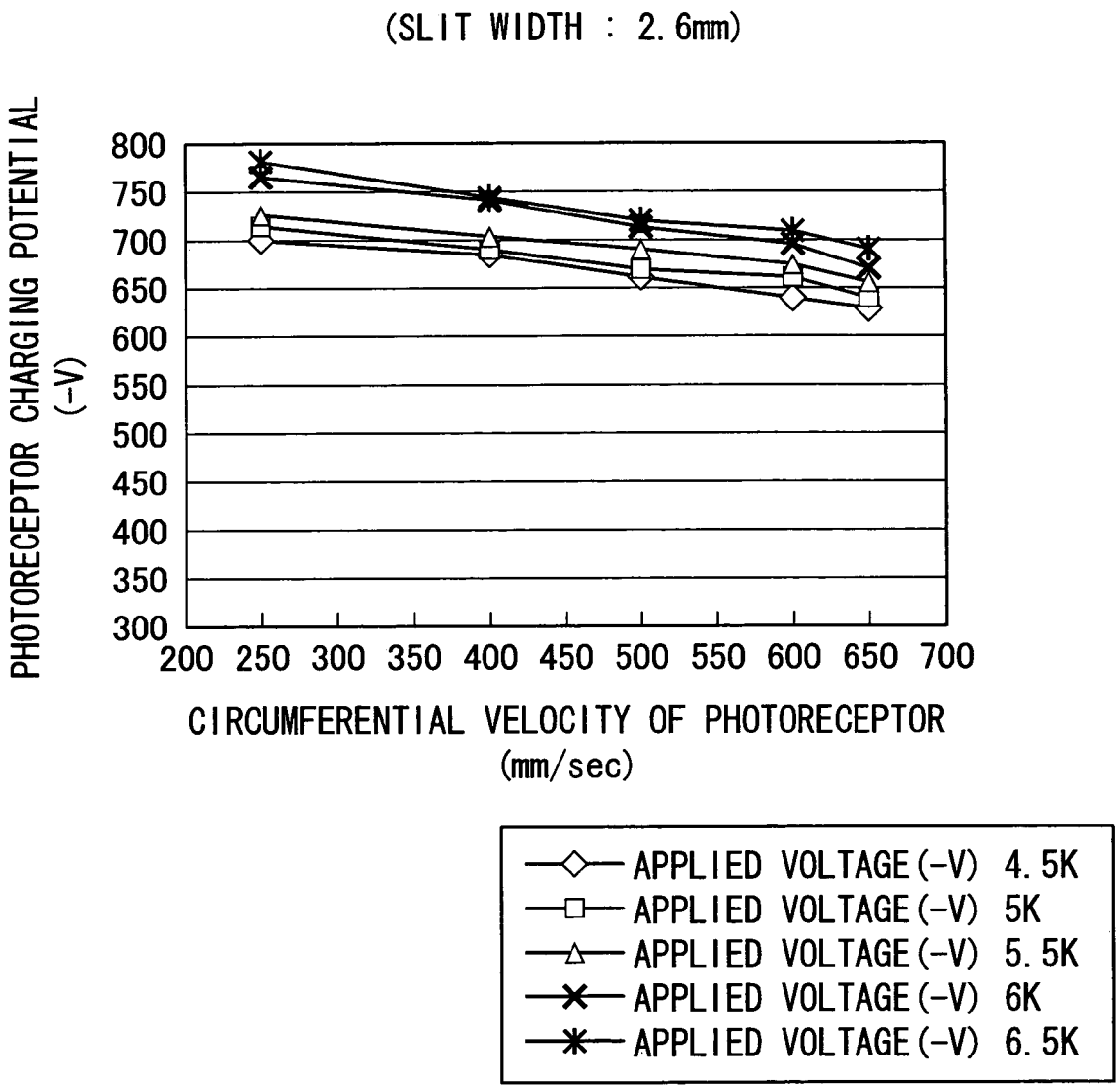
FIG. 33 a view illustrating a result of examination on a relation between a circumferential velocity of the photoreceptor and a charging potential of the photoreceptor in a situation where no grid voltage is applied, at a certain slit width for each of applied voltages.

Similarly, FIGS. 31, 32, and 33 shows results of the examination on a relation between a circumferential velocity of the photoreceptor and a charging potential (ultimate potential) of the photoreceptor in a situation where no grid voltage is applied, with variations of a voltage applied to the charger lines. FIG. 31 shows the result obtained by using the grid electrode having a slit width of 1.8 mm. FIG. 32 shows the result obtained by using the grid electrode having a slit width of 2.4 mm. FIG. 33 shows the result obtained by using the grid electrode having a slit width of 2.6 mm.

Figure 34:
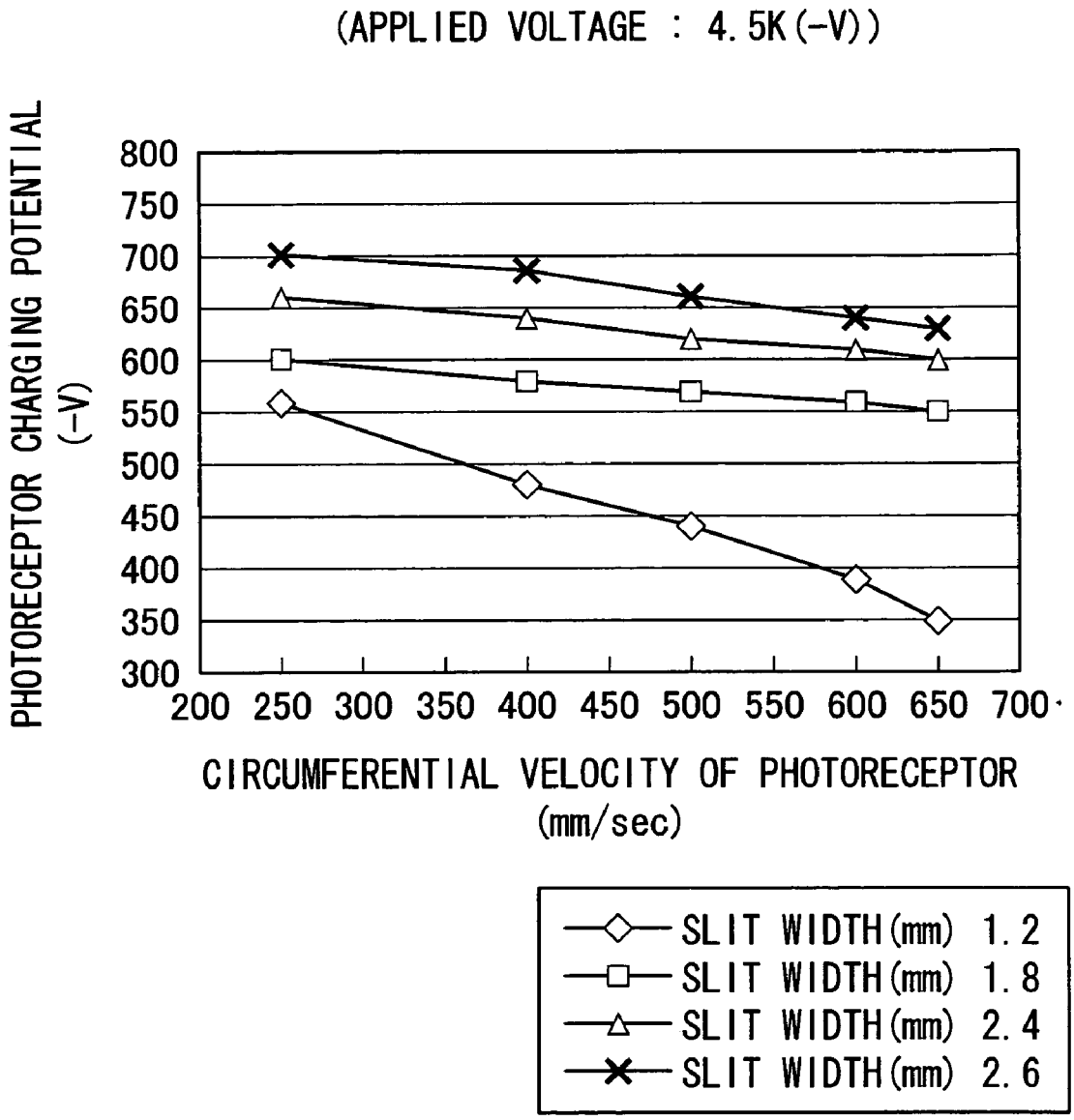
FIG. 34 is a plot of a relation between a circumferential velocity of the photoreceptor and a charging potential of the photoreceptor (in a situation where no grid voltage is applied), at a certain applied voltage for each of slit widths.
Figure 35:
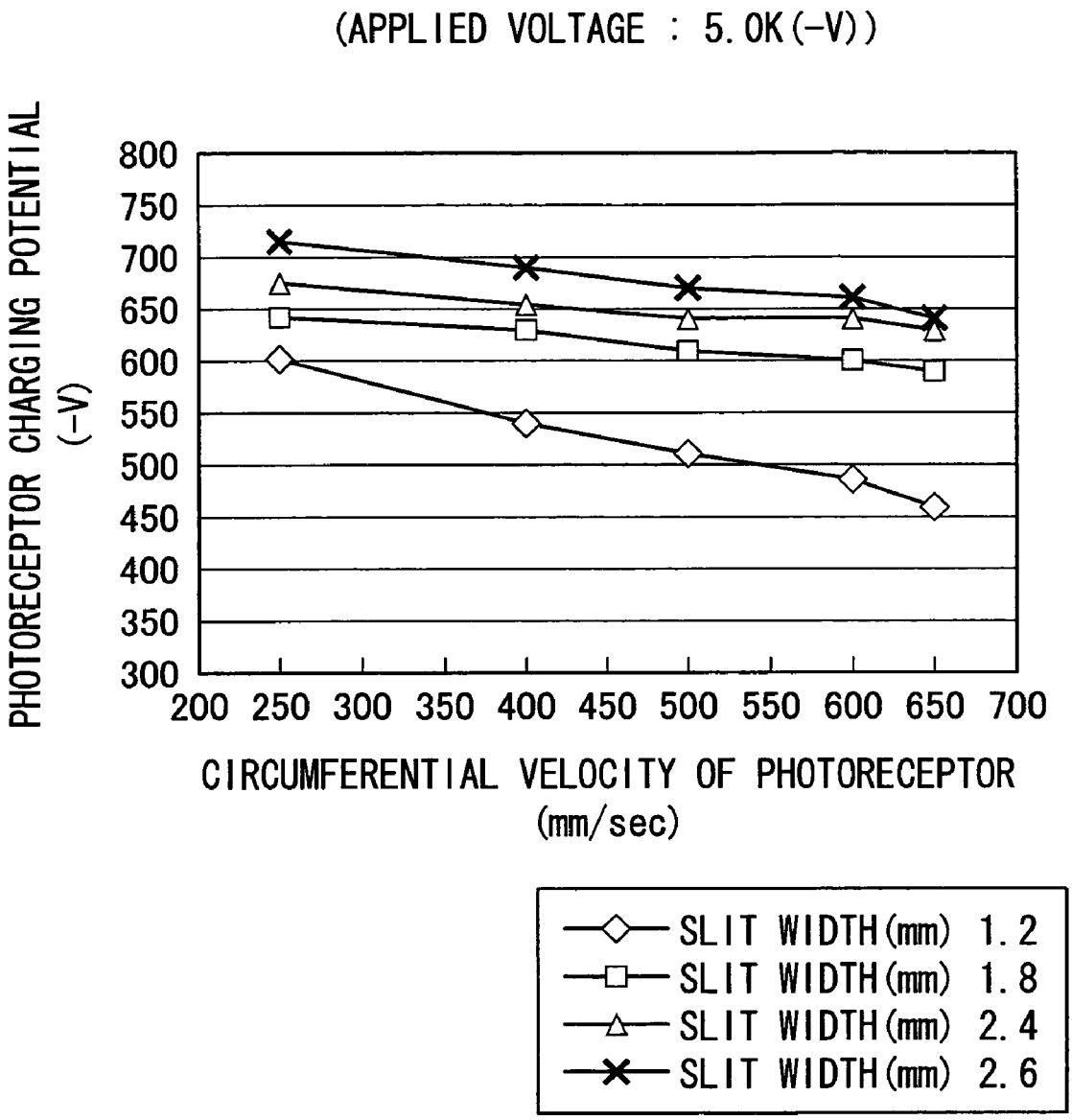
FIG. 35 is a plot of a relation between a circumferential velocity of the photoreceptor and a charging potential of the photoreceptor (in a situation where no grid voltage is applied), at a certain applied voltage for each of slit widths.
Figure 36:
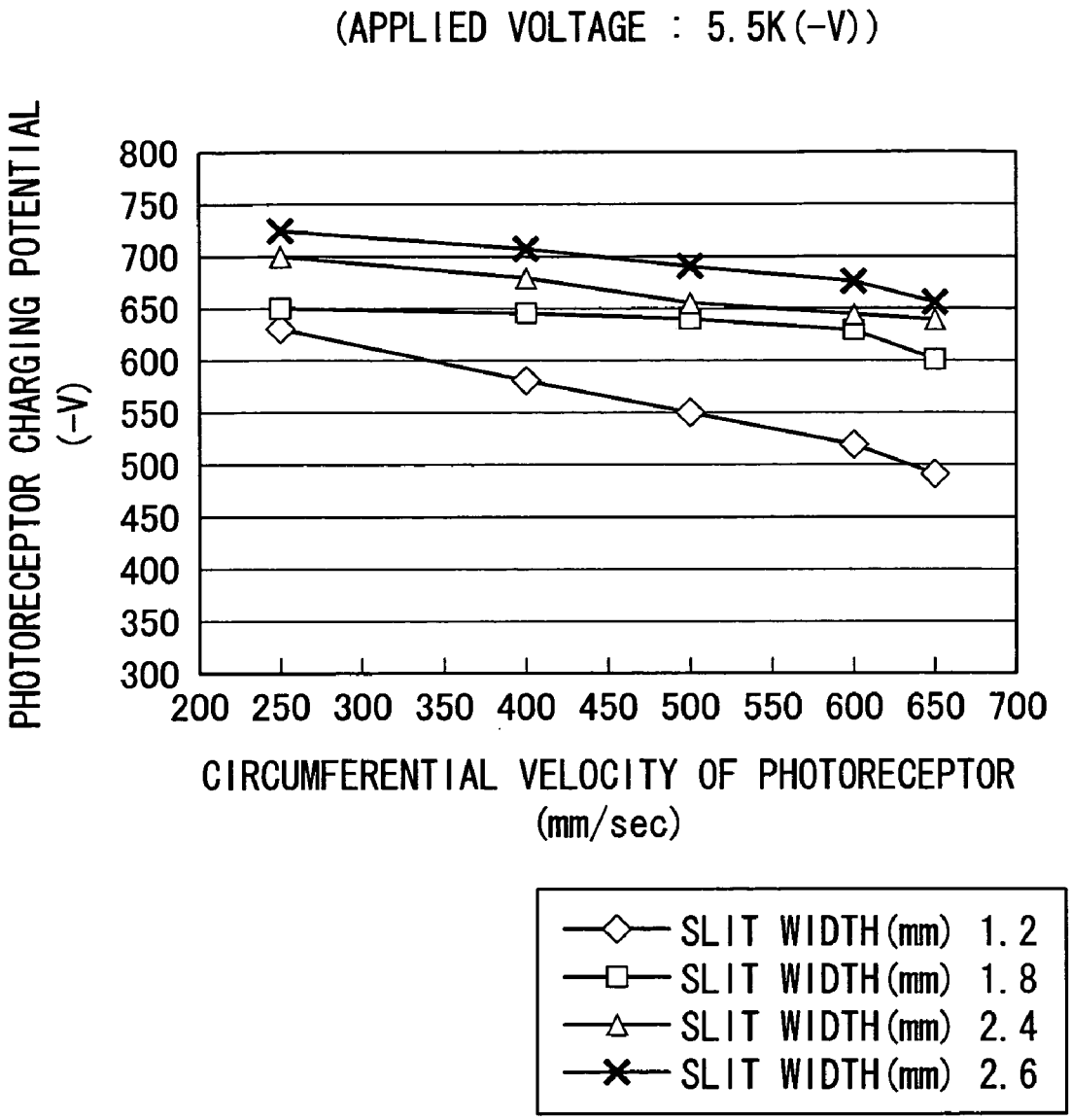
FIG. 36 is a plot of a relation between a circumferential velocity of the photoreceptor and a charging potential of the photoreceptor (in a situation where no grid voltage is applied), at a certain applied voltage for each of slit widths.
Figure 37:
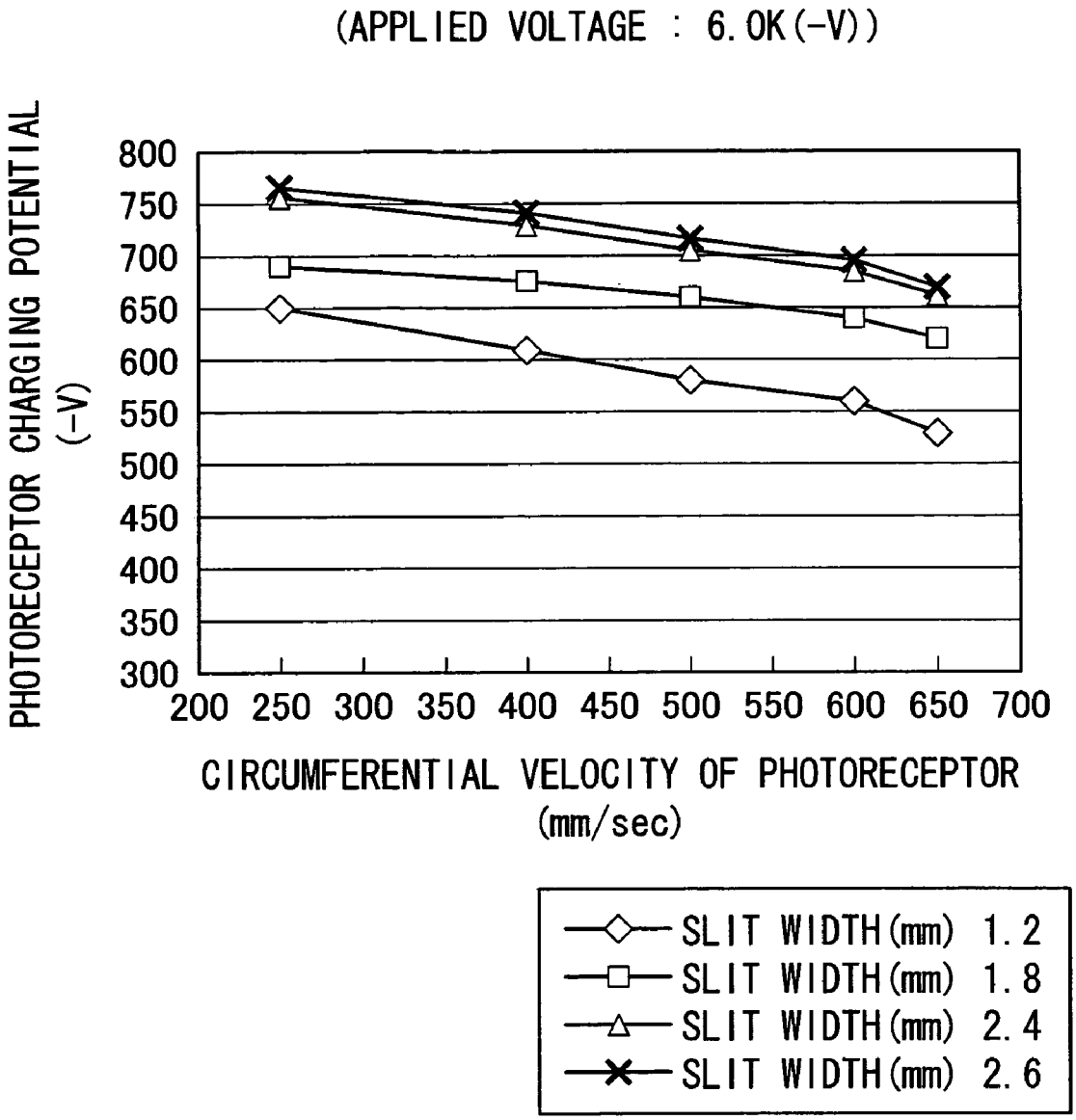
FIG. 37 is a plot of a relation between a circumferential velocity of the photoreceptor and a charging potential of the photoreceptor (in a situation where no grid voltage is applied), at a certain applied voltage for each of slit widths.
Figure 38:
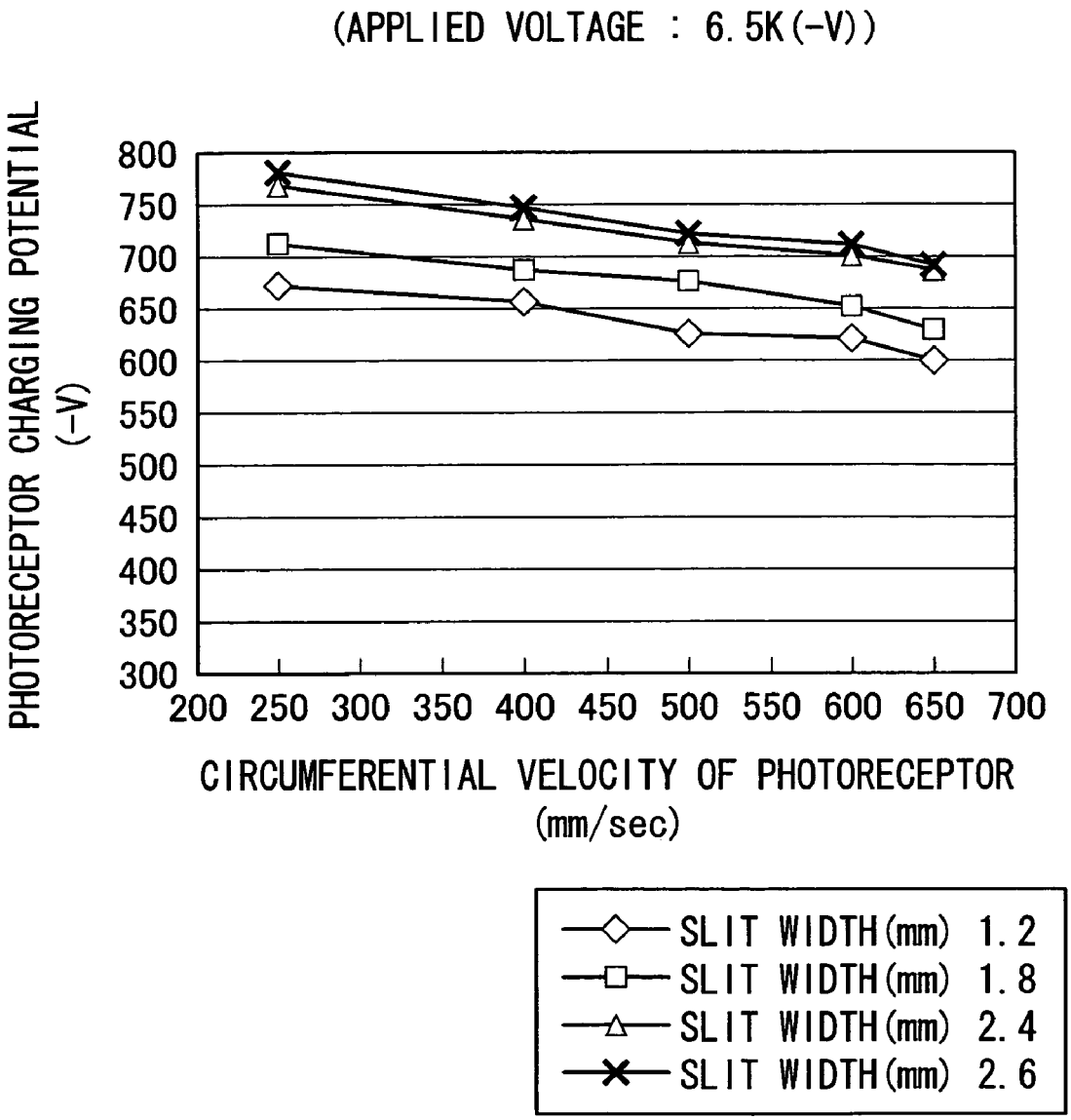
FIG. 38 is a plot of a relation between a circumferential velocity of the photoreceptor and a charging potential of the photoreceptor (in a situation where no grid voltage is applied), at a certain applied voltage for each of slit widths.

On the basis of the results obtained in such a manner, a relation between circumferential velocity of the photoreceptor and a charging potential (ultimate potential) of the photoreceptor in a situation where no grid voltage is applied was plotted for each of the slit widths when the voltages applied to the charger lines are 4.5 K(−V), 5.0 K(−V), 5.5 K(−V), 6.0 K(−V), and 6.5 K(−V). FIG. 34 is a plot of the relation when the voltage applied to the charger lines is 4.5 K(−V). FIG. 35 is a plot of the relation when the voltage applied to the charger lines is 5.0 K(−V). FIG. 36 is a plot of the relation when the voltage applied to the charger lines is 5.5 K(−V). FIG. 37 is a plot of the relation when the voltage applied to the charger lines is 6.0 K(−V). FIG. 38 is a plot of the relation when the voltage applied to the charger lines is 6.5 K(−V).

As is apparent from FIGS. 34 through 38, in the case of the grid electrode having a slit width of 1.2 mm, a charging potential of the photoreceptor did not reach 650 (−V) at a circumferential velocity of 400 even when the applied voltage was 6.0 K(−V). Because of this, data of the result obtained when the slit width was 1.2 mm was left out. Further, the applied voltage of 6.5 K(−V) was also left out for the reason that it is not a practical voltage in consideration of the amount of ozone generated.

Figure 39:
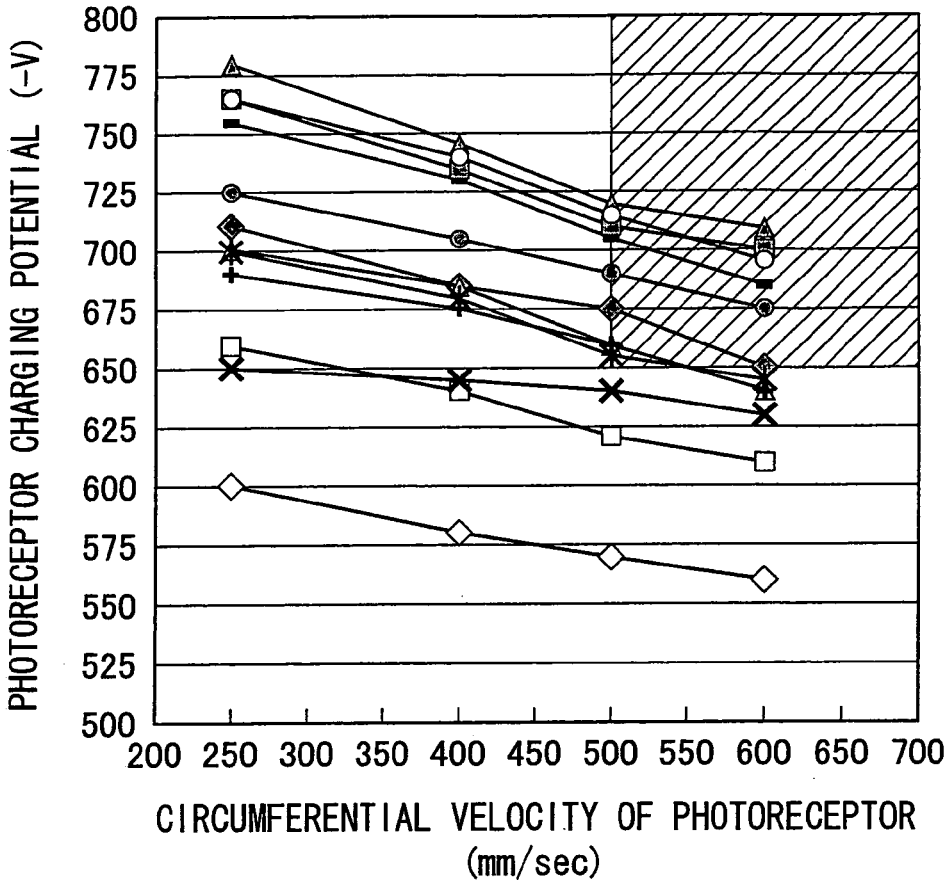
FIG. 39 is a plot of a relation between a circumferential velocity of the photoreceptor and a charging potential of the photoreceptor (in a situation where no grid voltage is applied), for each of the slit widths and each of the applied voltages.

FIG. 39 shows, for each of the slit widths, a relation between a circumferential velocity of the photoreceptor and a charging potential (ultimate potential) of the photoreceptor in a situation where no grid voltage is applied, when the slit widths were 1.8 mm, 2.4 mm, and 2.6 mm, the voltages applied to the charger lines were focused on the range from 4.5 K(−V) to 6.0 K(−V).

In the range in the plot of FIG. 39 where a circumferential velocity of the photoreceptor is 500 mm/sec or more, which is a circumferential velocity of a high-speed apparatus, and a charging potential of the photoreceptor at the circumferential velocity of 500 mm/sec or more is 650 K(−V) (In FIG. 39, the range corresponding to the shaded area), an approximate expression having upper and lower limits can be expressed by the following Equation 1:

$$(-A/7+760)<E<(-A/5+810) \quad \text{Equation 1}$$

where A (mm/sec) is a circumferential velocity of the photoreceptor, and E is a charging potential of the photoreceptor when no grid voltage is applied to the grid electrode.

That is, an ultimate potential of the photoreceptor in a state where no grid voltage is applied is in the range indicated by Equation 1, under the following conditions: a voltage applied to the charger lines is in the range from 5.0 K(V) to 6.0 K(V); a circumferential velocity of the electrostatic latent image carrier is in the range from 500 mm/sec to 600 mm/sec; and the grid electrode is such that a thickness thereof is 0.1 mm, its material is SUS, a slit width thereof ranges from 1.8 mm to 2.6 mm, and a width of an electrode line provided between slits is 0.16 (±0.01) mm.

Thus, in a case when the circumferential velocity A of the photoreceptor has been determined in the range from 500 mm/sec to 600 mm/sec, an ultimate potential of the photoreceptor corresponding to the circumferential velocity A can be obtained from Equation 1. Therefore, by setting the grid voltage to a value equal to or lower than a minimum value of the ultimate potential E, it is possible to control a charging potential of the photoreceptor by using the grid electrode.

Figure 40:
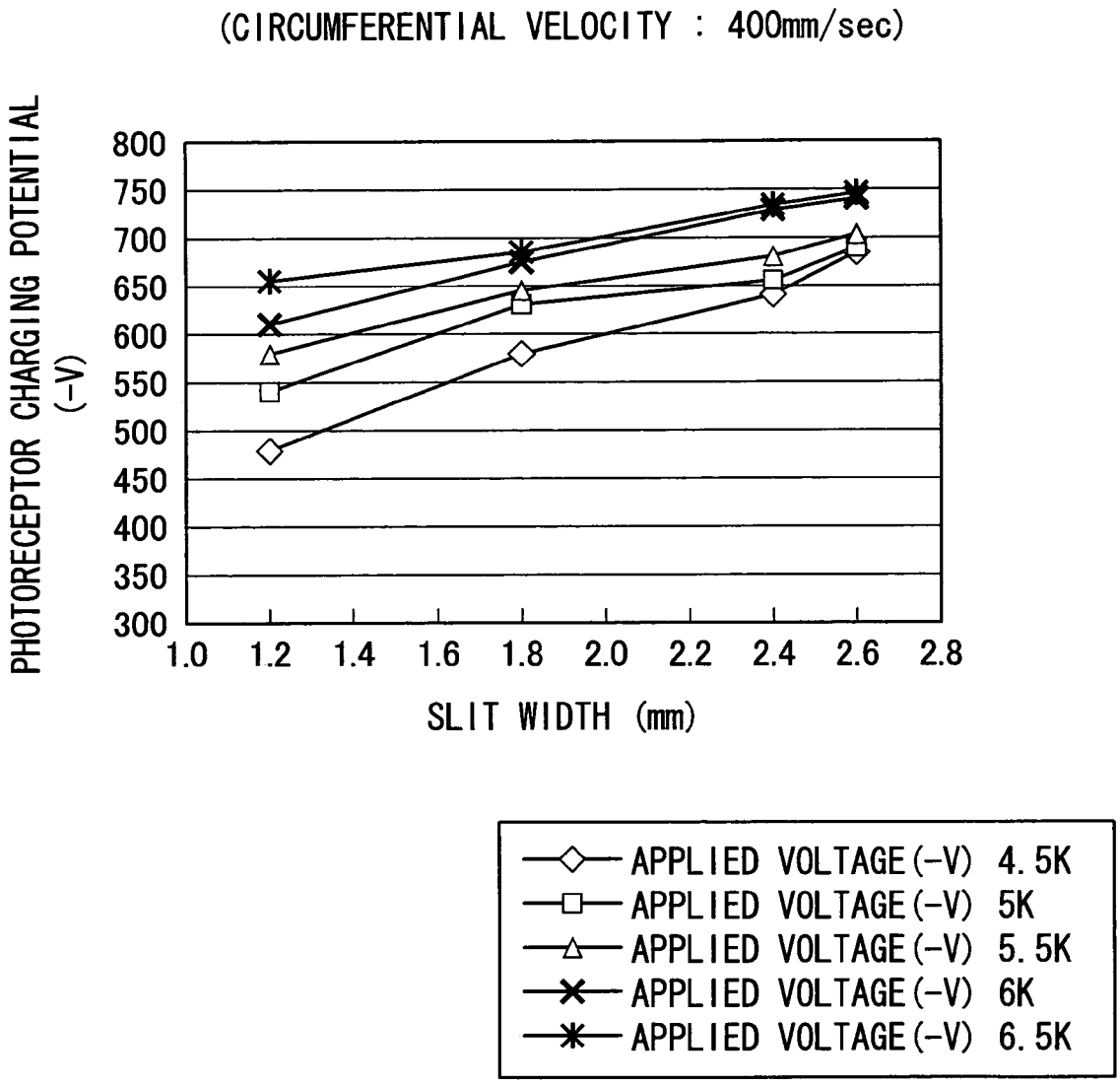
FIG. 40 is a plot of a relation between a slit width and a charging potential of the photoreceptor (in a situation where no grid voltage is applied), at a certain circumferential velocity of the photoreceptor for each of applied voltages.
Figure 41:
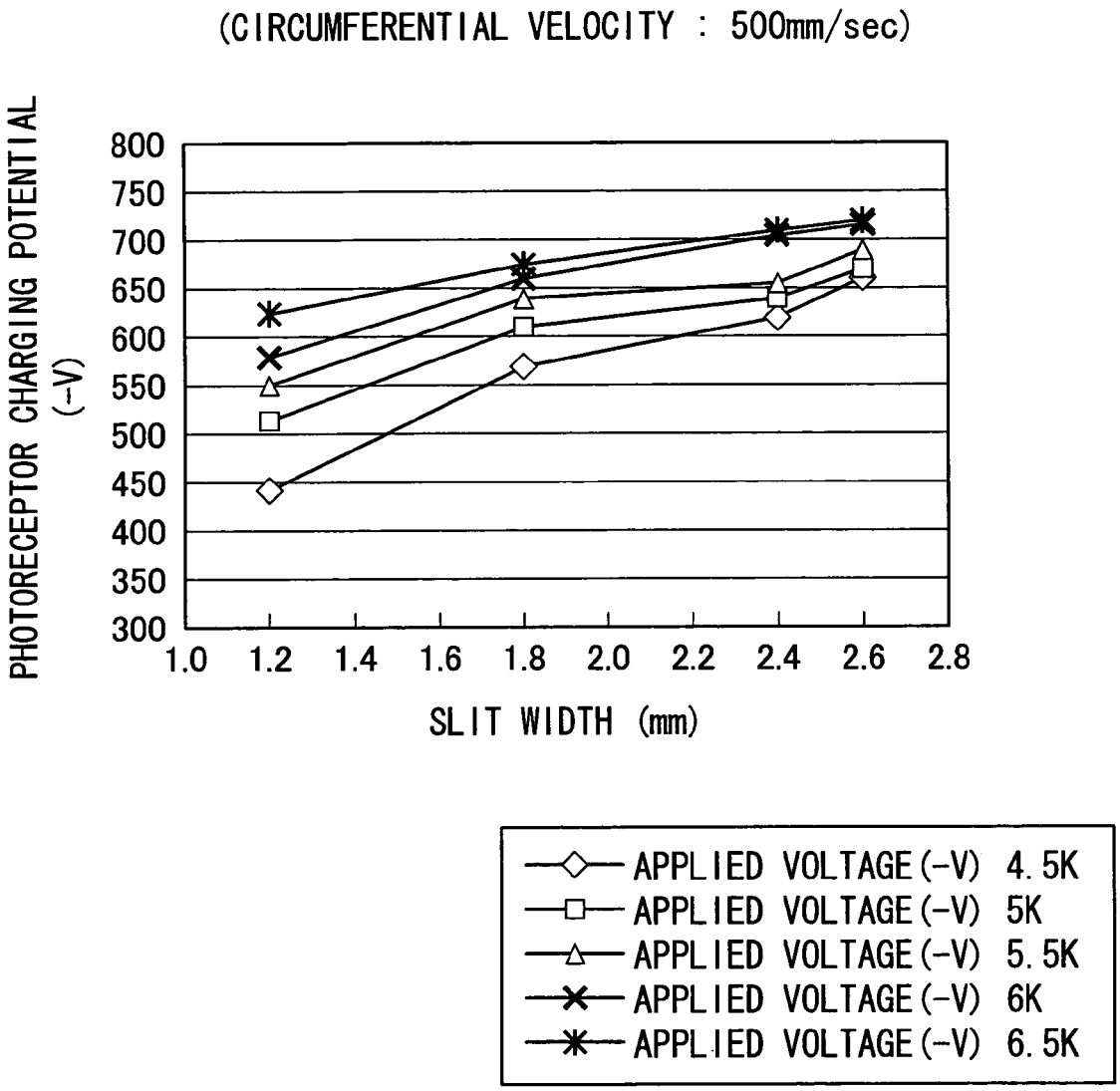
FIG. 41 is a plot of a relation between a slit width and a charging potential of the photoreceptor (in a situation where no grid voltage is applied), at a certain circumferential velocity of the photoreceptor for each of applied voltages.
Figure 42:
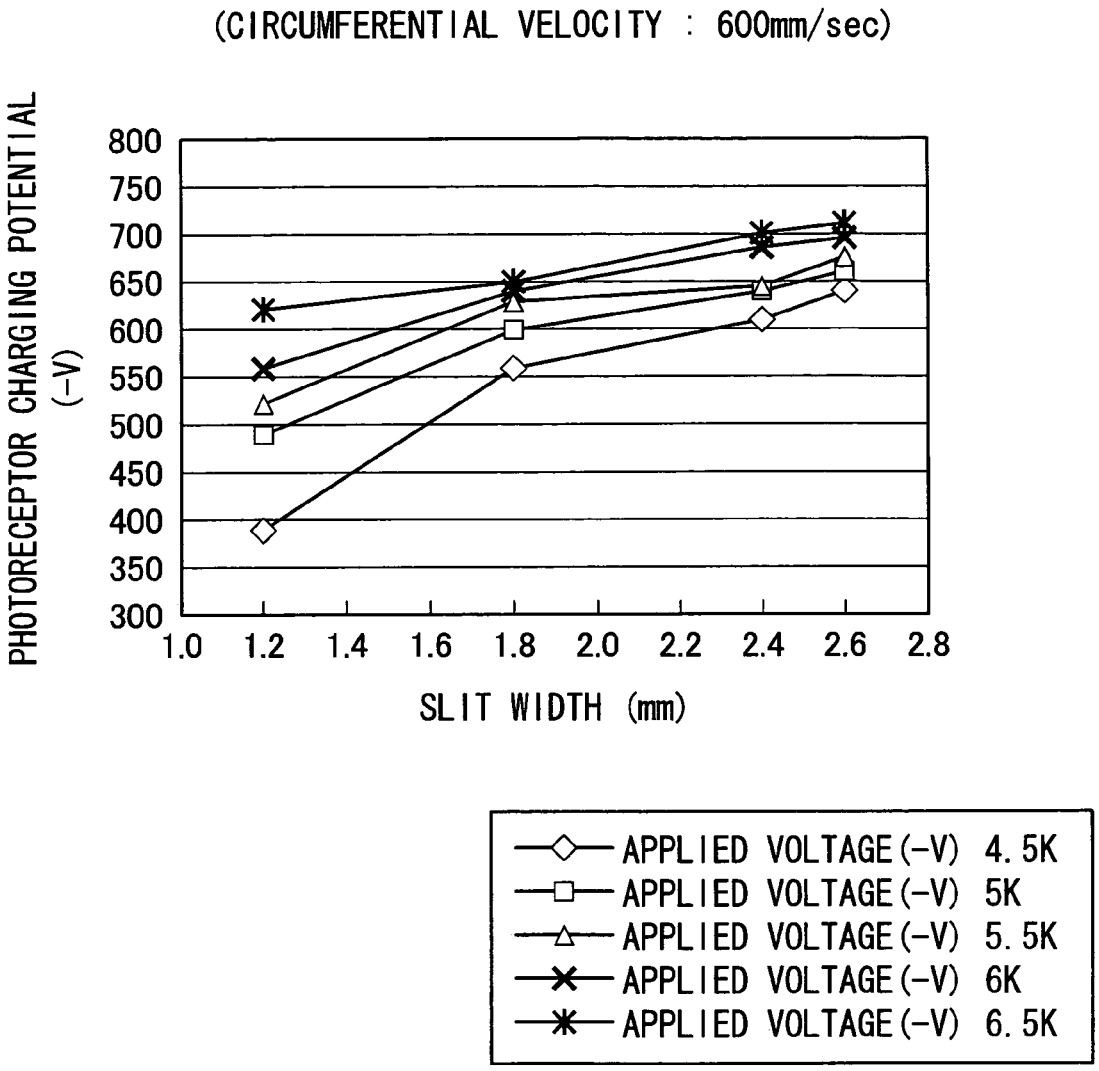
FIG. 42 is a plot of a relation between a slit width and a charging potential of the photoreceptor (in a situation where no grid voltage is applied), at a certain circumferential velocity of the photoreceptor for each of applied voltages.
Figure 43:
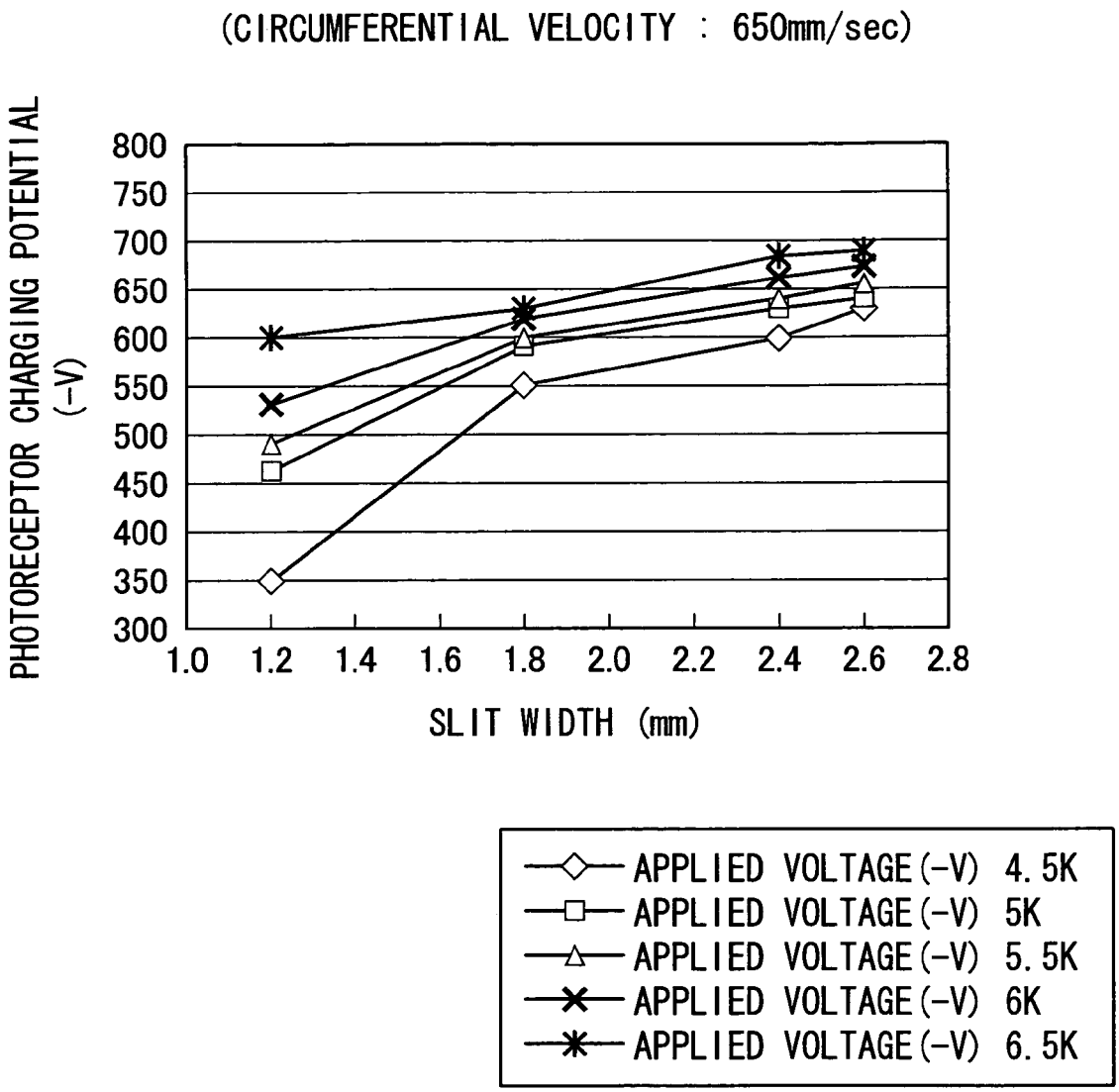
FIG. 43 is a plot of a relation between a slit width and a charging potential of the photoreceptor (in a situation where no grid voltage is applied), at a certain circumferential velocity of the photoreceptor for each of applied voltages.

Similarly, on the basis of the results shown in FIGS. 30 through 33, a relation between a slit width and a charging potential (ultimate potential) of the photoreceptor in a situation where no grid voltage is applied was plotted for each of the voltages applied to the charger lines when the circumferential velocities of the photoreceptor are 400 mm/sec, 500 mm/sec, 600 mm/sec, and 650 mm/sec. FIG. 40 is a plot of the relation when the circumferential velocity of the photoreceptor is 400 mm/sec. FIG. 41 is a plot of the relation when the circumferential velocity of the photoreceptor is 500 mm/sec. FIG. 42 is a plot of the relation when the circumferential velocity of the photoreceptor is 600 mm/sec. FIG. 43 is a plot of the relation when the circumferential velocity of the photoreceptor is 650 mm/sec.

Figure 44:
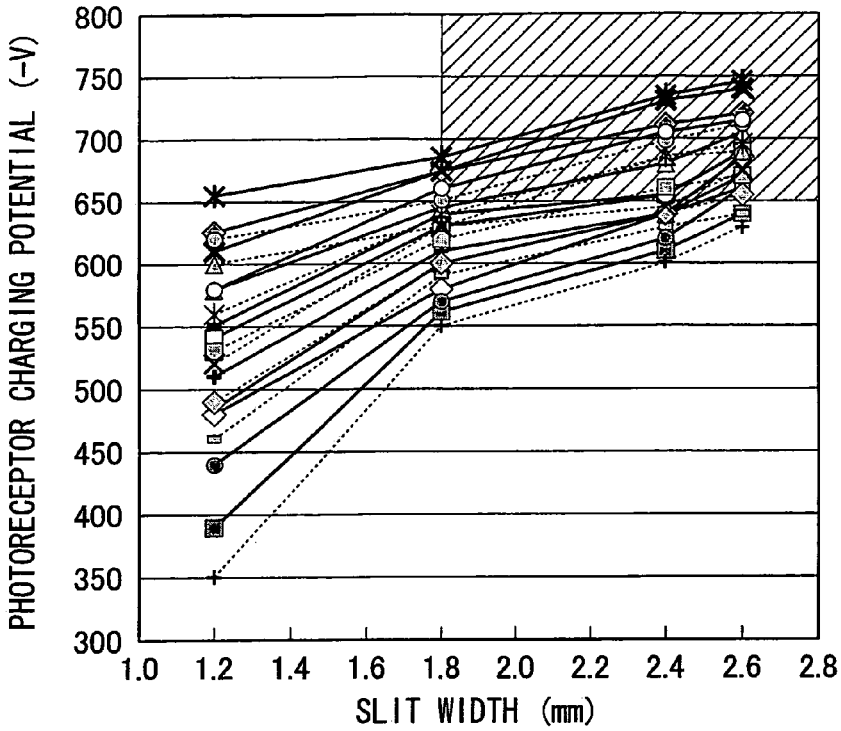
FIG. 44 is a plot of a relation between a slit width and a charging potential of the photoreceptor (in a situation where no grid voltage is applied), for each of the applied voltages and each of the circumferential velocities of the photoreceptor.
Figure 45:
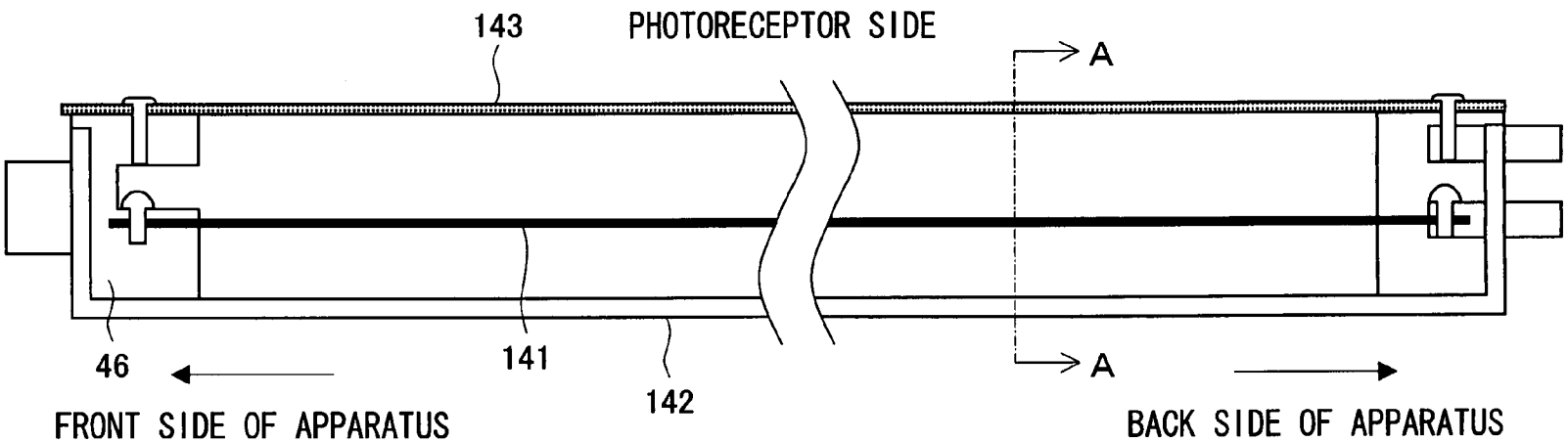
FIGS. 45(*a*) and 45(*b*) are views illustrating the structure of the conventional scorotron charging device.
Figure 45:
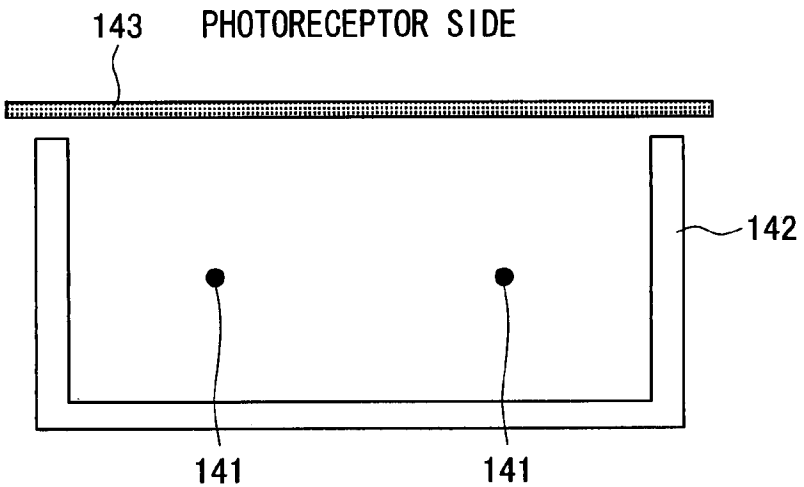
Figure 46:
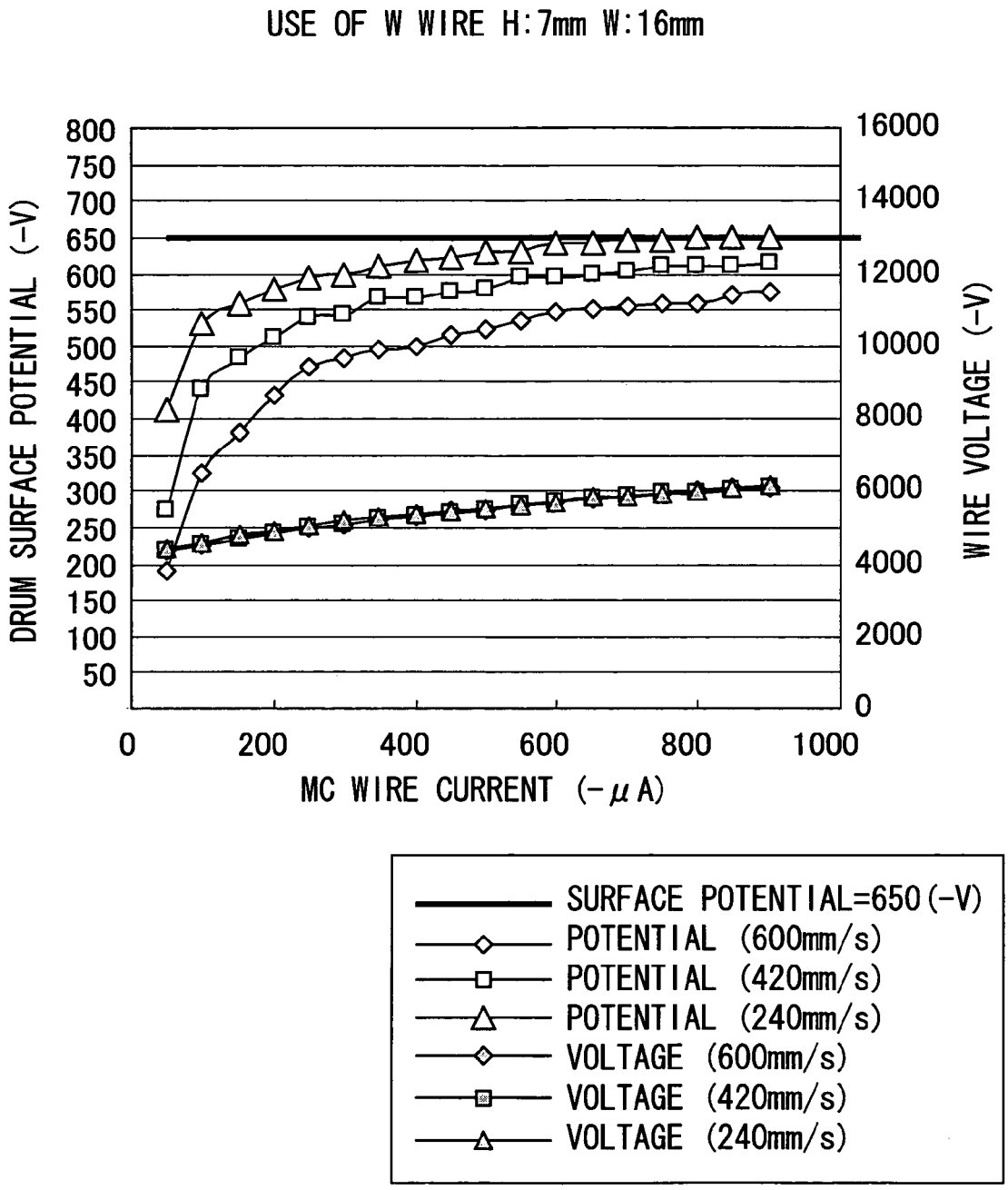
FIG. 46 is a view illustrating a relation between a wire current, a drum surface potential, and a wire voltage in the scorotron charging device when a circumferential velocity of a photoreceptor is changed.

FIG. 44 shows, for each of the voltages applied to the charger lines, a relation between a slit width and a charging potential (ultimate potential) of the photoreceptor in a situation where no grid voltage is applied.

In the range in the plot of FIG. 44 where the slit width is 1.8 mm or more, which is effective for charging in the high-speed apparatus, and a charging potential of the photoreceptor at the slit width of 1.8 mm or more is 650 (−V) (In FIG. 44, the range corresponding to the shaded area), an approximate expression having upper and lower limits can be expressed by the following Equation 2:

$$(72B+520)<E<(75B+515) \quad \text{Equation 2}$$

where B (mm) is a slit width of the grid electrode, and E is a charging potential of the photoreceptor when no grid voltage is applied to the grid electrode.

That is, an ultimate potential of the photoreceptor in a state where no grid voltage is applied is also in the range indicated by Equation 2, under the following conditions: a voltage applied to the charger lines is in the range from 5.0 K(V) to 6.0 K(V); a circumferential velocity of the electrostatic latent image carrier is in the range from 500 mm/sec to 600 mm/sec; and the grid electrode is such that a thickness thereof is 0.1 mm, its material is SUS, a slit width thereof ranges from 1.8 mm to 2.6 mm, and a width of an electrode line provided between slits is 0.16 (±0.01) mm.

Thus, in a case when the slit width B of the grid electrode has been determined in the range from 1.8 mm to 2.6 mm, an ultimate potential of the photoreceptor corresponding to the slit width B can be obtained from Equation 2. Therefore, by setting the grid voltage to a value equal to or lower than a minimum value of the ultimate potential E, it is possible to control a charging potential of the photoreceptor by using the grid electrode.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A charging device which is installed in an electrophotographic apparatus and charges at a predetermined potential a surface of an electrostatic latent image carrier which is driven for rotation, the charging device comprising:

at least one wire which is subjected to application of a high voltage and placed at a position that faces the electrostatic latent image carrier so that an axial direction of the wire is orthogonal to a rotational direction of the electrostatic latent image carrier;

a shield electrode which shields the wire and has an open surface that faces the electrostatic latent image carrier; and a meshed grid electrode which is placed so as to face the open surface of the shield electrode, wherein:

the grid electrode is arranged to be a fine-meshed grid electrode as a circumferential velocity of the electrostatic latent image carrier is low, and to be a coarse-meshed grid electrode as a circumferential velocity of the electrostatic latent image carrier is high.

2. An electrophotographic apparatus comprising: an electrostatic latent image carrier which retains an electrostatic latent image formed on a surface thereof and is driven for rotation; and a charging device which charges a surface of the electrostatic latent image carrier at a predetermined potential, the charging device being realized by one scorotron charger, the scorotron charger comprising:

at least one wire which is subjected to application of a high voltage and placed at a position that faces the electrostatic latent image carrier so that an axial direction of the wire is orthogonal to a rotational direction of the electrostatic latent image carrier;

a shield electrode which shields the wire and has an open surface that faces the electrostatic latent image carrier; and a meshed grid electrode which is placed so as to face the open surface of the shield electrode, wherein:

the grid electrode is arranged to be a fine-meshed grid electrode as a circumferential velocity of the electrostatic latent image carrier is low, and to be a coarse-meshed grid electrode as a circumferential velocity of the electrostatic latent image carrier is high.

3. The electrophotographic apparatus according to claim 2, wherein:

the circumferential velocity of the electrostatic latent image carrier ranges from 500 mm/sec to 600 mm/sec; and the grid electrode has a plurality of slits such that a slit width ranges from 1.8 mm to 2.4 mm and a slit pitch ranges from 1.95 mm to 2.57 mm.

4. The electrophotographic apparatus according to claim 2, wherein:

the circumferential velocity of the electrostatic latent image carrier ranges from 500 mm/sec to 600 mm/sec; and the grid electrode has a plurality of polygonal openings such that a diameter of each of circumcircles around the polygonal openings ranges 3.5 mm to 4.5 mm and a pitch between the circumcircles ranges 3.75 mm to 4.75 mm.

5. The electrophotographic apparatus according to claim 2, wherein:

a voltage applied to the wire ranges from 5.0 K(V) to 6.0 K(V);

the circumferential velocity of the electrostatic latent image carrier ranges from 500 mm/sec to 600 mm/sec; and the grid electrode is 0.1 mm in thickness, made of SUS, has a slit width ranging from 1.8 mm to 2.6 mm, and has a 0.16 (±0.01) mm-wide electrode line provided between slits.

* * * * *